US007673569B2

(12) United States Patent
Ishikawa et al.

(10) Patent No.: US 7,673,569 B2
(45) Date of Patent: Mar. 9, 2010

(54) METHOD OF AND SYSTEM FOR MANAGING RACK OPERATION, METHOD OF AND SYSTEM FOR MANAGING MULTISTAGE RACK, ARTICLE CONVEYANCE AND STORAGE DEVICE, AND COMPUTER PRODUCT

(75) Inventors: Sakae Ishikawa, Kanagawa-ken (JP); Satoshi Ishihara, Saitama (JP); Tomoaki Arai, Tokyo (JP); Isamu Tanaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1394 days.

(21) Appl. No.: 11/079,251

(22) Filed: Mar. 15, 2005

(65) Prior Publication Data

US 2005/0159839 A1 Jul. 21, 2005

Related U.S. Application Data

(62) Division of application No. 09/848,764, filed on May 4, 2001.

(30) Foreign Application Priority Data

May 8, 2000 (JP) ..... 2000-135235
Nov. 22, 2000 (JP) ..... 2000-356640
Feb. 22, 2001 (JP) ..... 2001-047288

(51) Int. Cl.
*B65D 19/44* (2006.01)

(52) U.S. Cl. ..... 108/55.1

(58) Field of Classification Search ..... 108/55.1, 108/55.3, 55.5, 56.1, 51.11, 57.25; 206/386, 206/597, 598, 600; 248/346.02
See application file for complete search history.

(56) References Cited

U.S. PATENT DOCUMENTS 4,915,033 A * 4/1990 Bond ..... 108/55.1
5,093,794 A 3/1992 Howie et al.
5,109,985 A * 5/1992 Rose ..... 108/55.1
5,133,108 A * 7/1992 Esnault ..... 16/225
5,147,176 A 9/1992 Stolzer et al.
5,161,929 A 11/1992 Lichti, Sr.

(Continued)

FOREIGN PATENT DOCUMENTS

JP 48-4079 1/1973

(Continued)

OTHER PUBLICATIONS

U.S. Appl. No. 11/365,687, filed Mar. 2, 2006, Arai et al.

(Continued)

*Primary Examiner*—José V Chen
(74) *Attorney, Agent, or Firm*—Oblon, Spivak, McClelland, Maier & Neustadt, L.L.P.

(57) ABSTRACT

When a first article is to be delivered to a customer and a second article is to be collected from the customer, first rack components required for delivery of the first article and second rack components not required for delivery of the first article, yet required for collecting the second article, are specified. Delivery procedure and collection procedure of the articles using the specified first rack components and second rack components are instructed to a worksite. Accordingly, delivery and collection of the articles can be carried out by making efficient use of the rack components commonly used for the first article and the second article.

5 Claims, 38 Drawing Sheets

U.S. PATENT DOCUMENTS

| | | | | |
|---|---|---|---|---|
| 5,190,427 | A | 3/1993 | Lai | |
| 5,373,451 | A | 12/1994 | Furukawa | |
| 5,401,229 | A | 3/1995 | Otsuka et al. | |
| 5,403,147 | A | 4/1995 | Tanaka | |
| 5,468,110 | A | 11/1995 | McDonald et al. | |
| 5,472,309 | A | 12/1995 | Bernard et al. | |
| 5,538,178 | A * | 7/1996 | Zink et al. | 229/117.01 |
| 5,644,991 | A * | 7/1997 | Prevot et al. | 108/54.1 |
| 5,669,748 | A | 9/1997 | Knudsen, Jr. | |
| 5,694,638 | A | 12/1997 | Maruyama et al. | |
| 5,758,329 | A | 5/1998 | Wojcik et al. | |
| 5,762,222 | A * | 6/1998 | Liu | 206/600 |
| 5,842,424 | A * | 12/1998 | Prevot et al. | 108/54.1 |
| 5,911,179 | A * | 6/1999 | Spiczka | 108/51.11 |
| 5,918,551 | A * | 7/1999 | Liu | 108/55.1 |
| 5,970,886 | A * | 10/1999 | Knio | 108/57.12 |
| 6,044,990 | A | 4/2000 | Palmeri | |
| 6,105,014 | A | 8/2000 | Ramsden et al. | |
| 6,105,511 | A * | 8/2000 | Bridges | 108/55.3 |
| 6,125,306 | A | 9/2000 | Shimada et al. | |
| 6,293,400 | B1 | 9/2001 | Arai et al. | |
| 6,311,438 | B1 | 11/2001 | Haquette | |
| 6,317,648 | B1 | 11/2001 | Sleep et al. | |
| 6,343,555 | B1 | 2/2002 | Arai et al. | |
| 6,377,867 | B1 | 4/2002 | Bradley et al. | |
| 6,418,612 | B1 | 7/2002 | Chuang et al. | |
| 6,463,863 | B1 * | 10/2002 | Ishikawa et al. | 108/53.1 |
| 6,556,888 | B2 | 4/2003 | Kantola | |
| 6,571,213 | B1 | 5/2003 | Altendahl et al. | |
| 6,602,032 | B2 * | 8/2003 | Arai | 108/55.1 |
| 7,219,609 | B1 * | 5/2007 | Utz et al. | 108/57.21 |
| 2007/0283858 | A1 * | 12/2007 | Ballard | 108/57.12 |

FOREIGN PATENT DOCUMENTS

| | | |
|---|---|---|
| JP | 60-177028 | 11/1985 |
| JP | 1-147939 | 10/1989 |
| JP | 1-147943 | 10/1989 |
| JP | 5-330555 | 12/1993 |
| JP | 6-107309 | 4/1994 |
| JP | 3012789 | 4/1995 |
| JP | 7-26700 | 5/1995 |
| JP | 3020629 | 11/1995 |
| JP | 8-156935 | 6/1996 |
| JP | 10-81332 | 3/1998 |
| JP | 10-194280 | 7/1998 |
| JP | 10-222568 | 8/1998 |
| JP | 11-120250 | 4/1999 |
| JP | 11-165735 | 6/1999 |
| JP | 11-245946 | 9/1999 |
| JP | 11-290551 | 10/1999 |
| JP | 11-348985 | 12/1999 |
| JP | 2000-264337 | 9/2000 |

OTHER PUBLICATIONS

U.S. Appl. No. 11/347,308, filed Feb. 6, 2006, Naruishi et al.
U.S. Appl. No. 10/611,976, filed Jul. 3, 2003, Arai et al.

* cited by examiner

FIG.11

OPERATING RACK MANAGEMENT TABLE 140g

| DOUBLE-STACKED RACK | ASSEMBLED RACK | RACK COMPONENTS | LOCATION |
|---|---|---|---|
| W123 | S11 | TOP a1<br>SUPPORT b1<br>PAD c1<br>PALLET d1 | MAIN-BODY PRODUCTION SITE 122 |
| | S12 | TOP a2<br>SUPPORT b2<br>PAD c2<br>PALLET d2 | |
| W234 | S21 | TOP a3<br>SUPPORT b3<br>PAD c3<br>PALLET d3 | PAPER-FEEDER PRODUCTION SITE 123 |
| | S22 | TOP a4<br>SUPPORT b4<br>PAD c4<br>PALLET d4 | |
| | | | |

FIG.12

OPERATING RACK MANAGEMENT TABLE 140g

| DOUBLE-STACKED RACK | ASSEMBLED RACK | RACK COMPONENTS | LOCATION |
|---|---|---|---|
| W345 | S11 | TOP a1<br>SUPPORT b1<br>PAD c1<br>PALLET d1 | SALES-USE WAREHOUSE 124 |
| | S21 | TOP a3<br>SUPPORT b3<br>PAD c3<br>PALLET d3 | |
| W456 | S12 | TOP a2<br>SUPPORT b2<br>PAD c2<br>PALLET d2 | SALES-USE WAREHOUSE 124 |
| | S22 | TOP a4<br>SUPPORT b4<br>PAD c4<br>PALLET d4 | |
| | | | |

METHOD OF AND SYSTEM FOR MANAGING RACK OPERATION, METHOD OF AND SYSTEM FOR MANAGING MULTISTAGE RACK, ARTICLE CONVEYANCE AND STORAGE DEVICE, AND COMPUTER PRODUCT

This application is a division of U.S. patent application Ser. No. 09/848,764 filed May 4, 2001. The entire contents of this application are incorporated herein by reference.

FIELD OF THE INVENTION

The present invention relates to a technology for managing racks used for packing, storing or delivering articles or products.

BACKGROUND OF THE INVENTION

Conventionally, when a maker receives an order of a product such as a copier or a facsimile from a customer, the product is packaged by a packaging member such as a corrugated board and delivered to the customer site, but disposal of the used packaging member is left to the customer.

However, in order to deliver the product as a precision machine, some strength has to be given to the packaging member using the corrugated board. Resultantly, the packaging member becomes comparatively costly even though it is a disposable one. Referring to the recent environmental problems, if the disposable type of packaging member is used, the load of disposing the member is put more heavily on the customer.

Therefore, in recent years, the case of repeatedly using a rack explained below for delivery of an article has been increased. This rack is assembled with rack components made of resin or metal and is capable of being disassembled or folded. For example, in Japanese Patent Application No. HEI 11-290551 filed by the applicant of this application, an article conveyance and storage device is disclosed. In this device, coupling members are provided between two adjacent supports so that each distance of the supports detachably fitted to four corners of a pallet where an article is loaded can be freely changed. When the pallets from which the supports are detached are vertically stacked, a support unit formed with the supports and the coupling members is accommodated in the internal side of the pallets.

However, even if the conventional rack represented by this conventional art is used, there comes up a problem such that the rack operation becomes more complicated just because the rack has been produced based on the idea of its reuse though the times of repeatedly using the rack are prolonged.

For example, there are many cases where a new product of a copier is delivered to a customer and at the same time an old product already owned by the customer is collected at the customer site. However, if the shape of the new product is different from that of the old one, the same rack can not be used. Accordingly, a rack for delivering the new product and a rack for collecting the old product have to be separately brought to the customer site.

Recently in particular, the disposal of the electric appliances have become burdensome for customers. Needs for customers who desire old products to be collected at the time of purchasing new products has tended to increase. Therefore, it is an extremely important matter how efficiently collect such products. This matter is applied not only to the electric appliances but also to a self-propelled device and a non-self-propelled device other than an image formation device. This matter is also applied to any device that does not function singly, parts forming a device, a container with liquid, gas, or a solid burned to produce heat or power and an empty container, or a substance to be conveyed such as a solid burned to produce heat or power, non-food/drinks or food/drinks.

The conventional rack represented by this conventional art has to be collected and reused after an article is delivered to a customer. Therefore, it is important how to manage these racks and rack components forming each of the racks. In such a case, it can be considered that the rack components in use are discretely managed for each rack. However, when an enormous number of articles are to be delivered to a variety of customers, the number of racks in use becomes also enormous. Therefore, how to efficiently manage the racks in use becomes an extremely significant problem.

Especially, when the conventional type of copier is to be delivered using a repeatedly-usable rack, this type of copier is accompanied with large-sized mechanical components such as a paper feeder and a sorter. Therefore, it is necessary to efficiently manage multistage racks to be assembled at a plurality of production sites and new multistage racks obtained after the plurality of multistage racks are reassembled.

For example, when main bodies (X) of copiers are produced at a production site A and paper feeders (Y) are produced at a production site B, a double-stacked rack as X/X is carried from the production site A to a relay point, and a double-stacked rack as Y/Y is carried from the production site B to the relay point. Two double-stacked racks as X/Y and X/Y are delivered from the relay point to the customer. Therefore, these double-stacked racks have to be efficiently managed.

Further, the above-mentioned types of article conveyance and storage devices have conventionally been known. These article conveyance and storage devices are used to convey industrial products such as electric appliances, various types of components, various materials such as architectural materials, furniture, natural substances, or some other articles, and to store them. In order to convey or store an article by such an article conveyance and storage device, the article is first loaded onto a pallet of the device directly or through another member. A plurality of supports are fitted to the pallet so as to surround the article with these supports. This article is then conveyed or stored together with the article conveyance and storage device.

For example, there is a case where the article is transported from one site to another using the article conveyance and storage device, the article is unloaded from the pallet at the destination, and the article conveyance and storage device is transported to the original site to be collected. In such a case, as the supports can be detached from the pallet, these supports can be folded to be compact in size and efficiently be transported back to the original site. When the article conveyance and storage device is not used, the device can also be stored in such a state.

However, a plurality of supports are provided in the article conveyance and storage device. Therefore, if these supports detached from the pallet may come apart, the working efficiency at the time of conveying such supports will decrease. Further, a large space may be required for conveying or storing these supports. Such inconvenience will become significant when the supports of a large number of article conveyance and storage devices are collectively transported back to the original site or stored therein.

The article conveyance and storage device, in which two adjacent supports are coupled by coupling members so as to be capable of being closer to or apart from each other, has been proposed by the applicant of this application (JP, HEI 11-348985A). In this device, when the supports are detached from the pallet, the supports may move relatively. Therefore, it is also difficult to efficiently convey these supports.

To solve the problem, there is an idea that the plurality of supports detached from the pallet are bundled by a fastening tool such as a band or a loop and the bundled supports are conveyed or stored. However, if doing so, the fastening tool is always carried together with the article conveyance and storage device. Accordingly, the conveying work of the articles and the collecting work of the article conveyance and storage device are inevitably complicated. Further, it is quite difficult to fasten these supports firmly so as not to be moved even if these supports are bundled by the fastening tool.

On the other hand, when an article is loaded on a pallet, a plurality of supports are fitted to the pallet, and the article is conveyed, if there is a large gap between the article and each of the supports, the article largely vibrates due to an impactive force or the like added during conveyance, which may cause the article to be damaged. Therefore, by providing shock absorbers between the article and the supports to hold the article by the supports through the shock absorbers, the vibration of the article can be suppressed.

Conventionally, a corrugated board or the like has been used as the shock absorber, and this shock absorber has been packed into between the article and each of the supports. However, it is not easy to keep such a shock absorber between the article and the support without displacement, and the work for packing the shock absorber into the space between the article and the support has also been awkward. Further, the corrugated board has been generally disposed at a destination. Resultantly, a large amount of wastes has been produced at the destination.

SUMMARY OF THE INVENTION

It is an object of this invention to provide a system and method of managing rack operation and a program for making a computer execute the method, by which racks are speedily and efficiently operated when a new product such as a copier is delivered to a customer using the rack and an old product already owned by the customer is collected.

It is another object of this invention to provide a system and method of managing multistage racks and a program for making a computer execute the method, by which multistage racks in use obtained by joining a plurality of racks to each other in multiple stages can efficiently be managed.

It is still another object of this invention to provide an article conveyance and storage device whose plural supports detached from a pallet can be conveyed or stored by being efficiently tied in a bundle.

It is still another object of this invention to provide an article conveyance and storage device in which a shock absorber can easily and securely be disposed between an article and each support.

In the system according to one aspect of this invention, when a first article is delivered to a customer and a second article is collected from the customer, first rack components required for delivery of the first article and second rack components not required for delivery of the first article, yet required for collecting the second article, are specified. A delivery procedure and a collection procedure of the articles using the specified first rack components and the second rack components are instructed to a worksite for delivery. Accordingly, delivery and collection of the articles can be performed by efficiently using the rack components that can be commonly used for the first article and the second article.

In the method according to another aspect of this invention, when a first article is delivered to a customer and a second article is collected from the customer, first rack components required for delivery of the first article and second rack components not required for delivery of the first article, yet required for collecting the second article, are specified. A delivery procedure and a collection procedure of the article using the specified first rack components and the second rack components are instructed to a worksite for delivery. Accordingly, delivery and collection of articles can be performed by efficiently using the rack components that can be commonly used for the first article and the second article.

In the system according to still another aspect of this invention, multistage racks in use are managed based on information from a plurality of production sites which produce self-propelled devices, non-self-propelled devices, devices that do not function singly, and main bodies or components of products to be conveyed each as a part forming a device, and pack the devices and components in the multistage rack to deliver. The multistage racks in use are managed also based on information from a prespecified relay point that reassembles the multistage racks received from the respective production sites and delivers the multistage racks each formed with the main body and the components. Accordingly, the multistage racks in use can efficiently be managed.

In the method according to still another aspect of this invention, multistage racks in use are managed based on information from a plurality of production sites which produce self-propelled devices, non-self-propelled devices, devices that do not function singly, and main bodies or components of products to be conveyed each as a part forming a device, and pack the devices and components in the multistage rack to deliver. The multistage racks in use are managed also based on information from a prespecified relay point that reassembles the multistage racks received from the respective production sites and delivers the multistage racks each formed with the main body and the components. Accordingly, the multistage racks in use can efficiently be managed.

The device according to still another aspect of this invention has a support coupling unit, which detachably couples at least two supports detached from a pallet to each other adjacently in substantially parallel with each other, provided in the supports themselves.

The device according to still another aspect of this invention has a shock absorber provided between an article loaded on a pallet and each support fitted to the pallet and a fixing unit that fixes the shock absorber to the support.

Other objects and features of this invention will become apparent from the following description with reference to the accompanying drawings.

BRIEF DESCRIPTION OF THE DRAWINGS

FIG. 11 shows an example of an operating rack management table when the double-stacked racks are assembled at the main-body production site and the paper-feeder production site shown in FIG. 8;

FIG. 12 shows another example of the operating rack management table when the double-stacked racks are reassembled at the sales-use warehouse shown in FIG. 8;

DESCRIPTION OF THE PREFERRED EMBODIMENTS

Preferred embodiments of the system and method of managing rack operation and the program for making a computer execute the method according to this invention will be explained in detail below with reference to the accompanying drawings.

Figure 1:
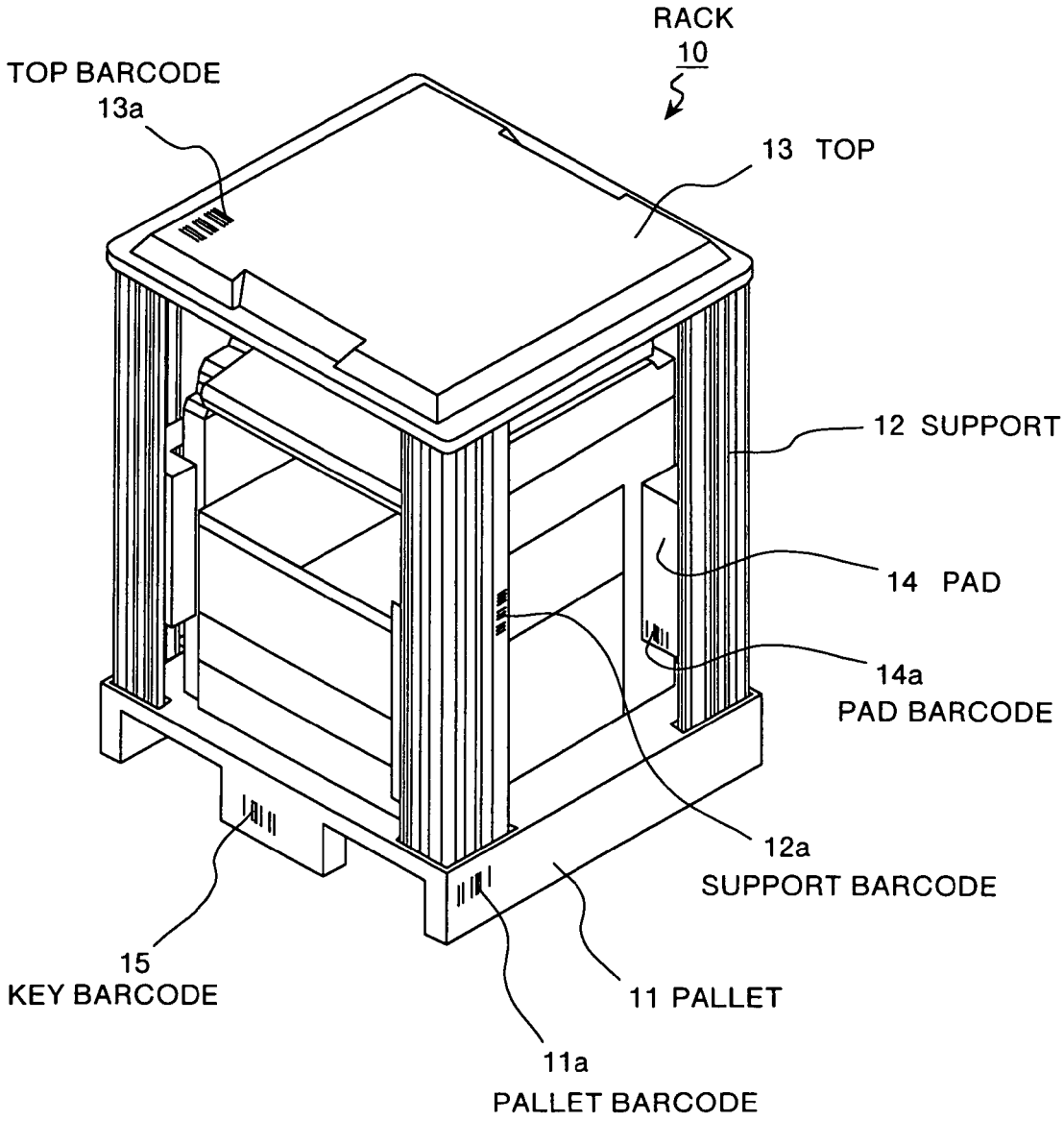
FIG. 1 is a perspective view showing a structure of a rack according to a first embodiment of this invention.

A rack according to the first embodiment of this invention will be explained. FIG. 1 is a perspective view showing a structure of the rack according to this embodiment. This rack 10 is assembled with pallet 11, supports 12, top 13, and pads 14 so that the rack can be disassembled.

The pallet 11 has two legs and a loading plate integrally formed with these legs, and both of the legs are placed on the installation surface such as a floor surface. At this time, some space is formed between the installation surface and the loading plate so that a fork of a forklift can be inserted into the space.

The supports 12 are discretely and detachably fitted into four corners of the pallet after an article is loaded on the pallet. The top 13 is a cover that is provided over the upper parts of the supports 12 and protects the upper side of the article. The pads 14 are shock absorbing members formed according to the shape of the article to be conveyed and detachably fixed to the support 12.

Such a rack 10 has the pallet 11, the supports 12, the top 13, and the pads 14 as the rack components. A barcode is provided to each of the rack components. That is, a pallet barcode 11*a* is provided to the pallet 11, a support barcode 12*a* to the support 12, a top barcode 13*a* to the top 13, and a pad barcode 14*a* to the pad 14. Accordingly, even if the rack components are assembled and used, each of the barcodes can be read at each of the sites, which makes it possible to grasp the use of each rack component.

A key barcode 15 is provided to the pallet 11 other than the pallet barcode 11*a*. This key barcode 15 does not indicate a barcode representing the pallet 11 but a barcode for the overall rack 10 including respective information for the components forming the rack 10. Therefore, by reading this key barcode 15 at each of the sites, it is possible to catch the use of the rack 10 and each of the rack components without reading each barcode of the rack components. The barcode of the pallet 11 may also be used as the key barcode 15.

This rack 10 is used to deliver articles of different shapes by selecting any rack components for each article to be assembled for the article. For example, when there are two types of copiers A and B which are the same except their height, the copier B can also be delivered together with the copier A by replacing the supports 12 with the longer ones.

Figure 2:
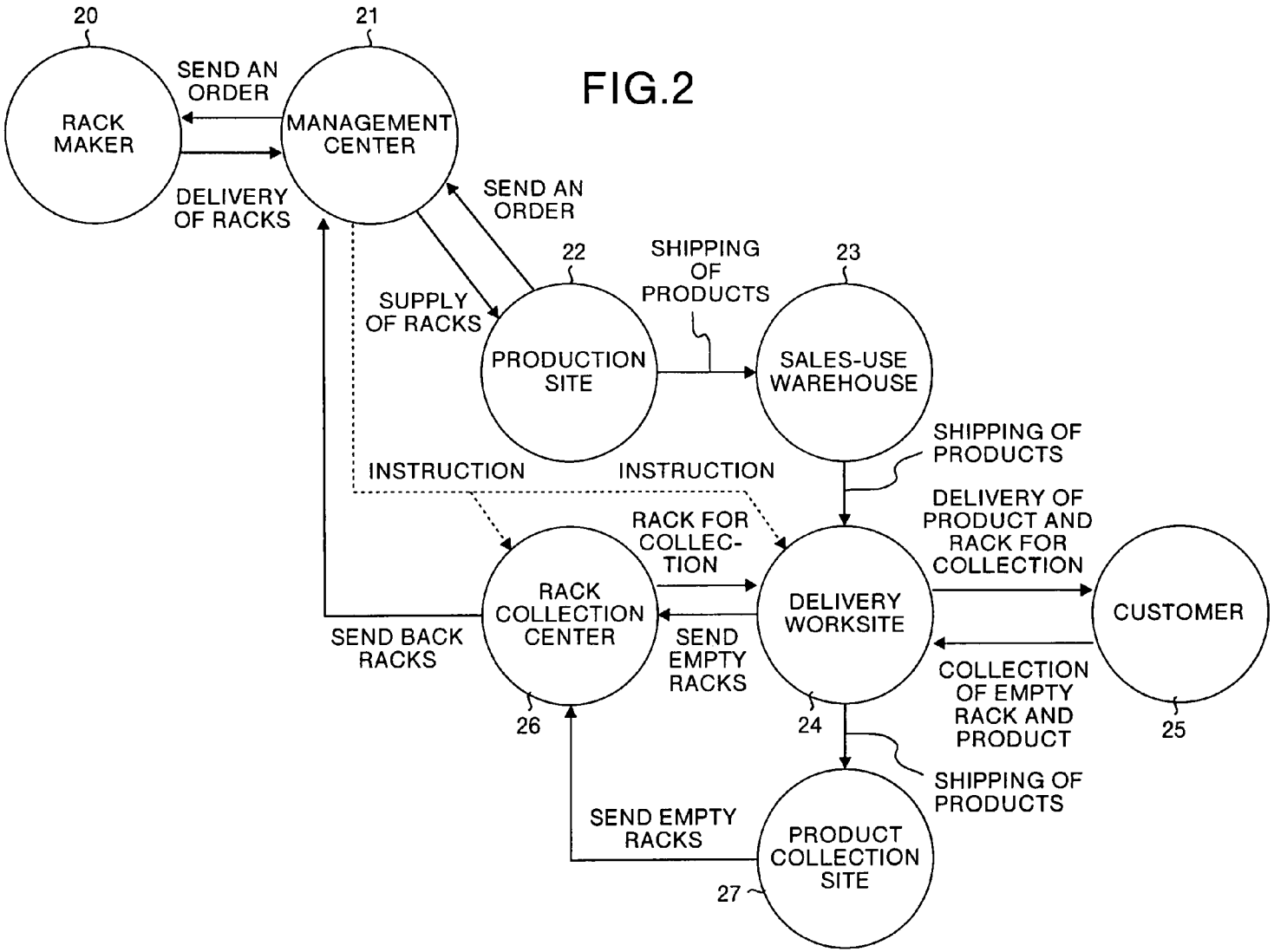
FIG. 2 shows sites that handle the rack shown in FIG. 1.

Each site for handling the rack shown in FIG. 1 and its job flow will be explained below. FIG. 2 shows the sites that handle the rack shown in FIG. 1. This figure also shows a case where an old product is collected at the time of delivering a new product.

The site for handling the rack includes a rack maker 20, a management center 21, a production site 22, a sales-use warehouse 23, a worksite for delivery 24, a rack collection center 26, and a product collection site 27.

The management center 21 sends an order of racks to the rack maker 20, and takes delivery of the racks from the rack maker 20. When receiving an order from a production site 22, the management center 21 supplies the racks for new products to this production site 22. The production site 22 assembles the rack together with the new product, and the assembled new product is shipped to the sales-use warehouse 23. The sales-use warehouse 23 ships the new product to the delivery worksite 24.

On the other hand, the rack collection center 26 supplies rack components for collection to the delivery worksite 24 when receiving an instruction to collect an old product from the management center 21. This rack collection center 26 does not always supply all the rack components required for collecting an old product, that is, the pallet 11, the supports 12, the top 13, and the pads 14, to the delivery worksite 24.

More specifically, the rack collection center 26 compares a rack for delivery required for supplying a new product with a rack for collecting an old product, and does not supply any rack components capable of being used for both to the delivery worksite 24. However, which rack components the rack collection center 26 is to supply to the delivery worksite 24 is instructed from the management center 21.

The delivery worksite 24 receives instructions for delivery and collection of products from the management center 21, and delivers the new product and collects the old product according to the instructions. More specifically, a delivery person delivers the product to a customer 25 and unpacks the product at the customer site to be handed over to the customer 25. After the delivery, the delivery person packs the old product using the rack components required for collecting the old product out of the rack components used for the new product and the rack components supplied from the rack collection center 26, and collects the old product together with the components of the empty rack used for the new product.

The delivery worksite 24 sends the components of the empty rack used for the new product to the rack collection center 26, and delivers the old product to the product collection site 27. This product collection site 27 unpacks the product and sends the empty rack to the rack collection center 26. When the empty racks are stocked more than the prespecified number, this rack collection center 26 sends back the empty racks to the management center 21.

The construction of the system for managing rack operation according to the first embodiment will be explained below. The block diagram in FIG. 3 shows the construction of the system for managing rack operation according to the first embodiment.

This management system for rack components is constructed by making connections between a rack information management device 30 and terminals with their barcode readers explained below through a public network 31. That is, the rack information management device 30 that manages rack components in their standby state or in use, a terminal 32 with its barcode reader 32*a* provided at the management center 21, a terminal 33 with its barcode reader 33*a* provided at the production site 22, a terminal 34 with its barcode reader 34*a* provided in the sales-use warehouse 23, a terminal 35 with its barcode reader 35*a* provided at the delivery worksite 24, and a terminal 36 with its barcode reader 36*a* provided at the rack collection center 26.

When a barcode attached to a rack component is read by any barcode reader provided at any of the sites, the information of this barcode is transmitted to the rack information management device 30 together with its site ID and read time. Therefore, the rack information management device 30 can manage not only the rack components in their standby state but also the situations of the rack components in use. Based on such management in particular, the rack information management device 30 can manage what types of rack components are stocked at the rack collection center 26.

Figure 3:
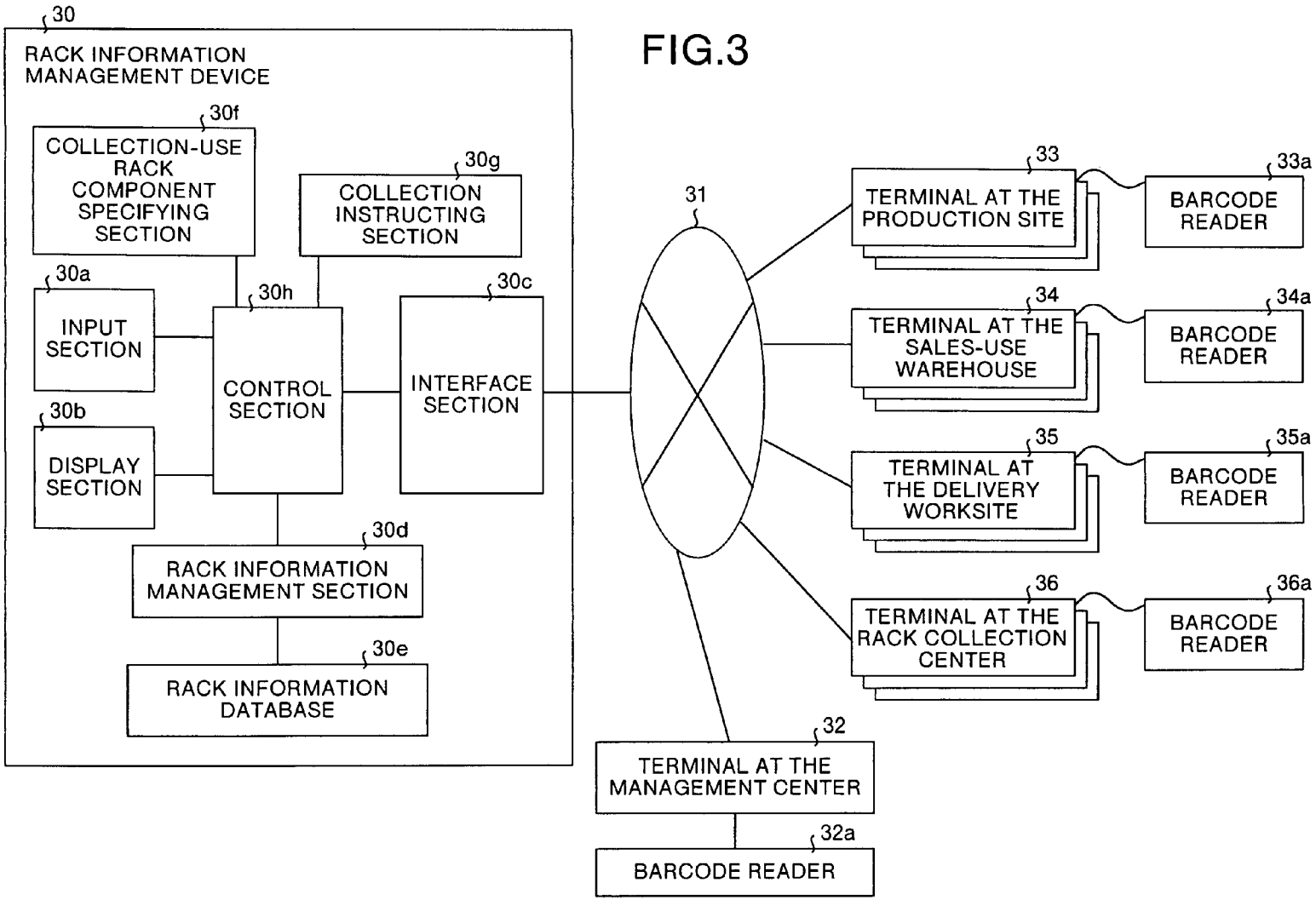
FIG. 3 is a block diagram showing a construction of a system for managing rack operation according to the first embodiment.

As shown in FIG. 3, the rack information management device 30 comprises an input section 30*a*, a display section 30*b*, an interface section 30*c*, a rack information management section 30*d*, and a rack information database 30*e*. This rack information management device 30 also comprises a collection-use rack component specifying section 30*f*, a collection instructing section 30*g*, and a control section 30*h*.

The input section 30*a* is an input device such as a keyboard and a mouse. The display section 30*b* is a display device such as a liquid crystal panel or a display. The interface section 30*c* is a data input/output section used to perform data transaction with the terminals 32 to 36 through the public network 31.

The rack information management section 30*d* manages information for rack components using the rack information database 30*e* in which the respective information for pallets, supports, a top, and pads as rack components for each rack is stored. Accordingly, if a user inputs identification information for a desired rack component through the input section 30*a*, the current situation of the rack component can be acquired from the rack information management section 30*d* to be displayed on the display section 30*b*. For example, if the stock at the rack collection center 26 is specified, the user can check the rack components stocked at this rack collection center 26.

The collection-use rack component specifying section 30*f* specifies any rack components for collection to be supplied from the rack collection center 26 to the delivery worksite 24. More specifically, the collection-use rack component specifying section 30*f* determines a type of rack components required for collecting an article, and specifies rack components as the rack components for collection through exclusion of any rack components used to deliver an article to the customer 25 from the whole rack components for collection. By specifying the rack components for collection in such a manner, delivery of wasteful rack components is prevented, thus efficiently operating the rack components.

The collection instructing section 30*g* issues an instruction to supply a rack required for delivering a product to the customer 25 and also an instruction to supply a rack required for collecting a product from the customer 25.

More specifically, the collection instructing section 30*g* checks through the rack information management section 30*d* whether the rack components for collection specified by the collection-use rack component specifying section 30*f* are stocked at the rack collection center 26. When the rack components for collection are stocked at the rack collection center 26, the collection instructing section 30*g* instructs the rack collection center 26 to supply the rack components for collection to the delivery worksite 24.

On the other hand, when the rack components for collection are not stocked at the rack collection center 26, the collection instructing section 30*g* instructs the management center 21 to supply the rack components for collection together with the rack components for delivery to the production site 22.

The collection instructing section 30*g* also issues instructions to deliver and collect products to the delivery worksite 24. For example, when a new product is delivered and an old product is collected, the collection instructing section 30*g* instructs any rack components, out of the rack components for delivery, to be used for collection, and instructs the delivery worksite 24 to collect the product using the instructed rack components and the rack components for collection.

The control section 30*h* controls the overall rack information management device 30. More specifically, when receiving data for a barcode, its site ID and read time from any of the terminals 32 to 36 at the sites, the control section 30*h* outputs the data to the rack information management section 30*d*. The control section 30*h* also performs data transfer between the collection instructing section 30*g* and the rack information management section 30*d*.

Figure 4:
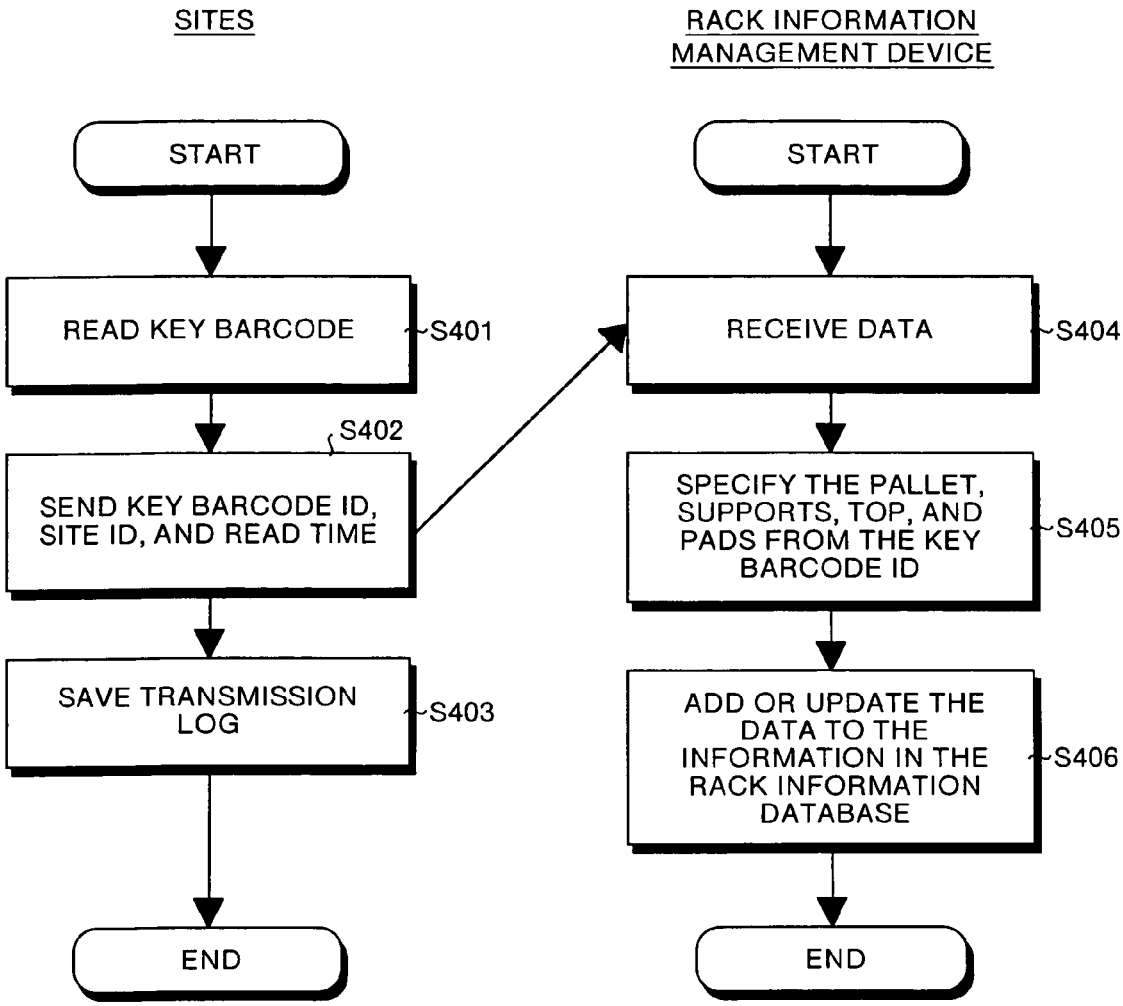
FIG. 4 is a flow chart showing a procedure of how the rack components are managed at each of the sites shown in FIG. 3 and by a rack information management device.

A procedure for how the rack components are managed at each of the sites shown in FIG. 3 and by the rack information management device 30 will be explained below. The flowchart in FIG. 4 shows procedures of how rack components are managed at each of the sites shown in FIG. 3 and by the rack information management device 30. The case where the key barcode is to be read will be explained here.

As shown in FIG. 4, when the key barcode 15 attached to the pallet 11 of the rack is read by the barcode reader 36*a* of the rack collection center 26 (step S401), the terminal 36 at the rack collection center transmits the ID of this key barcode together with its site ID and its read time to the rack information management device 30 (step S402), and stores its transmission log (step S403).

The rack information management device 30 receives this data (step S404), specifies the pallet, the supports, the top, and the pads from the key barcode ID (step S405), and adds the specified information to the information in the rack information database 30*e* (step S406). More specifically, a correlation between key barcode IDs and components of the racks is previously managed in tabular form, and by searching the table using the key barcode ID, the components are specified.

Accordingly, respective information for the pallet, supports, top, and pads as the rack components forming the rack in use can be updated based on the key barcode attached to the rack. Particularly, the rack information management section 30*d* can also manage what types of rack components are stocked at the rack collection center 26.

A sequence of processing required for the case where a new product is supplied and an old product is collected by the rack information management device 30 shown in FIG. 3 will be explained below. The flow chart in FIG. 5 shows the sequence of processing required for the case where a new product is supplied and an old product is collected by the rack information management device shown in FIG. 3.

Figure 5:
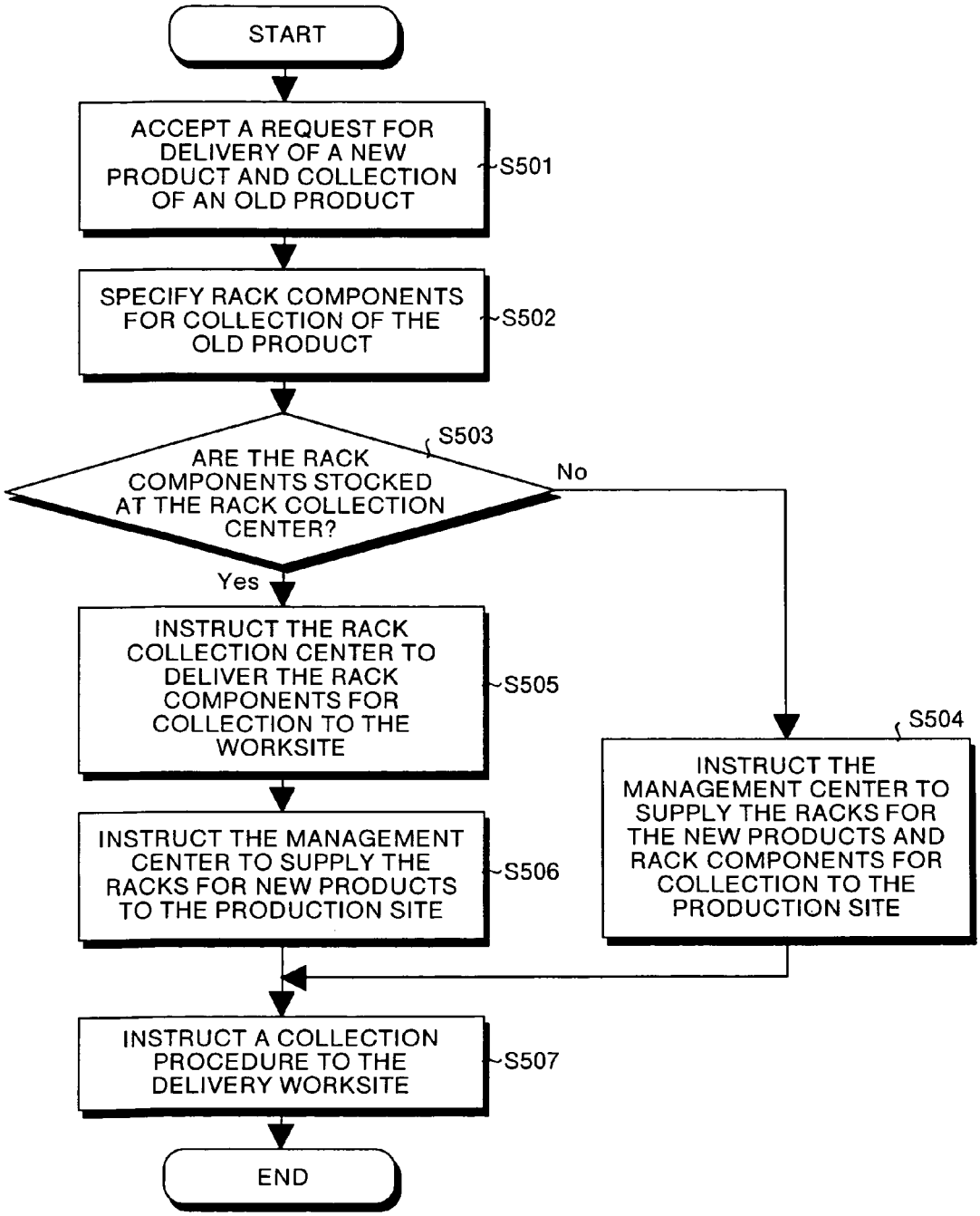
FIG. 5 is a flow chart showing a sequence of processing required for the case where a new product is supplied and an old product is collected by the rack information management device shown in FIG. 3.

As shown in FIG. 5, when the rack information management device 30 accepts instructions to deliver a new product and collect an old product (step S501), the collection-use rack component specifying section 30*f* specifies minimum rack components required for collecting the old product (step S502).

The collection instructing section 30*g* checks whether the rack collection center 26 stocks any rack components for collecting the old product (step S503). When the rack collection center 26 does not stock any such rack components (step S503, No), the collection instructing section 30*g* instructs the management center 21 to supply the rack components for new products and the rack components for old products to the production site 22 (step S504), and then instructs a collection procedure to the delivery worksite 24 (step S507).

On the other hand, when the rack collection center 26 stocks the rack components for collecting the old product (step S503, Yes), the collection instructing section 30*g* instructs the rack collection center 26 to deliver the rack components for collecting the old product to the delivery worksite 24 (step S505) The collection instructing section 30*g* also instructs the management center 21 to supply the rack components for new products to the production site 22 (step S506), and instructs a collection procedure to the delivery worksite 24 (step S507).

As explained above, in the first embodiment, the collection-use rack component specifying section 30*f* specifies minimum rack components required for collection determined by excluding rack components required for supplying a product from rack components for collecting a product. The collection instructing section 30*g* instructs the rack collection center 26 to supply the rack components for collection to the delivery worksite 24, and also issues an instruction for delivery and collection of products to the delivery worksite 24. Therefore, when a new product such as a copier is delivered to a customer using a rack and an old product owned by the customer, the rack can be operated speedily and efficiently.

Although it has been explained that the collection instructing section 30*g* gives instructions to the rack collection center 26 and the delivery worksite 24 for convenience in explanation, in actual cases, the collection instructing section 30*g* transmits instruction data to the terminal 36 at the rack collection center and the terminal 35 at the delivery worksite.

Although the first embodiment has presented the case where delivery of a new product and collection of an old product are executed at the same time, this invention is not limited by this case. Accordingly, there may be a case where an old product is collected after a couple of days since a new product is delivered. The case where an old product is collected after a couple of days since a new product is delivered will be explained below as the second embodiment. In this case, the structure of the rack and the construction of the system are the same as these in the previous case. Therefore, explanation of these structure and the construction is omitted.

Figure 6:
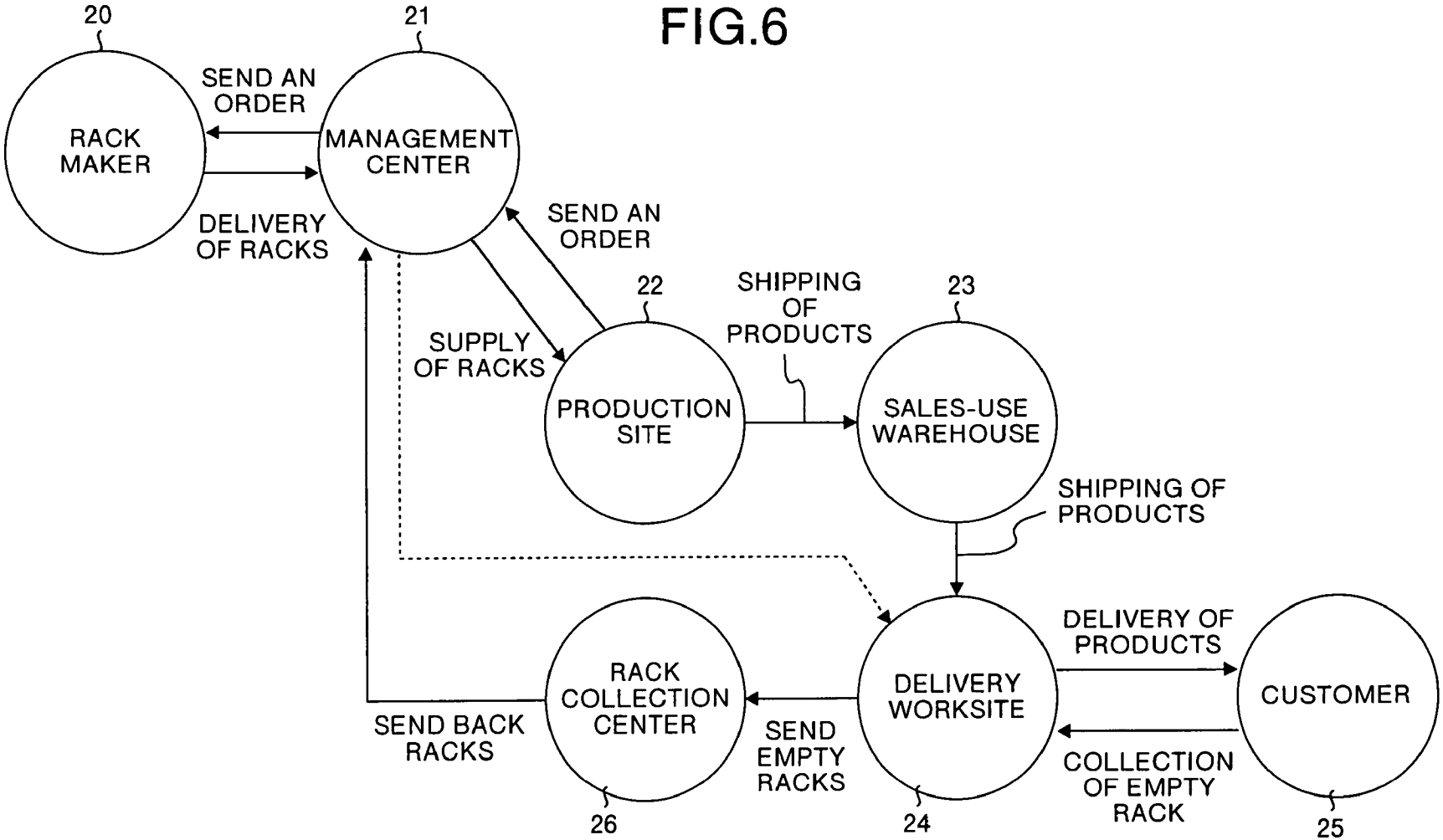
FIG. 6 shows a job flow for delivering a new product according to a second embodiment.

A job flow for delivering a new product according to the second embodiment will be explained below. FIG. 6 shows the job flow for delivering a new product according to the second embodiment.

The management center 21 sends an order of racks to the rack maker 20, and takes delivery of the racks from the rack maker 20. When receiving an order from a production site 22, the management center 21 supplies the racks for new products to this production site 22. The production site 22 assembles the rack together with the new product, and the assembled new product is shipped to the sales-use warehouse 23. The sales-use warehouse 23 ships the new product to the delivery worksite 24.

In the delivery worksite 24, the delivery person delivers the new product to a customer 25 based on the instruction from the management center 21, unpacks the product at the customer site 25, and collects the empty rack to be sent to the rack collection center 26. In the delivery worksite 24, however, not all the rack components used to deliver the new product are collected, but some rack components to be used to collect an old product are left at the customer site 25. Such rack components are used again for collecting the old product. If the customer does not allow the rack components to be left, all the rack components are collected.

Figure 7:
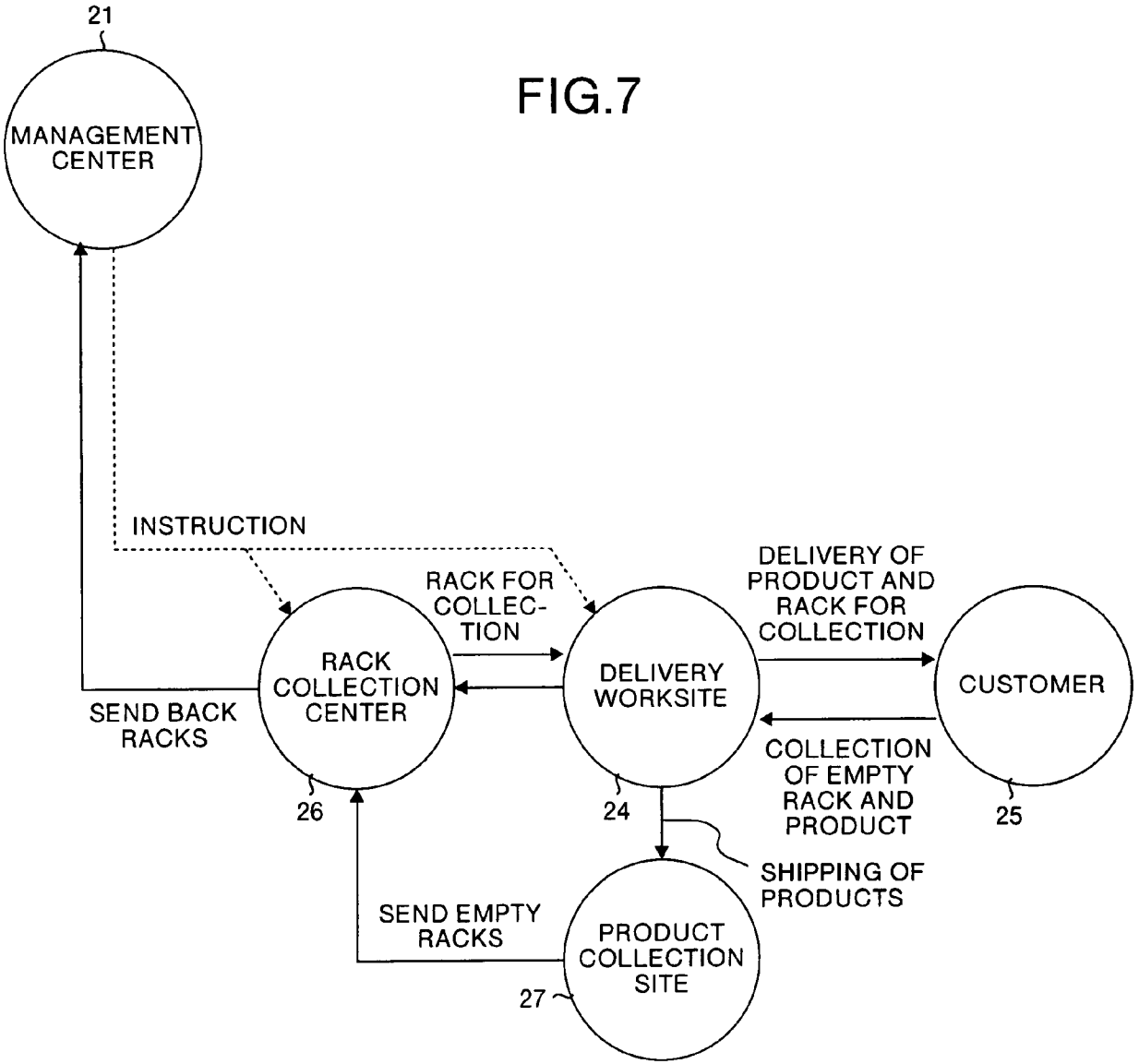
FIG. 7 shows a job flow for collecting an old product according to the second embodiment.

A job flow for collecting an old product according to the second embodiment will be explained below. FIG. 7 shows the job flow for collecting an old product according to the second embodiment.

The rack collection center 26 supplies rack components for collection to the delivery worksite 24 when accepting an instruction to collect an old product from the management center 21. However, this rack collection center 26 does not always supply all the rack components required for collecting an old product, that is, the pallet 11, the supports 12, the top 13, and the pads 14, to the delivery worksite 24. The rack collection center 26 supplies only rack components that do not overlap the rack components for delivery of a product left at the customer site 25. Further, which rack components the rack collection center 26 is to supply to the delivery worksite 24 is instructed from the management center 21.

The delivery worksite 24 receives an instruction for delivery and collection of products from the management center 21, and collects the old product according to the instruction. More specifically, the old product is packed using the rack components left at the customer and the rack components supplied from the rack collection center 26 and collected.

The packed old product is then sent to the product collection site 27, is unpacked at this product collection site 27, and the empty rack is sent to the rack collection center 26. When the empty racks are stocked more than the prespecified number, this rack collection center 26 sends back the empty racks to the management center 21.

As explained above, in the second embodiment, even if the delivery data of a new product is different from the date for collecting an old product, a part of the rack components used to deliver the new product is reused for collection of the old product. Thus, the rack can be operated speedily and efficiently.

Although the first and second embodiments have presented the case where the delivery and the collection of products of the same type are executed, this invention is not limited by this case. That is, this invention is also applicable to a case where products of different types are handled. This case will be explained as the third embodiment.

More specifically, even if a product to be delivered to a customer 25 is an image formation device such as a copier and a product to be collected from the customer is electric appliances such as a refrigerator, the rack can be operated speedily and efficiently by reusing the rack components commonly used for delivery and collection of the products.

In this case, the job flow of the copier is completely different from the job flow of the refrigerator. However, by sharing the management center 21, the delivery worksite 24, and the rack collection center 26, a cross-job flow for racks can be realized.

As explained above, according to one aspect of this invention, when a first article is delivered to a customer and a second article is collected from the customer, the first rack components required for delivery of the first article and second rack components not required for delivery of the first article, yet required for collecting the second article, are specified. A delivery procedure and a collection procedure of the articles using the specified first rack components and the second rack components are instructed to the delivery worksite. Accordingly, there is an effect that it is possible to obtain the system for managing rack operation that can perform delivery and collection of articles by efficiently using the rack components commonly used for the first article and the second article.

Further, the rack components are the pallet where an article is loaded, the plural supports detachably fitted to the pallet, the top covering the plural supports, or the shock absorbing members provided between the supports and the article. Accordingly, there is an effect that it is possible to obtain the system for managing rack operation that can efficiently use any rack components, of these pallet, supports, top, or shock absorbing members, that can be commonly used for delivery and collection of articles.

Further, the first rack components are supplied from the management center to the production site, the rack components are assembled together with the first article at the production site to be stored in the sales-use warehouse, and the rack with the first article is shipped from the sales-use warehouse to the delivery worksite. Accordingly, there is an effect that it is possible to obtain the system for managing rack operation that can efficiently manage rack operation when the rack components are assembled together with the article and shipped according to the respective job flows at the management center, the production site, the sales-use warehouse, and the delivery worksite.

Further, the management center is instructed to deliver the first rack components to the production site. Accordingly, there is an effect that it is possible to obtain the system for managing rack operation that can centralize transmission of a trigger to deliver rack components (first rack components) for delivery of an article and transmission of a trigger to deliver rack components for collecting an article.

Further, it is checked whether the second rack components are stocked at the rack collection center. This rack collection center collects and manages the rack components collected from the delivery worksite, and delivers rack components to the management center when the rack components are stocked more than the prespecified number. When it is checked that the second rack components are stocked at the rack collection center, the rack collection center is instructed to deliver the second rack components to the delivery worksite. Accordingly, there is an effect that it is possible to obtain the system for managing rack operation that can speedily and efficiently supply the rack components for collection (second rack components) to the delivery worksite.

Further, when it is checked that the second rack components are not stocked at the rack collection center, the management center is instructed to deliver the second rack components together with the first rack components to the delivery worksite. Accordingly, there is an effect that it is possible to obtain the system for managing rack operation that can integrally manage the operation of the rack components for collection and the rack components for delivery.

Further, the delivery worksite is instructed to collect the second article after delivery of the first article using the first rack components. This collection is carried out by using the third rack components that can be used for delivery of the first article and collection of the second article, and the second rack components. Accordingly, there is an effect that it is possible to obtain the system for managing rack operation in which each of the delivery worksites can collect an article by commonly utilizing the pallet, the supports, the top, and the shock absorbing members for delivery and collection of articles.

Further, the delivery worksite is instructed to deliver the first article using the first rack components and collect any rack components, after the delivery is finished, except the third rack components that can be used for delivery of the first article and collection of the second article. Further, the delivery worksite is instructed to collect the second article using the third rack components and the second rack components. Accordingly, there is an effect that it is possible to obtain the system for managing rack operation that can efficiently operate the rack components even if delivery and collection of articles are not carried out at the same time.

Further, the first article and the second article are assumed to be image formation devices. Accordingly, there is an effect that it is possible to obtain the system for managing rack operation that can efficiently operate the rack components when an old image formation device is replaced with a new one.

Further, the first article is assumed to be an image formation device and the second article is assumed to be any product except the image formation device. Accordingly, there is an effect that it is possible to obtain the system for managing rack operation that can efficiently operate the rack components in a cross-job manner even between systems with different job flows for delivery and collection.

According to another aspect of this invention, when the first article is delivered to a customer and the second article is collected from the customer, the first rack components required for delivery of the first article and second rack components not required for delivery of the first article, yet required for collecting the second article, are specified. A delivery procedure and a collection procedure of the articles using the specified first rack components and the second rack components are instructed to the delivery worksite. Accordingly, there is an effect that it is possible to obtain the method of managing rack operation in which delivery and collection of articles are carried out by efficiently using the rack components commonly used for the first article and the second article.

Further, the rack components are the pallet where an article is loaded, the plural supports detachably fitted to the pallet, the top covering the plural supports, or the shock absorbing members provided between the supports and the article. Accordingly, there is an effect that it is possible to obtain the method of managing rack operation in which any components commonly used for delivery and collection of articles, of these pallet, supports, top, or shock absorbing members, can efficiently be operated.

Further, the first rack components are supplied from the management center to the production site, the rack components are assembled together with the first article at the production site to be stored in the sales-use warehouse, and the rack with the first article is shipped from the sales-use warehouse to the delivery worksite. Accordingly, there is an effect that it is possible to obtain the method of managing rack operation in which the rack operation can efficiently be managed when the rack components are assembled together with the article according to the respective job flows at the management center, the production site, the sales-use warehouse, and the delivery worksite.

Further, the management center is instructed to deliver the first rack components to the production site. Accordingly, there is an effect that it is possible to obtain the method of managing rack operation in which transmission of a trigger to deliver rack components (first rack components) for delivery of an article and transmission of a trigger to deliver rack components for collecting an article can be centralized.

Further, it is checked whether the second rack components are stocked at the rack collection center. This rack collection center collects and manages the rack components collected from the delivery worksite, and delivers rack components to the management center when stocked more than the prespecified number. When it is checked that the second rack components are stocked at the rack collection center, the rack collection center is instructed to deliver the second rack components to the delivery worksite. Accordingly, there is an effect that it is possible to obtain the method of managing rack operation in which the rack components for collection (second rack components) can be speedily and efficiently supplied to the delivery worksite.

Further, when it is checked that the second rack components are not stocked at the rack collection center, the management center is instructed to deliver the second rack components together with the first rack components to the delivery worksite. Accordingly, there is an effect that it is possible to obtain the method of managing rack operation in which the operation of the rack components for collection and the rack components for delivery can integrally be managed.

Further, the delivery worksite is instructed to collect the second article after delivery of the first article using the first rack components. This collection is carried out by using the third rack components that can be used for delivery of the first article and collection of the second article, and the second rack components. Accordingly, there is an effect that it is possible to obtain the method of managing rack operation in which each of the delivery worksites can collect an article by commonly utilizing the pallet, the supports, the top, and the shock absorbing members for delivery and collection of articles.

Further, the delivery worksite is instructed to deliver the first article using the first rack components and collect any rack components, after the delivery is finished, except the third rack components that can be used for delivery of the first article and collection of the second article. Further, the delivery worksite is instructed to collect the second article using the third rack components and the second rack components. Accordingly, there is an effect that it is possible to obtain the method of managing rack operation in which the rack components can efficiently be operated even if delivery and collection of articles are not carried out at the same time.

Further, the first article and the second article are assumed to be image formation devices. Accordingly, there is an effect that it is possible to obtain the method of managing rack operation in which the rack components can efficiently be operated when an old image formation device is replaced with a new one.

Further, the first article is assumed to be an image formation device and the second article is assumed to be any product except the image formation device. Accordingly, there is an effect that it is possible to obtain the method of managing rack operation in which the rack components can be efficiently operated in a cross-job manner even between systems with different job flows for delivery and collection.

A preferred embodiment of the system and method of managing multistage racks and the program for making a computer execute the method according to this invention will be explained in detail below. This embodiment will present a case where the main body of a copier and a paper feeder of the copier are produced in different production sites.

Figure 8:
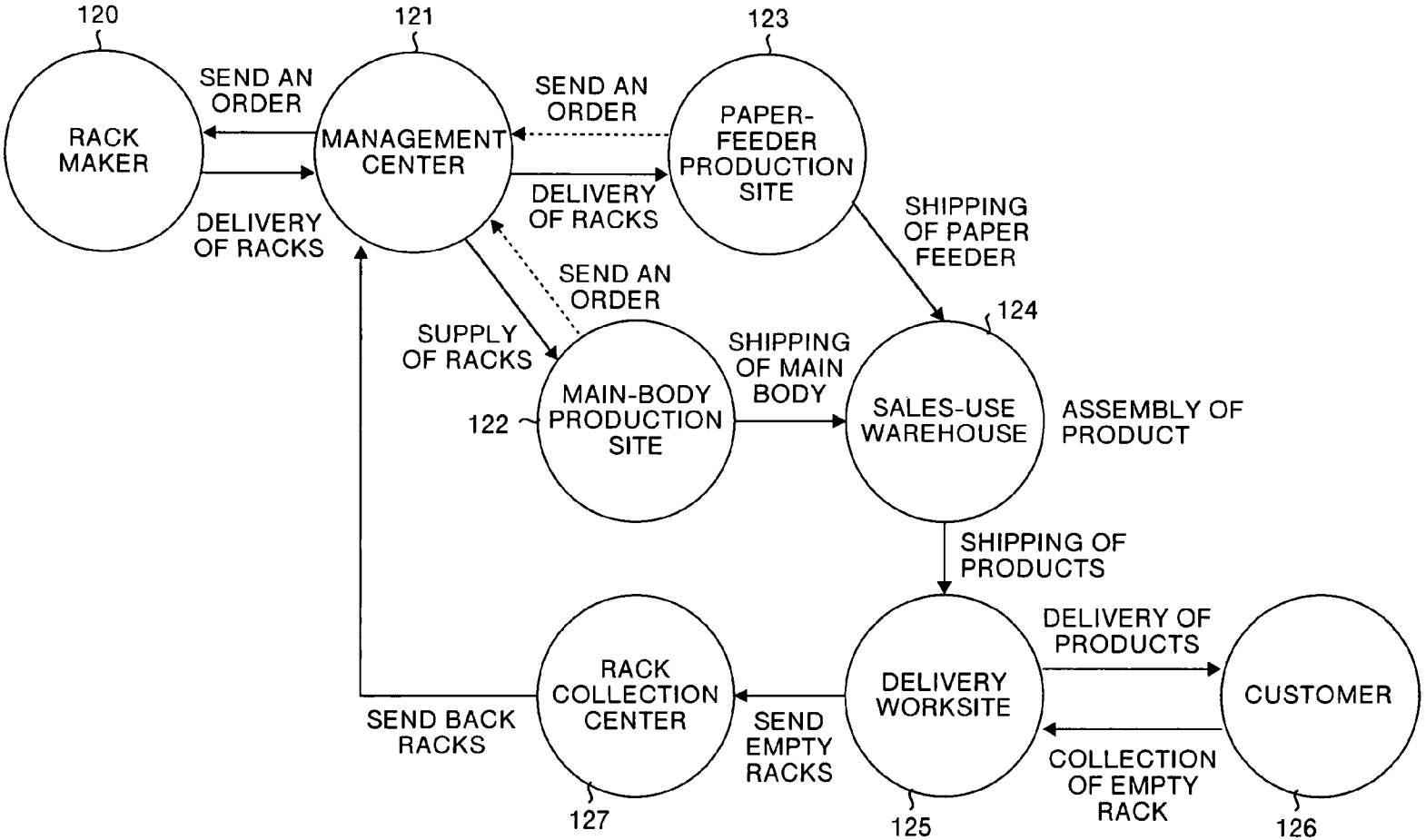
FIG. 8 shows the sites that handle the rack shown in FIG. 1.
Figure 9:
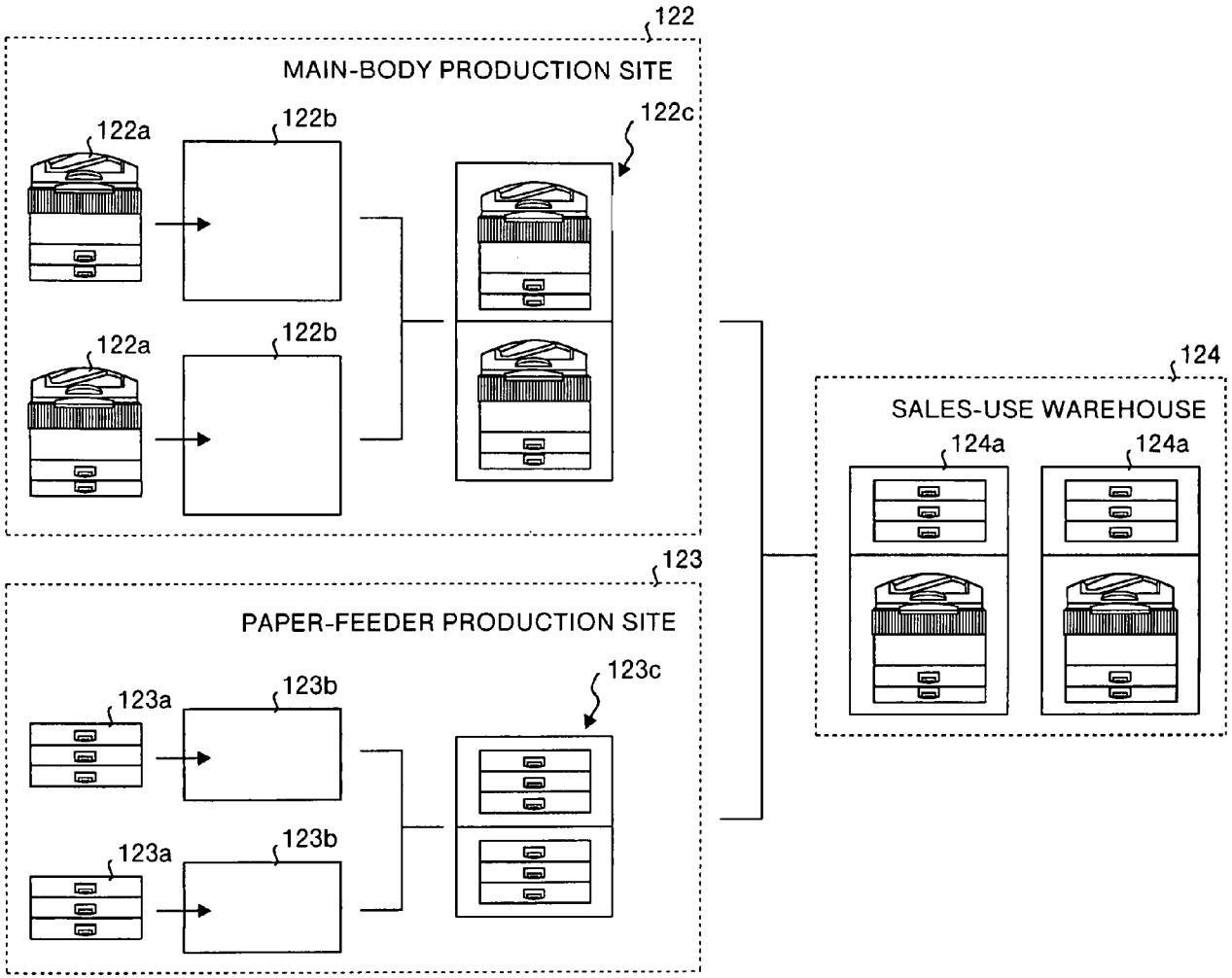
FIG. 9 shows how to assemble double-stacked racks at a main-body production site and a paper-feeder production site, and how to reassemble the double-stacked racks at a sales-use warehouse.

Each of the production sites that handle the rack shown in FIG. 1 and its job flow will be explained below. FIG. 8 shows the sites that handle the rack shown in FIG. 1. FIG. 9 shows how to assemble double-stacked racks at the main-body production site 122 and the paper-feeder production site 123 shown in FIG. 8 and how to reassemble the double-stacked racks at the sales-use warehouse 124.

As shown in FIG. 8, the site handling this rack includes a rack maker 120, a management center 121, the main-body production site 122, the paper-feeder production site 123, the sales-use warehouse 124, a delivery worksite 125, and a rack collection center 127.

The management center 121 sends an order of racks to the rack maker 120, and takes delivery of the racks from the rack maker 120. When receiving orders from the main-body production site 122 and the paper-feeder production site 123, the management center 21 supplies the racks to the main-body production site 122 and the paper-feeder production site 123.

At the main-body production site 122, a copier body 122*a* is packed with a rack 122*b* and a double-stacked rack 122*c* obtained by stacking the two racks 122*b* is shipped to the sales-use warehouse 124 as shown in FIG. 9. Likewise, at the paper-feeder production site 123, a paper feeder 123*a* of the copier is packed with a rack 123*b*. A double-stacked rack 123*c* obtained by stacking two these racks 123*b* is shipped to the sales-use warehouse 124 as shown in FIG. 9.

The sales-use warehouse 124 receives these double-stacked racks 122*c* and 123*c* from the main-body production site 122 and the paper-feeder production site 123, and reassembles these double-stacked racks as shown in FIG. 9. Two double-stacked racks 124*a* each formed with the copier body and the paper feeder are structured to ship them to the delivery worksite 125.

The double-stacked rack 124*a* is then shipped from the delivery worksite 125 to a customer 126, unpacked at the customer site, and the empty rack is collected to send it to the rack collection center 127. When the rack collection center 127 stocks empty racks more than the prespecified number, the empty racks are sent back to the management center 121.

The construction of the multistage rack management system according to this embodiment will be explained below. The block diagram in FIG. 10 shows the construction of the system for managing rack components according to this embodiment.

This management system for rack components is constructed by making connections between a rack information management device 140 and terminals with their barcodes, explained below, through a public network 141. That is, the rack information management device 140 that manages each of rack components in their standby state and double-stacked racks in use, a terminal 142 with its barcode reader 142*a* provided at the management center 121, a terminal 143 with its barcode reader 143*a* provided at the main-body production site 122, a terminal 144 with its barcode reader 144*a* provided at the paper-feeder production site 123, a terminal 145 with its barcode reader 145*a* provided in the sales-use warehouse 124, a terminal 146 with its barcode reader 146*a* provided at the delivery worksite 125, and a terminal 147 with its barcode reader 147*a* provided at the rack collection center 127.

When a barcode attached to a rack component is read by any barcode reader provided at any of the sites, the information of this barcode together with its site ID and read time is transmitted to the rack information management device 140. Therefore, the rack information management device 140 can manage not only the rack components in their standby state but also the situations of the rack components in use. This rack information management device 140 in particular has also a function of managing the double-stacked racks in use.

Figure 10:
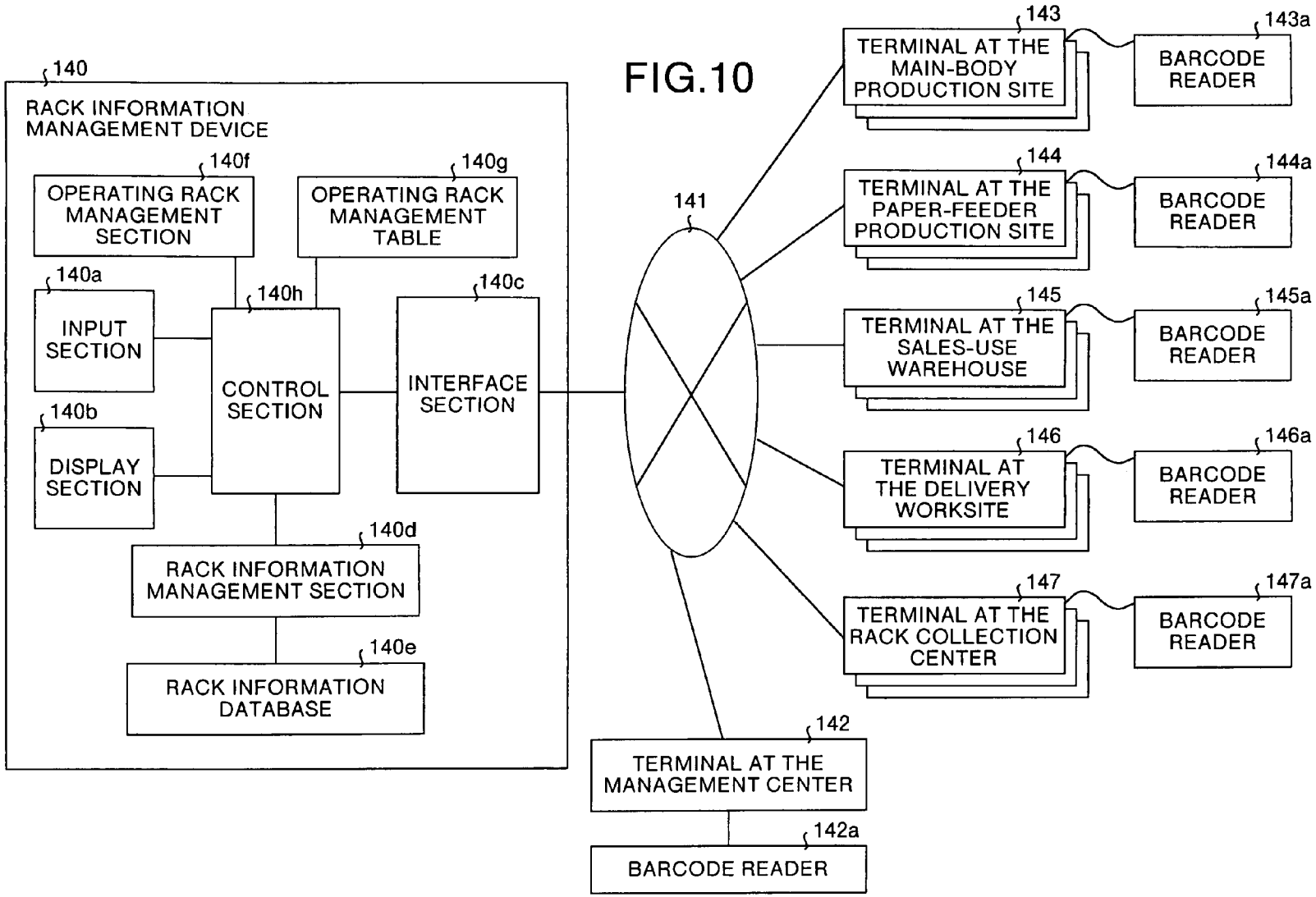
FIG. 10 is a block diagram showing a construction of a system for managing rack operation according to another embodiment.

As shown in FIG. 10, the rack information management device 140 comprises an input section 140*a*, a display section 140*b*, an interface section 140*c*, a rack information management section 140*d*, and a rack information database 140*e*. This rack information management device 140 also comprises an operating rack management section 140*f*, an operating rack management table 140*g*, and a control section 140*h*.

The input section 140*a* is a device such as a keyboard and a mouse. The display section 140*b* is a display device such as a liquid crystal panel or a display. The interface section 140*c* is a data input/output section used to perform data transaction with the terminals 142 to 147 through the public network 141.

The rack information management section 140*d* manages information for rack components using the rack information database 140*e* in which respective information for pallets, supports, a top, and pads as rack components for each rack is stored. Accordingly, if a user inputs identification information for a desired rack component through the input section 140*a*, the current situation of the rack component can be acquired from the rack information management section 140*d* to display the information on the display section 140*b*.

The operating rack management section 140*f* manages locations of double-stacked racks in use and rack components forming each of the double-stacked racks using the operating rack management table 140*g*.

For example, when the two racks 122*b* are combined to form the double-stacked rack 122*c* at the main-body production site 122 shown in FIG. 9, each key barcode of the racks 122*b* forming the double-stacked rack 122*c* is read by the barcode reader 143*a*. The terminal 143 at the main-body production site transmits respective barcode data with the information indicating that the racks have been combined, to the rack information management device 140. The operating rack management section 140*f* registers this double-stacked rack into the operating rack management table 140*g* based on these barcode data and information.

Likewise, when the two racks 123*b* are combined to form the double-stacked rack 123*c* at the paper-feeder production site 123 shown in FIG. 9, each key barcode of the racks 123*b* forming the double-stacked rack 123*c* is read by the barcode reader 144*a*. The terminal 144 at the paper-feeder production site transmits respective barcode data with the information indicating that the racks have been combined, to the rack information management device 140. The operating rack management section 140*f* registers this double-stacked rack into the operating rack management table 140*g* based on these barcode data and information.

When the two double-stacked racks 122*c* and 123*c* are reassembled in the sales-use warehouse 124 shown in FIG. 9 to construct two double-stacked racks 124*a* each formed with the copier body and the paper feeder, each key barcode of the racks forming the double-stacked rack 124*a* is read by the barcode reader 145*a*. The terminal 144 at the sales-use warehouse transmits respective barcode data with the information indicating that the racks have been reassembled to the rack information management device 140. The operating rack management section 140*f* updates the contents of the operating rack management table 140*g* based on these barcode data and information.

The control section 140*h* controls the overall rack information management device 140. More specifically, when receiving barcode data with its site ID and read time from any of the terminals 142 to 147 at the sites, the control section 140*h* outputs the data to the rack information management section 140*d* or the operating rack management section 140*f*.

An example of the operating rack management table 140*g* shown in FIG. 10 will be explained below. FIG. 11 shows an example of the operating rack management table when the double-stacked racks are assembled at the main-body production site and the paper-feeder production site shown in FIG. 8. FIG. 12 shows another example of the operating rack management table when the double-stacked racks are reassembled at the sales-use warehouse shown in FIG. 8.

As shown in FIG. 11, when a rack S11 and a rack S12 are assembled as a double-stacked rack W123 at the main-body production site 122, the ID number of this double-stacked rack, the ID numbers of the structured racks, the rack components, and the location of the rack components are registered into the operating rack management table 140*g*.

Likewise, when a rack S21 and a rack S22 are assembled as a double-stacked rack W234 at the paper-feeder production site 123, the ID number of this double-stacked rack, the ID numbers of the structured racks, the rack components, and the location of the rack components are registered into the operating rack management table 140*g*.

After the registration, when such double-stacked racks are disassembled into each rack at the sales-use warehouse 124, the rack S11 for the copier body and the rack S21 for the paper feeder are reassembled to be a double-stacked rack, and the rack S12 for the copier body and the rack S22 for the paper feeder are reassembled to be a double-stacked rack, the operating rack management table 140*g* is updated as shown in FIG. 12.

Figure 13:
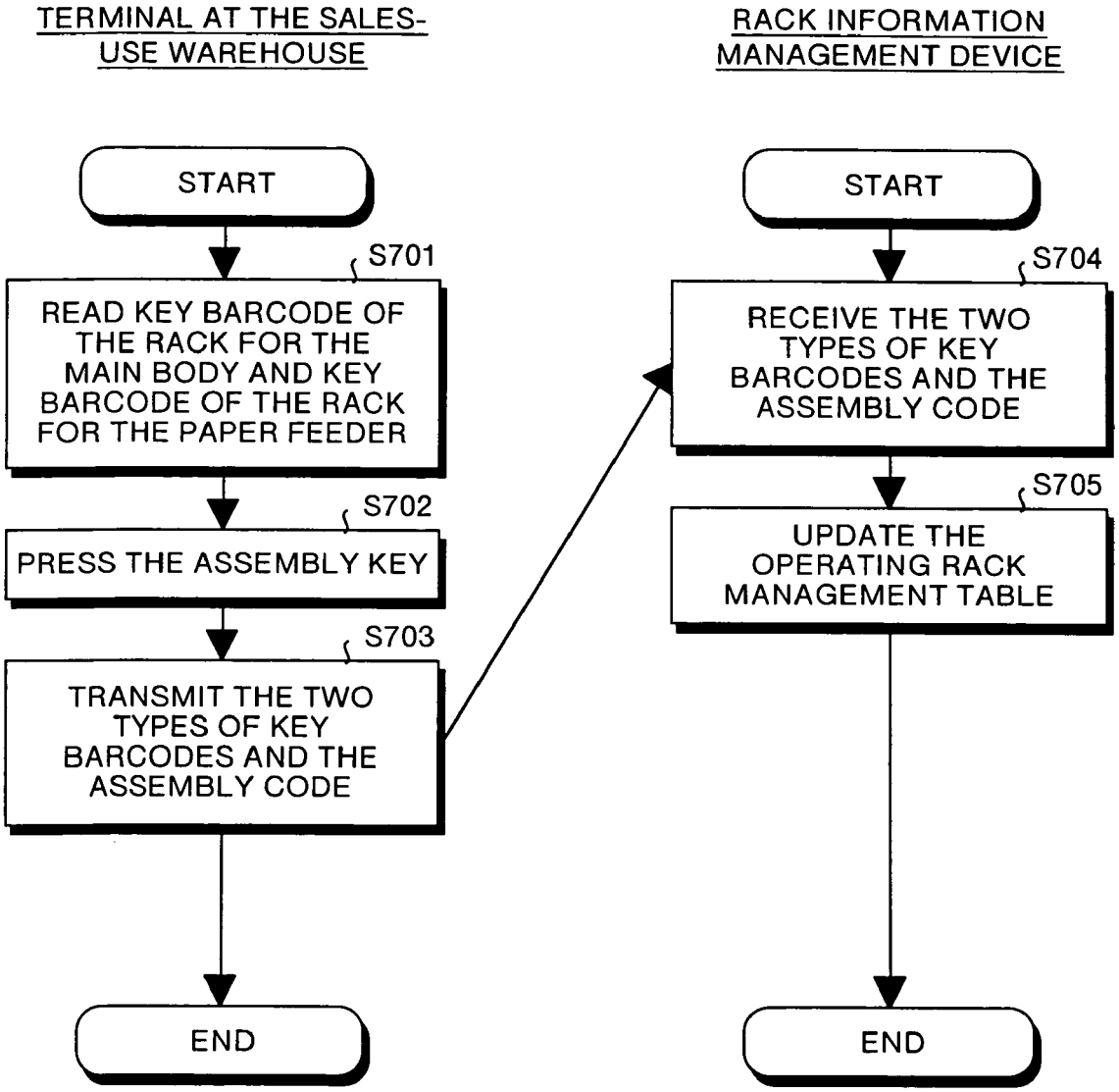
FIG. 13 is a flow chart showing a sequence of processing when the double-stacked racks are reassembled at the sales-use warehouse shown in FIG. 8.

A sequence of processing required for the case where the double-stacked racks are reassembled at the sales-use warehouse 124 as shown in FIG. 8 will be explained below. The flow chart in FIG. 13 shows the sequence of processing when the double-stacked racks are reassembled at the sales-use warehouse shown in FIG. 8.

When the double-stacked rack for the copier bodies and the double-stacked rack for the paper feeders are disassembled respectively to reassemble two new double-stacked racks each formed with the copier body and the paper feeder at the sales-use warehouse 124, the following steps are executed. That is, each key barcode of the two racks forming each double-stacked rack is read by the barcode reader 145*a* (step S701), and an assembly key of the terminal 145 at the sales-use warehouse is pressed (step S702) to transmit two types of key barcodes and an assembly code to the rack information management device 140 (step S703).

On the other hand, when the rack information management device 140 receives the two types of key barcodes and the assembly code (step S704), the operating rack management section 140*f* updates the contents of the operating rack management table 140*g* based on the data (step S705).

As explained above, in this embodiment, when the double-stacked rack for the copier bodies is constructed at the main-body production site 122, the key barcodes of the racks forming the double-stacked rack are read by the barcode reader 143*a*, and the operating rack management section 140*f* registers this double-stacked rack into the operating rack management table 1409 based on the data. Likewise, when the double-stacked racks are reassembled at the sales-use warehouse 124, the operating rack management section 140*f* updates the contents of the operating rack management table 140*g*. Thus, the double-stacked racks in use can efficiently be managed.

Although this embodiment has presented the case where the copier body and the paper feeder are produced at the different production sites for convenience in explanation, this invention is not limited by this embodiment. Accordingly, this invention is also applicable to the case where some other devices such as sorters, two-sided units, or tables with height are produced.

As explained above, according to still another aspect of this invention, the multistage racks in use are managed based on information from a plurality of production sites which produce self-propelled devices, non-self-propelled devices, devices that do not function singly, and main bodies or components of products to be conveyed each as a part forming a device respectively, and pack the devices or the components in the multistage rack to deliver. The multistage racks in use are managed also based on information from the prespecified relay point that reassembles the multistage racks received from the respective production sites and delivers the reassembled multistage racks each formed with the main body and the component. Accordingly, there is an effect that it is possible to obtain the multistage rack management system that can efficiently manage the multistage racks in use.

Further, the rack is formed with the pallet where an article is loaded, the plural supports detachably fitted to the pallet, the top covering the plural supports, or the shock absorbing members disposed between the supports and the article. The multistage rack is formed by stacking a second rack on the upper side of the pallet of a first rack. Accordingly, there is an effect that it is possible to obtain the multistage rack management system that can efficiently manage the multistage rack obtained by stacking the racks each consisting of the pallet, the supports, the top, and the shock absorbing members.

Further, locations of the multistage racks in use and the rack components forming each of the multistage racks are managed based on information from the plurality of production sites or the relay point. Accordingly, there is an effect that it is possible to obtain the multistage rack management system that can easily grasp the locations of the multistage racks and the information for the rack components forming each of the multistage racks.

Further, when assembly of the multistage rack with articles of the same type is notified from any of the production sites, this multistage rack is registered into the operating rack management table. Accordingly, there is an effect that it is possible to obtain the multistage rack management system that can efficiently manage the multistage racks each packed with articles of the same type produced at each of the production sites.

Further, when reassembly of the multistage racks is notified from the relay point, the information concerning the multistage racks registered in the operating rack management table is updated. Accordingly, there is an effect that it is possible to obtain the multistage rack management system that can efficiently manage the multistage racks that have been reassembled.

Further, when a plurality of racks are assembled to form the multistage rack or when the multistage racks are reassembled, the multistage rack is registered into the operating rack management table, or the information concerning the multistage rack registered into the operating rack management table is updated based on barcode information obtained by reading the key barcodes attached to the racks forming the multistage rack. Accordingly, there is an effect that it is possible to obtain the multistage rack management system that can manage the multistage racks speedily and efficiently based on the barcodes.

According to still another aspect of this invention, the multistage racks in use are managed based on information from the plurality of production sites which produce self-propelled devices, non-self-propelled devices, devices that do not function singly, and main bodies or components of products to be conveyed each as a part forming a device respectively, and pack the devices or the components in the multistage rack to deliver. The multistage racks in use are managed also based on information from the prespecified relay point that reassembles the multistage racks received from the respective production sites and delivers the reassembled multistage racks each formed with the main body and the component. Accordingly, there is an effect that it is possible to obtain the multistage rack management method in which the multistage racks in use can efficiently be managed.

Further, the rack is formed with the pallet where an article is loaded, the plural supports detachably fitted to the pallet, the top covering the plural supports, or the shock absorbing members disposed between the supports and the article. The multistage rack is formed by stacking a second rack on the upper side of the pallet of a first rack. Accordingly, there is an effect that it is possible to obtain the multistage rack management method in which the multistage rack can efficiently be managed by stacking the racks each consisting of the pallet, the supports, the top, and the shock absorbing members.

Further, locations of the multistage racks in use and the rack components forming each of the multistage racks are managed based on information from the plurality of production sites or the relay point. Accordingly, there is an effect that it is possible to obtain the multistage rack management method in which the locations of the multistage racks and the information for the rack components forming each of the multistage racks can easily be grasped.

Further, when assembly of the multistage rack with articles of the same type is notified from any of the production sites, this multistage rack is registered into the operating rack management table. Accordingly, there is an effect that it is possible to obtain the multistage rack management method in which the multistage racks each packed with articles of the same type produced at each of the production sites can efficiently be managed.

Further, when reassembly of the multistage racks is notified from the relay point, the information concerning the multistage racks registered in the operating rack management table is updated. Accordingly, there is an effect that it is possible to obtain the multistage rack management method in which the multistage racks, that have been reassembled, can efficiently be managed.

Further, when the plurality of racks are assembled to form the multistage rack or when the multistage racks are reassembled, the multistage rack is registered into the operating rack management table, or the information concerning the multistage rack registered in the operating rack management table is updated based on barcode information obtained by reading the key barcodes attached to the racks forming the multistage rack. Accordingly, there is an effect that it is possible to obtain the multistage rack management method in which the multistage racks can be managed speedily and efficiently based on the barcodes.

Figure 14:
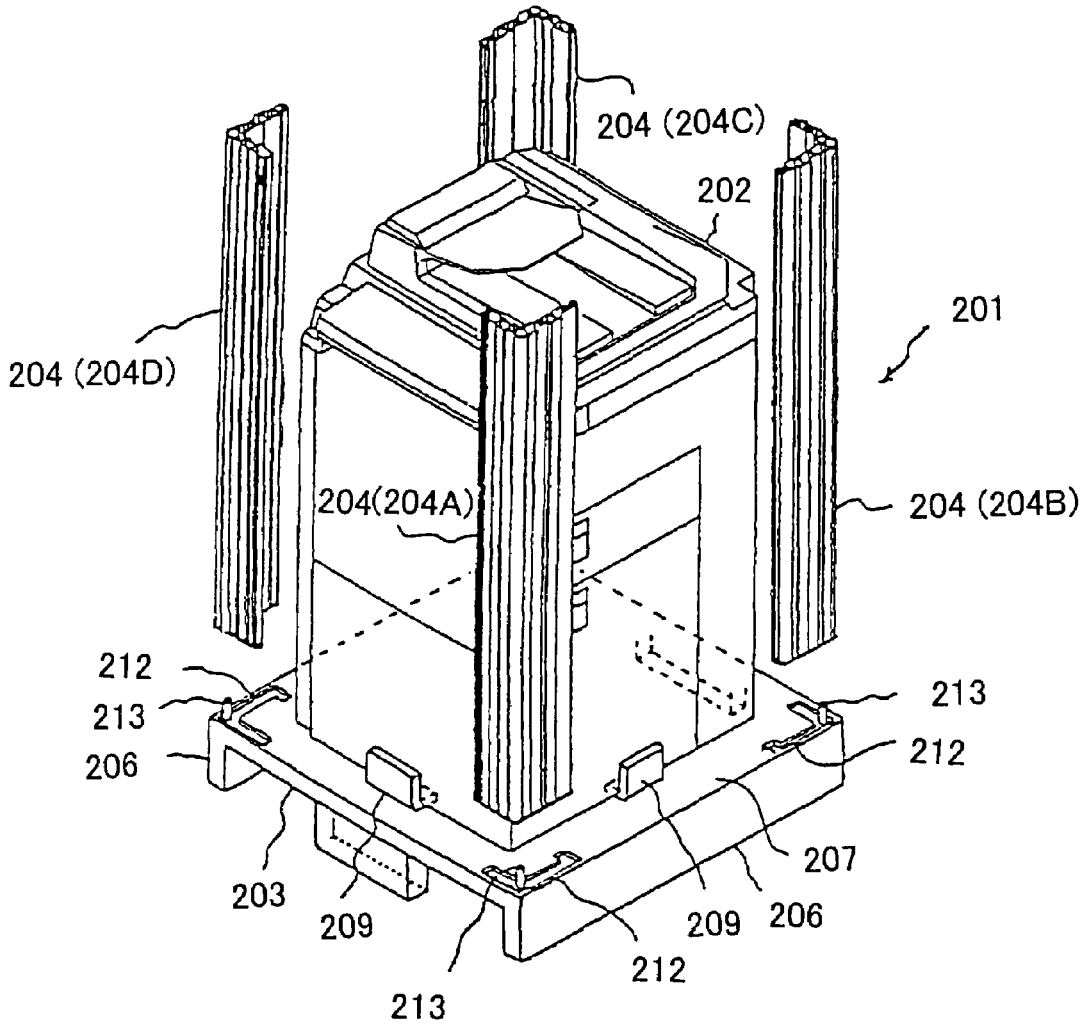
FIG. 14 is a perspective view showing how an article is loaded on a pallet of the article conveyance and storage device through article holding members.
Figure 15:
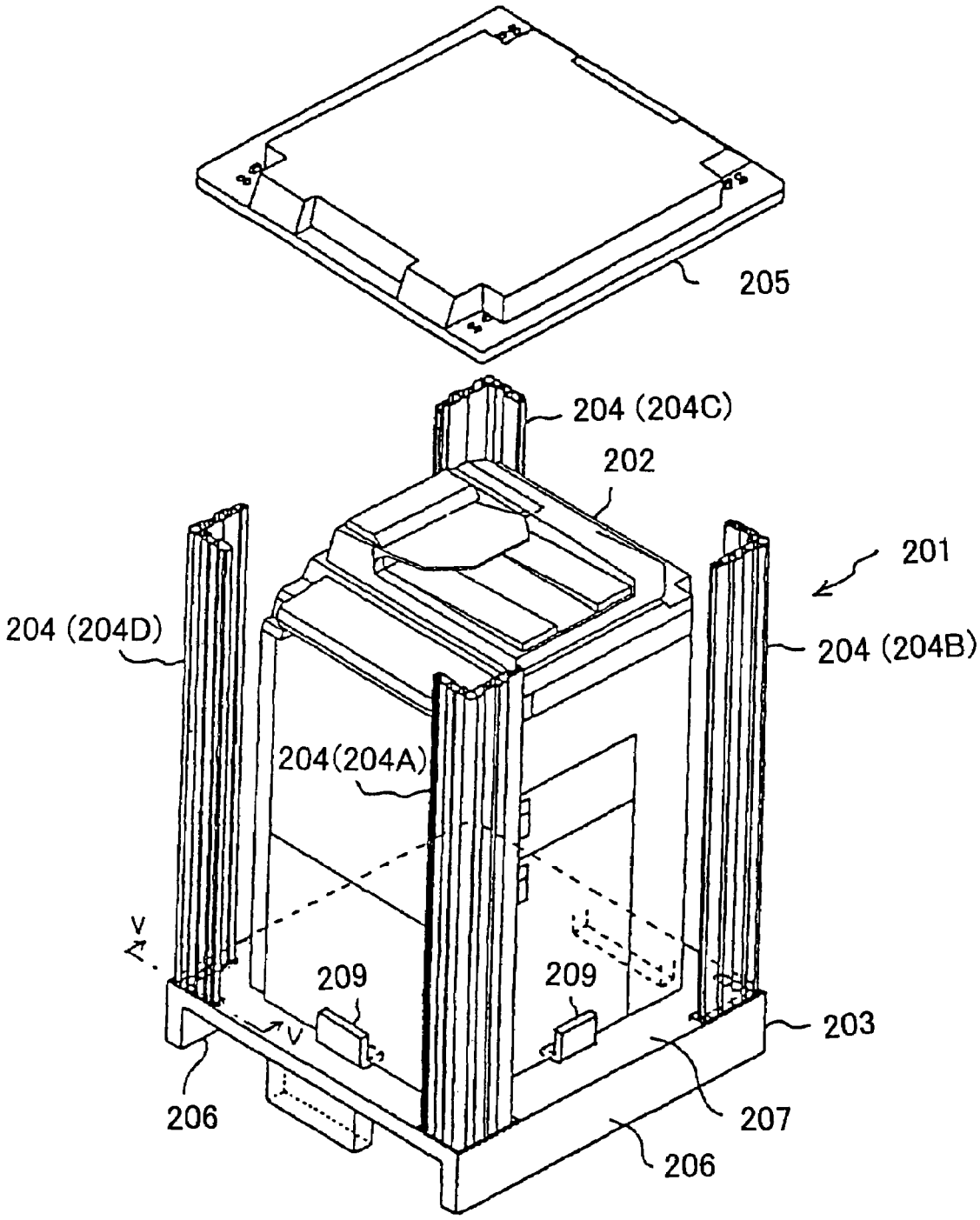
FIG. 15 is a perspective view showing how four supports are fitted to the pallet.
Figure 16:
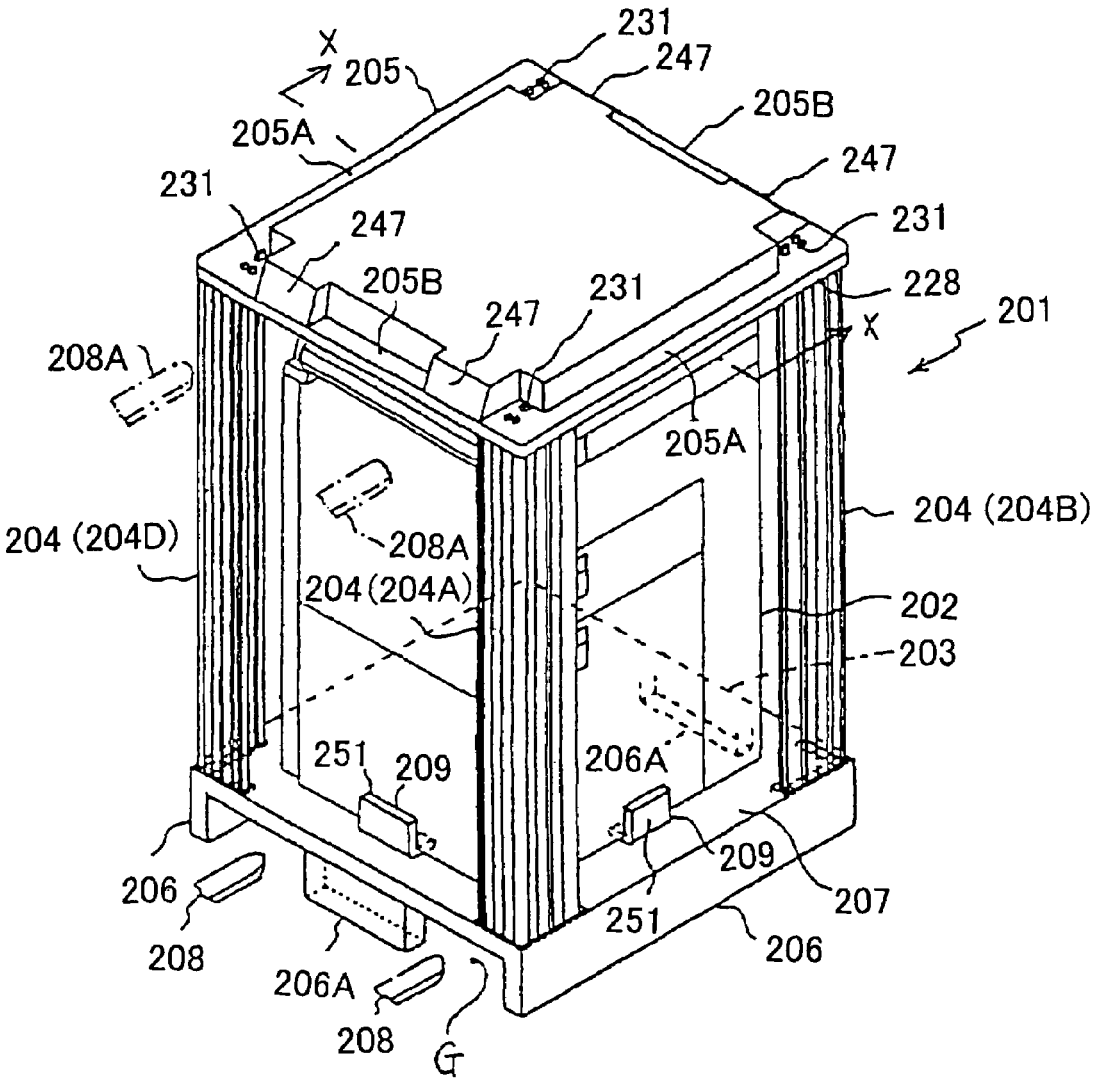
FIG. 16 is a perspective view showing how a shock absorber is fixed to the upper part of the support.

An embodiment of the article conveyance and storage device according to this invention will be explained in detail. The perspective views in FIG. 14 to FIG. 16 show an example of the article conveyance and storage device. The article conveyance and storage device 201 comprises a pallet 203 where an article 202 is loaded directly or through another member, a plurality of supports: four supports in the example detachably fitted to the pallet 203, and a top 205 (not shown in FIG. 14) detachably fixed to the upper parts of the plurality of supports 204 fitted to the pallet 203. FIG. 14 to FIG. 16 show copiers as an example of the article 202. However, any other article may be conveyed or stored by the article conveyance and storage device 201.

The pallet 203 shown as an example in the figure has two leg parts 206 and a loading plate 207 integrally formed with these leg parts 206, and both of the leg parts 206 are placed on the installation surface such as a floor surface. At this time, a gap G is formed between the installation surface and the loading plate 207 so that a fork 208 (FIG. 16) of a cargo handling gear such as a forklift can be inserted into the gap. This pallet 203 is formed with a molded product of hard resin. However, the pallet 203 may be formed with metal or wood, or a high rigidity material such as a composite material of these materials.

In order to convey or store the article 202 using the article conveyance and storage device 201, the article 202 is loaded on the top surface of the pallet 203 as shown in FIG. 14. In this case, the article 202 may be directly loaded on the pallet. In the shown example, the article 202 is loaded on the pallet 203 through article holding members 209, which will be explained in detail later. At this time, the article 202 may be covered with a flexible resin film or resin sheet, or a sack made of cloth, which is not shown.

Figure 17:
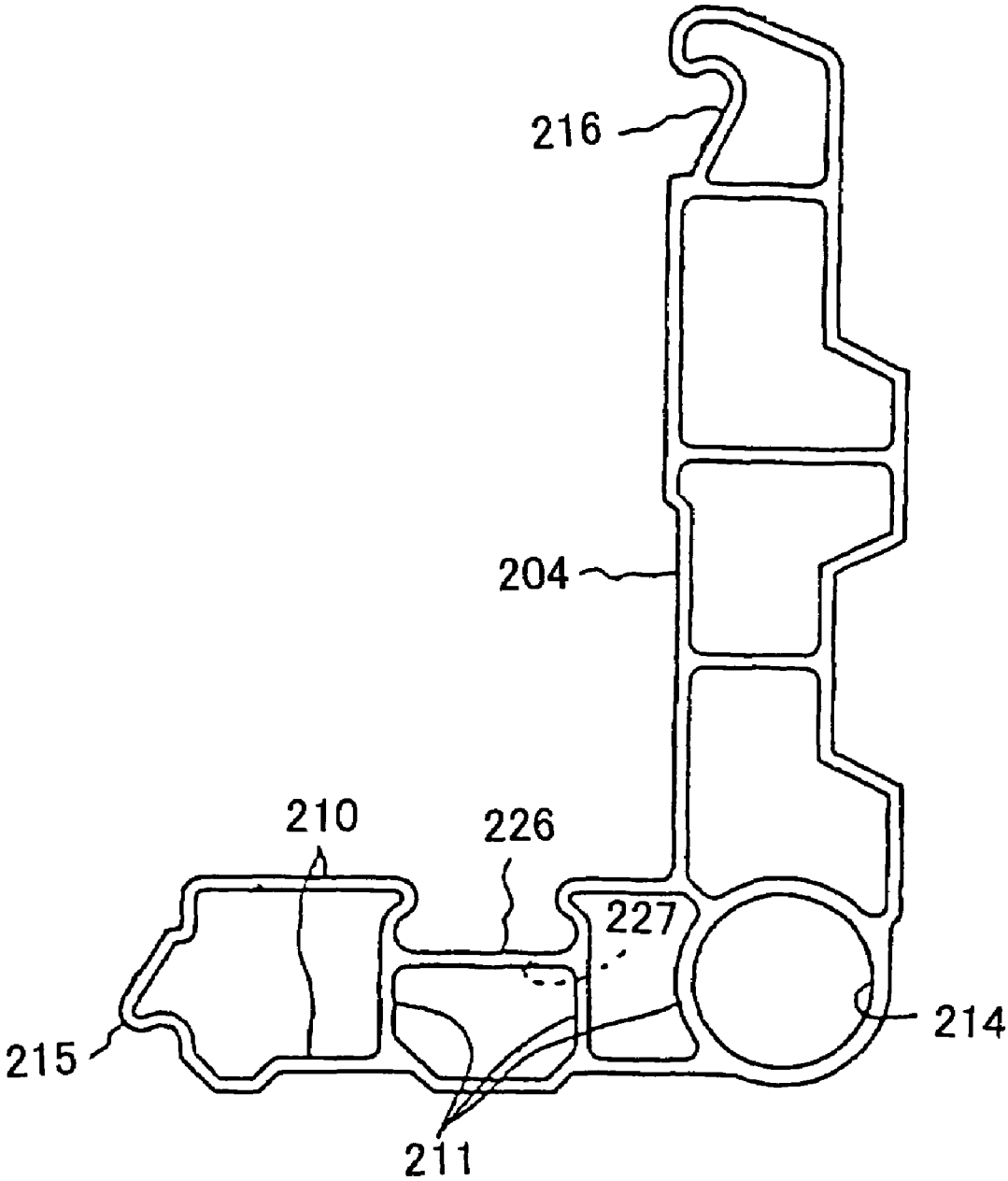
FIG. 17 is an enlarged plan view of the support.

As shown in FIG. 15, the lower parts of the four supports 204 are fitted to the four corners of the pallet 203 so as to surround the article 202 on the pallet 203. The plurality of supports 204 fitted to the pallet 203 are positioned almost upright with respect to the top surface of the loading plate 207 and in substantially parallel with each other. The supports may be formed with any material such as wood or metal. However, the supports 204 in this example are formed with a molded product obtained by extruding resin or metal, and preferably hard resin as shown in FIG. 17. Numbers of hollow parts are partitioned inside the molded product with its outer wall 210 and a plurality of partition walls 211. The overall support 204 is a substantially L-shape in cross section.

The supports 204 for this article conveyance and storage device are not coupled to each other by coupling members. Therefore, when the plurality of supports 204 are fitted to the pallet 203, the supports 204 fitted to the pallet 203 are independent from each other. Accordingly, by detaching these supports 204 from the pallet 203, these supports 204 may come apart from one another. Two adjacent supports may also be coupled so as to be narrowed to or widened from each other through the coupling members. In this case, the supports can still relatively move after these supports are detached from the pallet 203.

Figure 18:
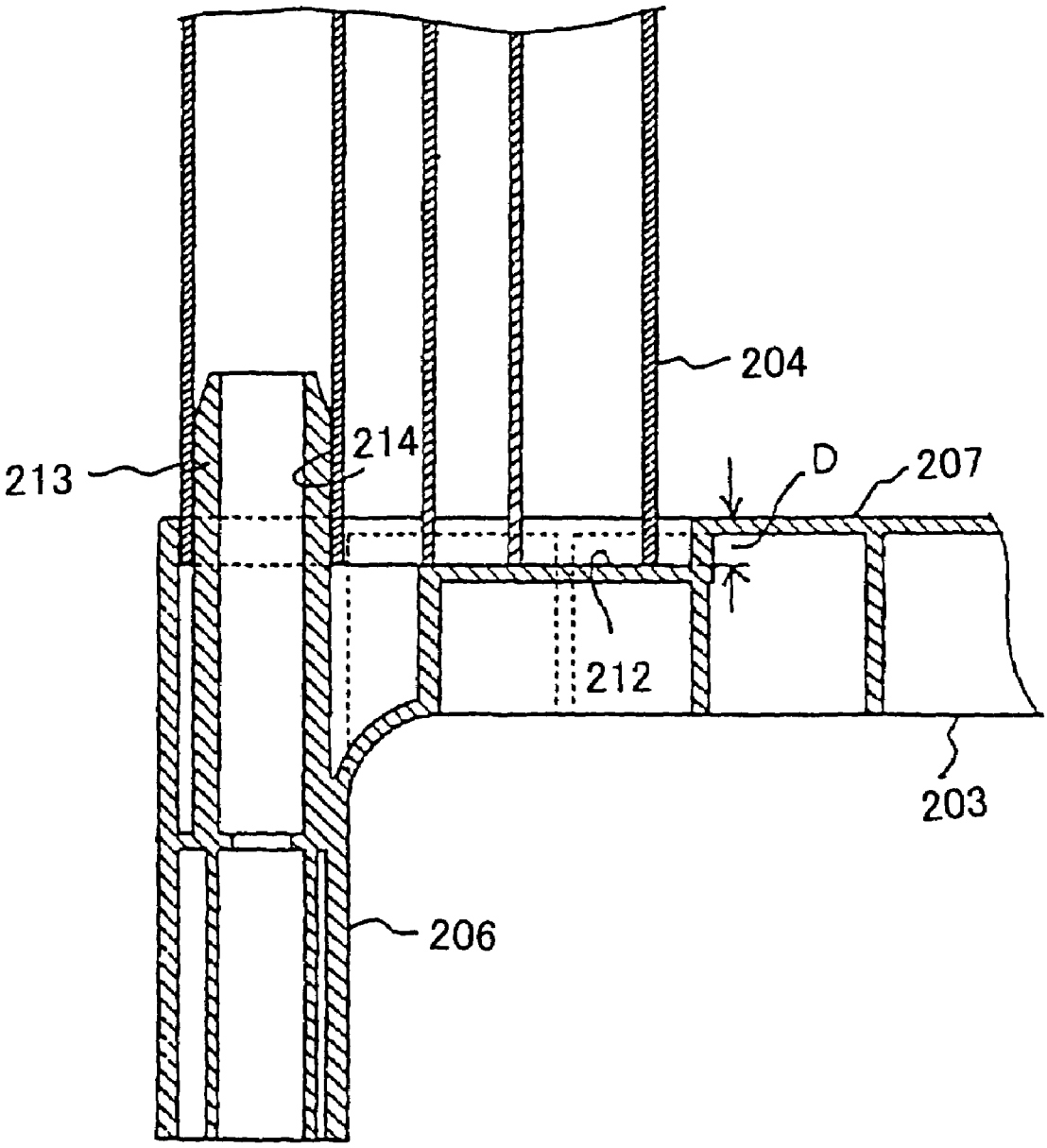
FIG. 18 is an enlarged cross-sectional view of the support taken along the line V-V in FIG. 15.

As shown in FIG. 14, fitting grooves 212 into which the lower parts of the supports 204 are fitted are formed on the four corners of the pallet 203. By fitting the lower part of the support 204 into each of the fitting grooves 212 as shown in FIG. 18, the supports 204 can be easily and accurately positioned and fitted to the pallet 203. The depth D of each fitting groove 212 is about 10 to 30 pp, preferably about 20 pp. By fitting the lower parts of the supports 204 into such fitting grooves 212, the supports 204 can be assembled in almost upright positions with respect to the pallet 203.

Further, the pallet 203 of this embodiment has pins 213 projecting upwardly from the parts where the fitting grooves 212 are formed. Therefore, the pins 213 are fitted into the lower parts of pin fitting holes 214 formed in the supports 204, respectively. As shown in FIG. 17, the pin fitting hole 214 is partitioned by a part of the outer wall 210 of the support 204 and a part of the partition wall 211, and formed along the length of the support 204.

After the plurality of supports 204 are fitted to the pallet 203 in the above manner, the top 205 is fixed to the upper parts of the supports 204 as shown in FIG. 16. Accordingly, the article 202 is surrounded by the top 205, the pallet 203, and the plurality of supports 204 to be accommodated in the article conveyance and storage device 201. The article 202 kept in this state can be conveyed or stored in a warehouse or the like.

In order to convey the article 202, for example, the fork 208 of a forklift is inserted into the gap G in the lower side of the loading plate 207 as shown in FIG. 16. By raising the fork 208, the article conveyance and storage device 201 is lifted, and is loaded onto a truck or the like. The article 202 is transported from its manufacturing plant to a user in the above manner. The article 202 can be unloaded from the pallet 203 at the user site in reverse order to how the article is loaded, that is, by detaching the top 205 from the supports 204 and detaching the supports 204 from the pallet 203. Using the top 205 can protect the upper part of the article 202 during transport. Alternatively, the article can also be conveyed or stored without using the top 25.

As explained above, the article conveyance and storage device 201 is used to convey the article, store the article temporarily or over the long term, or accommodate it for some other purposes. Therefore, this article conveyance and storage device 201 may be referred to as an article storage device or an article keeping device.

The article conveyance and storage device 201 can be used many times by transporting the article 202 to a specified place, unloading the article 202 from the article conveyance and storage device 201 at the destination, and sending back the article conveyance and storage device 201 to its original site. When the article conveyance and storage device 201 is to be sent back to the original site, the pallet 203 and the supports 204 detached from the pallet 203 can be conveyed by folding them compactly. However, if the plurality of supports are conveyed in their randomly-oriented state, conveying efficiency is reduced.

To prevent reduction in the conveying efficiency, the article conveyance and storage device 201 in this embodiment is structured to integrally couple two supports, that have been detached from the pallet 203, to be a bundle of the supports so that the bundle can efficiently be conveyed. The structure concerning this bundle will be explained in detail below.

All the four supports 204 shown in FIG. 14 to FIG. 16 have the same cross section and are formed in the same size. When it is required to identify each of the supports 204, any of legends 204A, 204B, 204C, and 204D assigned to the respective supports is used to identify the target one. The two supports 204A and 204C, which are disposed opposite to the article 202, are fitted to the pallet 203 so that the ends of these two supports are reversely oriented to each other. The other two supports 204B and 204D are also fitted in the same manner. As shown in FIG. 17, a projecting portion 215 and a recessed portion 216 are formed on the outer wall 210 of each support 204 along the length of the support 204 in its longitudinal direction.

Figure 19:
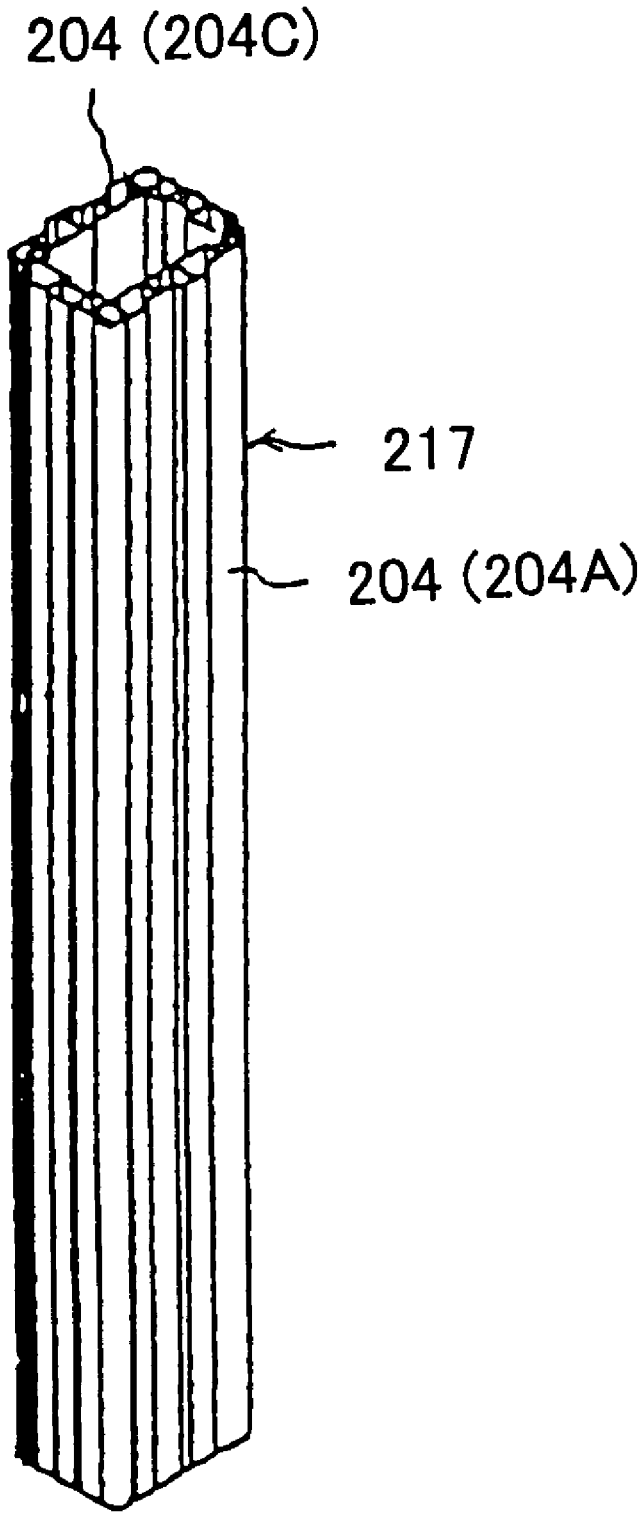
FIG. 19 is a perspective view showing how to form a bundle of supports by joining two supports positioned adjacently and in parallel with each other.
Figure 20:
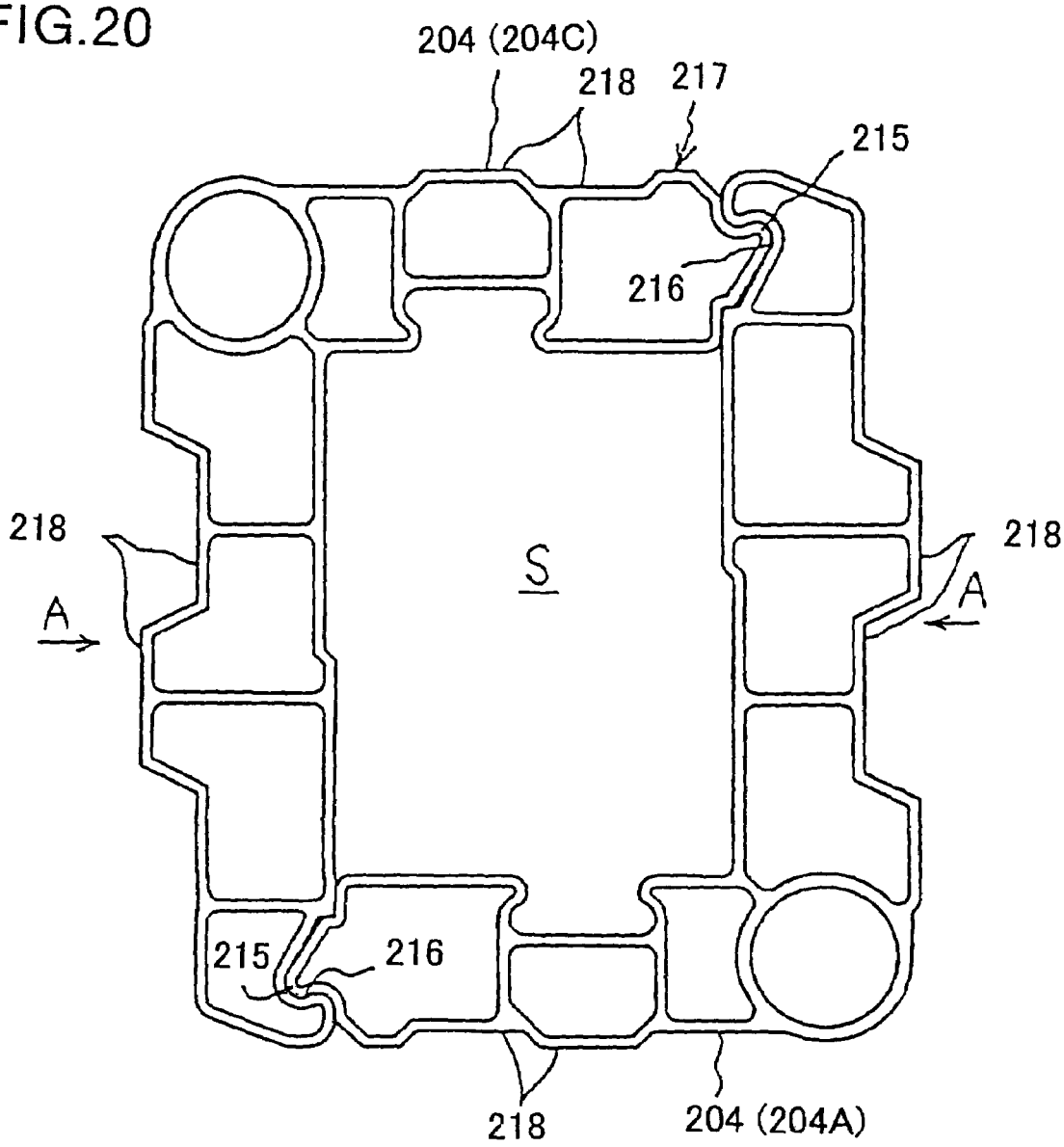
FIG. 20 is an enlarged plan view of the bundle of the supports shown in FIG. 19.

When the supports 204 are detached from the pallet 203, the supports 204 are randomly oriented from one another. However, of these supports 204, the two supports 204A and 204C, whose tops are reversely oriented, are matched with each other at each end in the longitudinal direction, and these two supports are kept adjacently in substantially parallel with each other as shown in FIG. 19 and FIG. 20. The projecting portions 215 and the recessed portions 216 of the supports 204A and 204C are positioned opposite to each other. Both of the supports 204A and 204C are then manually pressed from their outer side to their inner side as shown by the arrows A in FIG. 20. The projecting portion 215 of the support 204A is fitted into the recessed portion 216 of the support 204C, and the projecting portion 215 of the support 204C is also fitted into the recessed portion 216 of the support 204A. At the time of fitting, the parts of the supports forming the recessed portions 216 and the projecting portions 215 are elastically deformed by a slight amount. When the recessed portions 216 and the projecting portions 215 are fitted into each other as shown in FIG. 20, the parts of the supports are elastically recovered to their original shape. By click-fitting the projecting portions 215 to the recessed portions 216 to be engaged with each other, both of the supports 204A and 204C are integrally coupled to each other. Therefore, they will not be separated from each other unless a separation force stronger than a prespecified magnitude is applied to these two. These supports 204A and 204C are tied in a bundle 217 so as not to be moved in such a manner, thus efficiently conveying the bundle to a specified place or storing it in a small space.

The other two supports 204B and 204D are also coupled in the same manner to be a bundle of the supports, so that the bundle can be efficiently conveyed or stored.

When the article conveyance and storage device 201 is used again, the coupled supports 204A and 204C are manually pulled in the direction opposite to the arrows A as shown in FIG. 20. The projecting portions 215 and the recessed portions 216 are then disengaged, and the supports 204A and 204C are separated from each other. After the separation, these supports 204A and 204C can be fitted to the pallet 203 respectively. The other supports 204B and 204D are operated in the same manner. The projecting portion 215 and the recessed portion 216 formed on the support itself are structured as an example of a support coupling unit to detachably yet integrally couple the supports to each other.

In the example, although the two supports having been detached from the pallet 203 are detachably coupled to each other, three or more of supports may be detachably and integrally joined, so that these supports can also be conveyed or stored in a bundle.

As explained above, the article conveyance and storage device according to this embodiment has a support coupling unit that detachably yet integrally and securely couple at least two supports, that have been detached from the pallet, in a state where they are positioned adjacently in substantially parallel with each other. The support coupling unit is provided on the support itself. In the shown example, the support coupling unit has the projecting portion 215 that is formed on one of the supports to be coupled to each other, and the recessed portion 216 that is formed on the other support and engaged with the projecting portion 215. The support coupling unit in this example has a simple structure, which makes it possible to suppress increase in cost of the article conveyance and storage device. However, any other types of support coupling unit may be applied as necessary.

Since the support coupling units are formed on the supports themselves to be coupled to each other, a plurality of supports 204 detached from the pallet 203 can easily and securely be tied up without carrying a tightening tool such as bands or ropes at the time of transporting the article.

Figure 21:
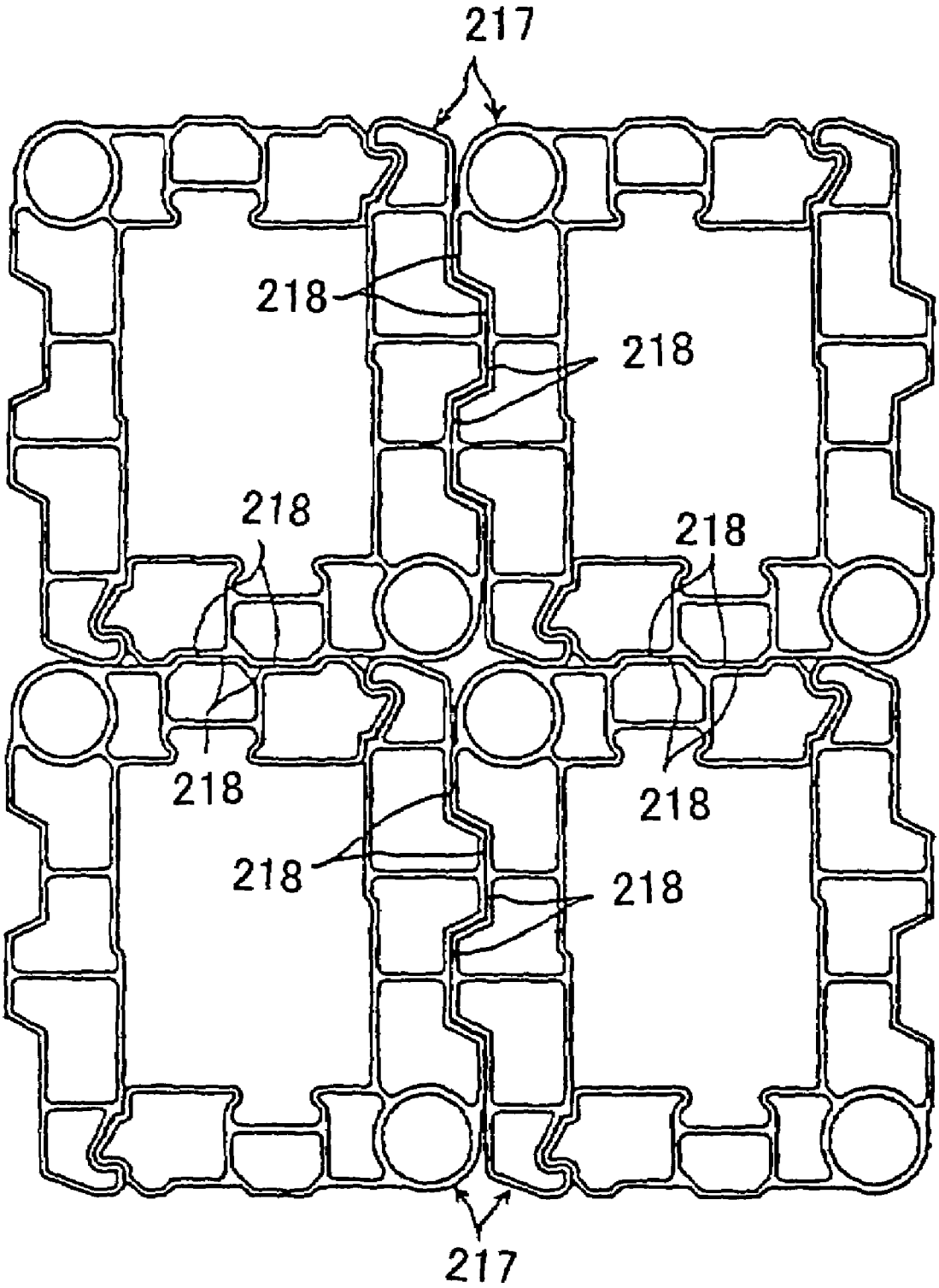
FIG. 21 is a plan view showing how to combine plural bundles of the supports with one another.

When the two supports 204A and 204C are coupled to tie the supports in a bundle 217 as shown in FIG. 20, the bundle 217 has a space S internally formed by being partitioned, which is a substantial square in cross section. In this case, uneven portions 218 are formed along the outer periphery of the bundle 217 and all the supports 204 are molded in the same form. Therefore, as shown in FIG. 21, if the bundles of the supports are kept adjacently in substantially parallel with each other, the uneven portions 218 of the bundles 217 are fitted to each other. Accordingly, these supports 204 can be tightly combined with each other. The uneven portions 218 are formed as an example of fitting parts to combine the bundles of the supports with each other. As explained above, the article conveyance and storage device according to this embodiment has fitting parts formed on each of the supports. More specifically, these fitting parts function to combine bundles each consisting of at least two coupled supports with each other so as to keep the bundles adjacently in substantially parallel with each other.

Numbers of support bundles 217 can be combined with each other by the fitting parts so as to be kept adjacently in substantially parallel with each other. Accordingly, when the numbers of support bundles 217 are conveyed or stored in their combined form, it is possible to prevent such inconvenience that the bundles are separated to cause load shifting, thus extremely efficiently conveying or storing the numbers of supports 204.

It is assumed that there is a large gap between the article 202 and the supports 204 when the article 202 is loaded on the article conveyance and storage device 201. In this case, an impact force is applied from the load carrying platform of a truck to the article conveyance and storage device 201 during transport of this device 201 loaded on the truck, for example, which may cause the article 202 on the pallet 203 to largely vibrate.

Figure 22:
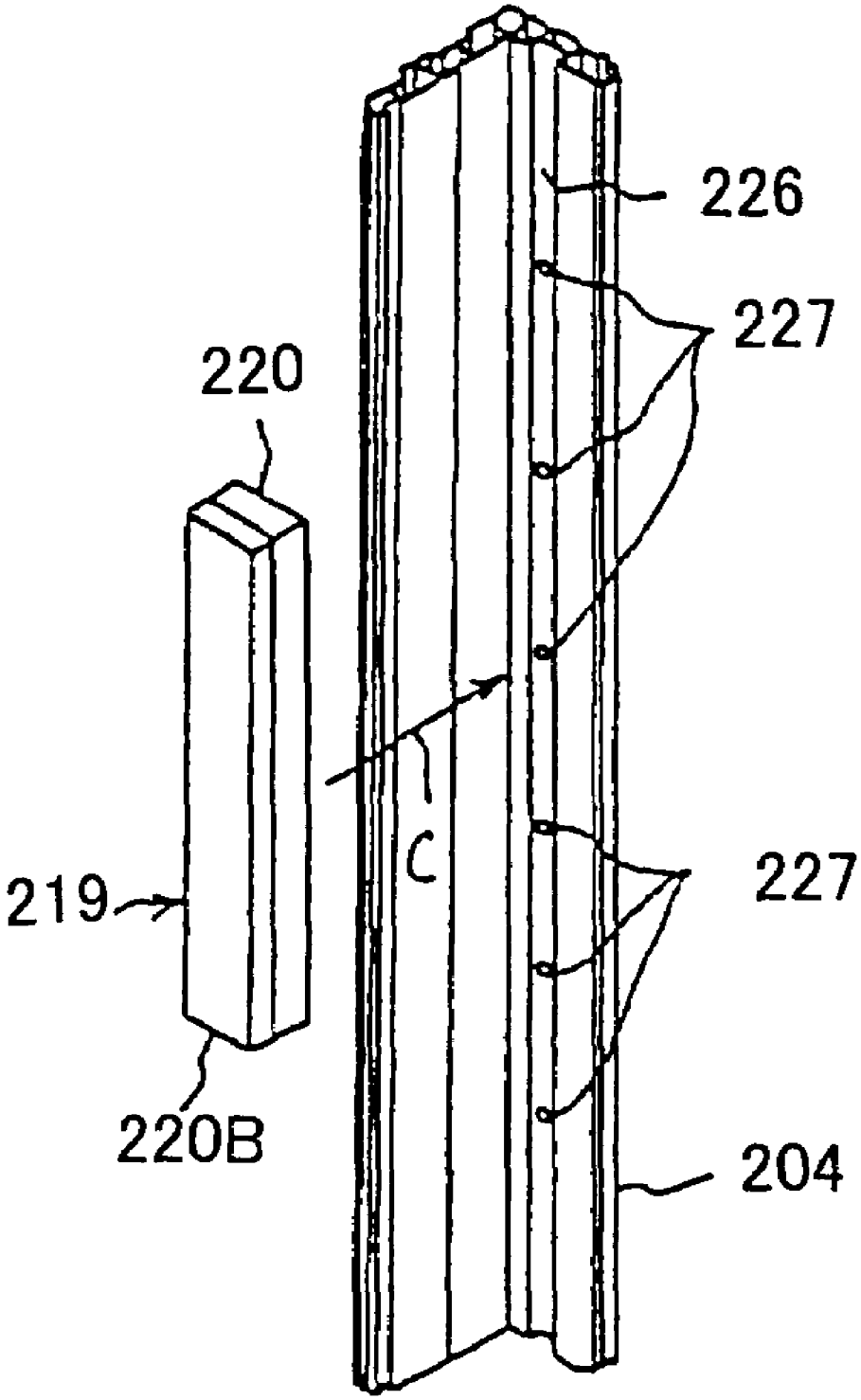
FIG. 22 is a perspective view showing how to fix the shock absorber to the support.
Figure 23:
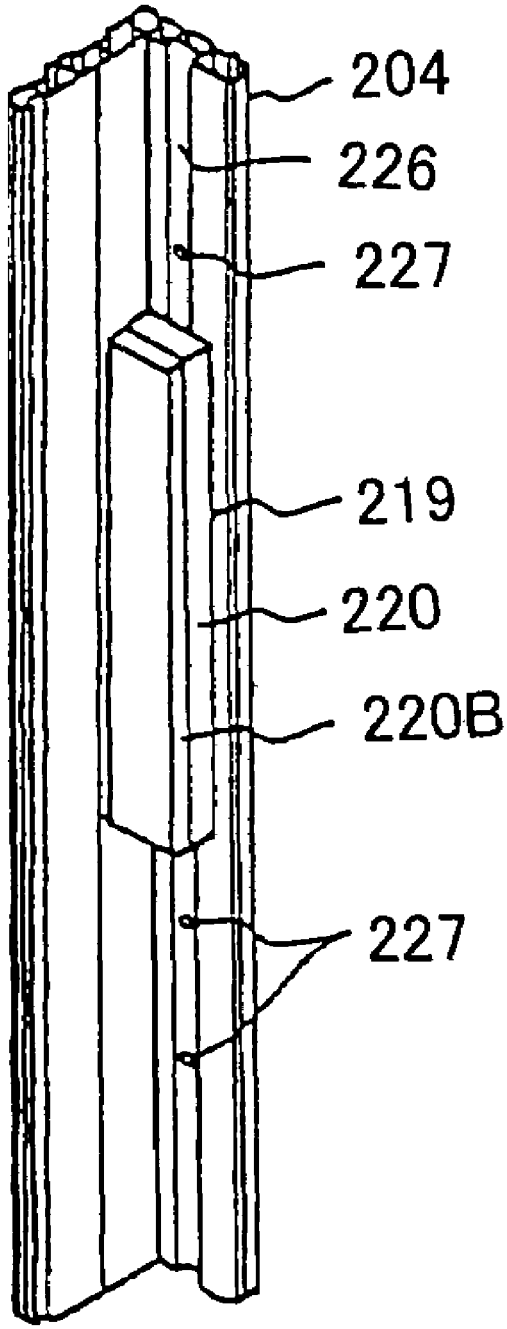
FIG. 23 is a perspective view showing the shock absorber fixed to the support.
Figure 24:
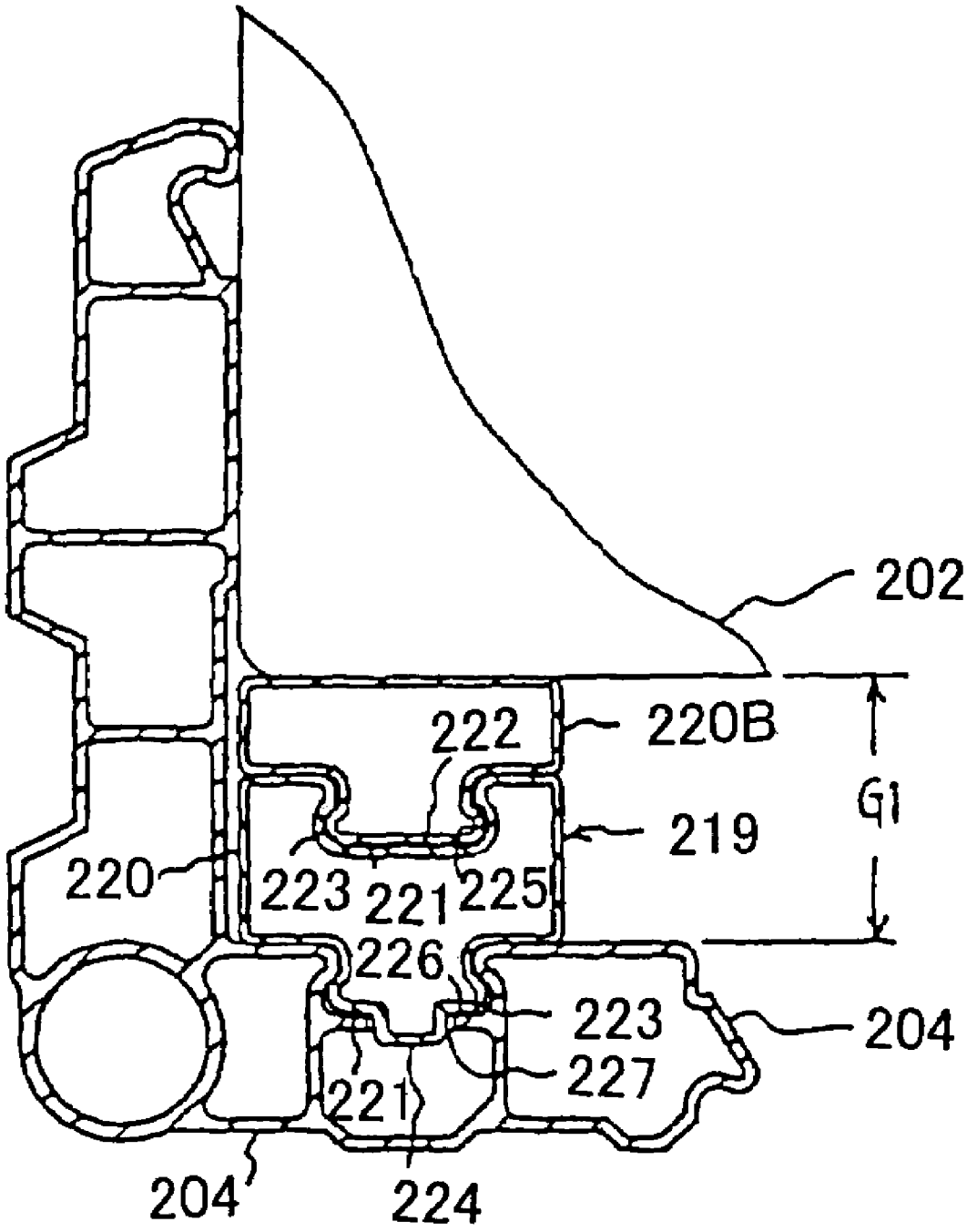
FIG. 24 is a horizontal cross-sectional view showing how the shock absorber is disposed between the article and the support.

In the article conveyance and storage device 201 according to this embodiment, shock absorbers 219 are disposed between the article 202 loaded on the pallet 203 and each of the supports 204 fitted to the pallet 203, respectively, as shown in FIG. 22 to FIG. 24. The article 202 is held by the supports 204 through the shock absorbers 219 to suppress occurrence of vibration of the article 202. Further, fixing units that fix the shock absorbers 219 to the supports 204 are provided in this device (FIG. 14 to FIG. 16 show the supports without the shock absorbers). The more specific example of the shock absorber 219 and the fixing unit and the effect of these units will be explained below.

As shown in FIG. 24, a gap G1 formed between the support 204 and the article 202 is different depending on the size and the shape of the article 202 loaded on the pallet 2. However, the shock absorber 219 according to this embodiment consists of a shock absorbing member or a plurality of shock absorbing members detachably coupled to each other so that the shock absorber 219 having a thickness fitting the gap G1 can be disposed in the gap G1.

Figure 25:
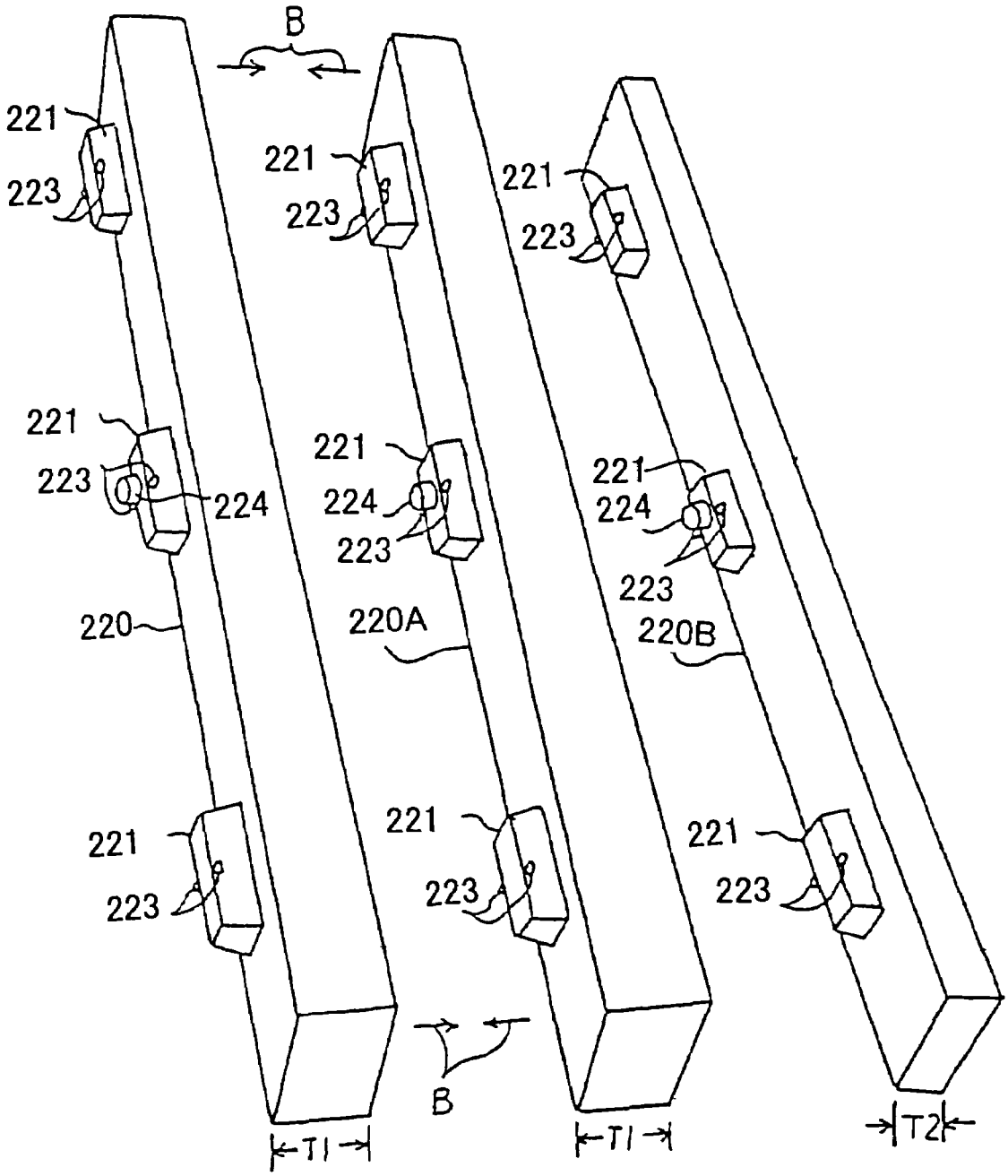
FIG. 25 is a perspective view showing a plurality of shock absorbing members.
Figure 26:
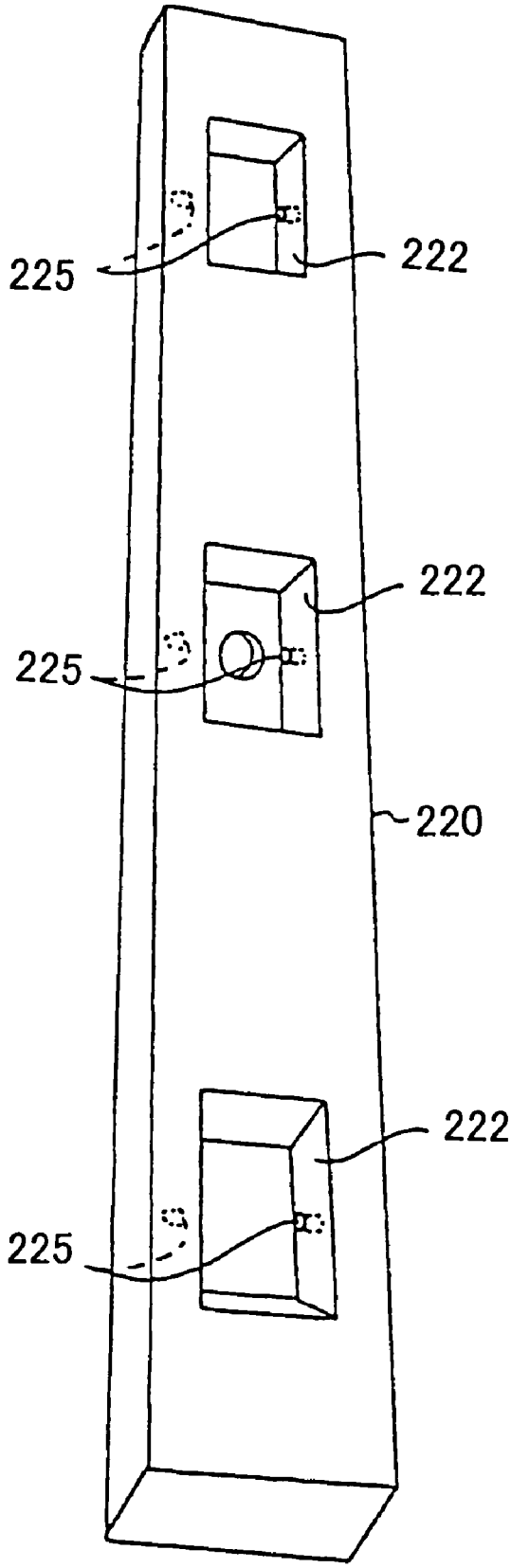
FIG. 26 is a perspective view showing the rear side of one of the shock absorbing members.

FIG. 25 shows three shock absorbing members 220, 220A, and 220B. FIG. 26 shows the rear side of the shock absorbing member 220. Each of these shock absorbing members 220, 220A, and 220B is formed with a slim piece of molded product that has a hollow inside the product molded with resin through a blow molding method.

As shown in FIG. 25, at least two protruding portions, three protruding portions 221 in the figure, are formed apart from each other on the front side of the shock absorbing member 220 in its longitudinal direction. Projections 223 are formed on both sides of each protruding portion 221. Further, a protrusion 224 is formed on the top surface of the protruding portion as a middle one of the three protruding portions 221. As shown in FIG. 26, rectangular grooves 222 are formed on the rear side of the shock absorbing member 220. More specifically, each of these rectangular grooves 222 has such a shape and a size that the protruding portion 221 can be fitted into the groove, and is formed at a position corresponding to the protruding portion 221. Further, fitting holes 225 are formed on the side walls of each rectangular groove 222 as shown in FIG. 24.

Figure 27:
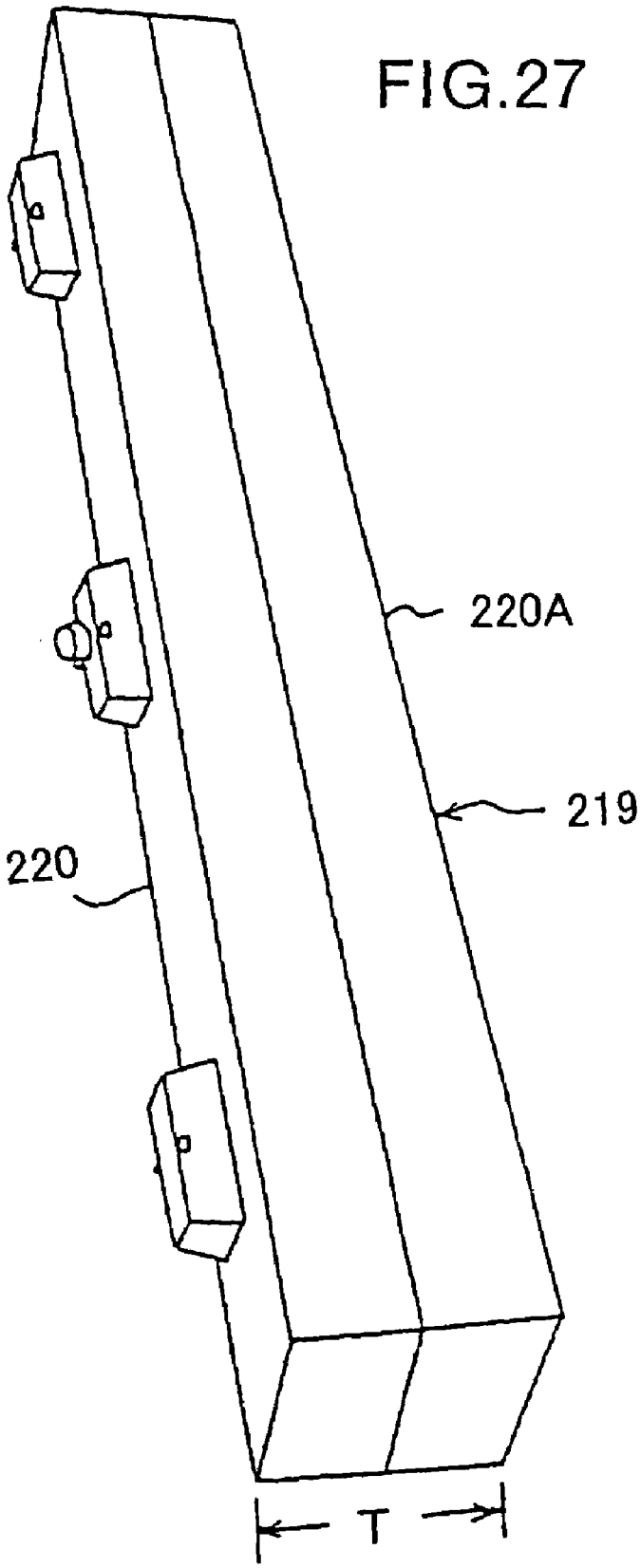
FIG. 27 is a perspective view of a shock absorber formed by joining two shock absorbing members of the same type to each other.

The shock absorbing member 220A shown in FIG. 25 is also formed in the same shape and size as the shock absorbing member 220. In order to couple these shock absorbing members 220 and 220A, the rear side of the shock absorbing member 220 and the front side of the shock absorbing member 220A are positioned opposite to each other and manually pressed in the direction indicated by the arrow B. The protruding portions 221 on the front side of the shock absorbing member 220A are then fitted into the rectangular grooves 222 on the rear side of the shock absorbing member 220. At this moment, the projections 223 provided on each of the protruding portions 221 of the shock absorbing member 220A are fitted into the fitting holes 225 formed on the side walls of the rectangular grooves 222 of the shock absorbing member 220, respectively. By click-fitting the projections 223 into the fitting holes 225 in the above manner, both of the shock absorbing members 220 and 220A are coupled to each other, as shown in FIG. 27, so that these two members will not be separated from each other unless a separation force stronger than a prespecified magnitude is added to these members. The shock absorber 219 having a thickness of T consisting of these two shock absorbing members 220 and 220A can be formed in such a manner. These shock absorbing members 220 and 220A can be separated from each other by manually pulling them in the direction opposite to the arrow B (FIG. 25) by the force stronger than the prespecified magnitude.

Figure 28:
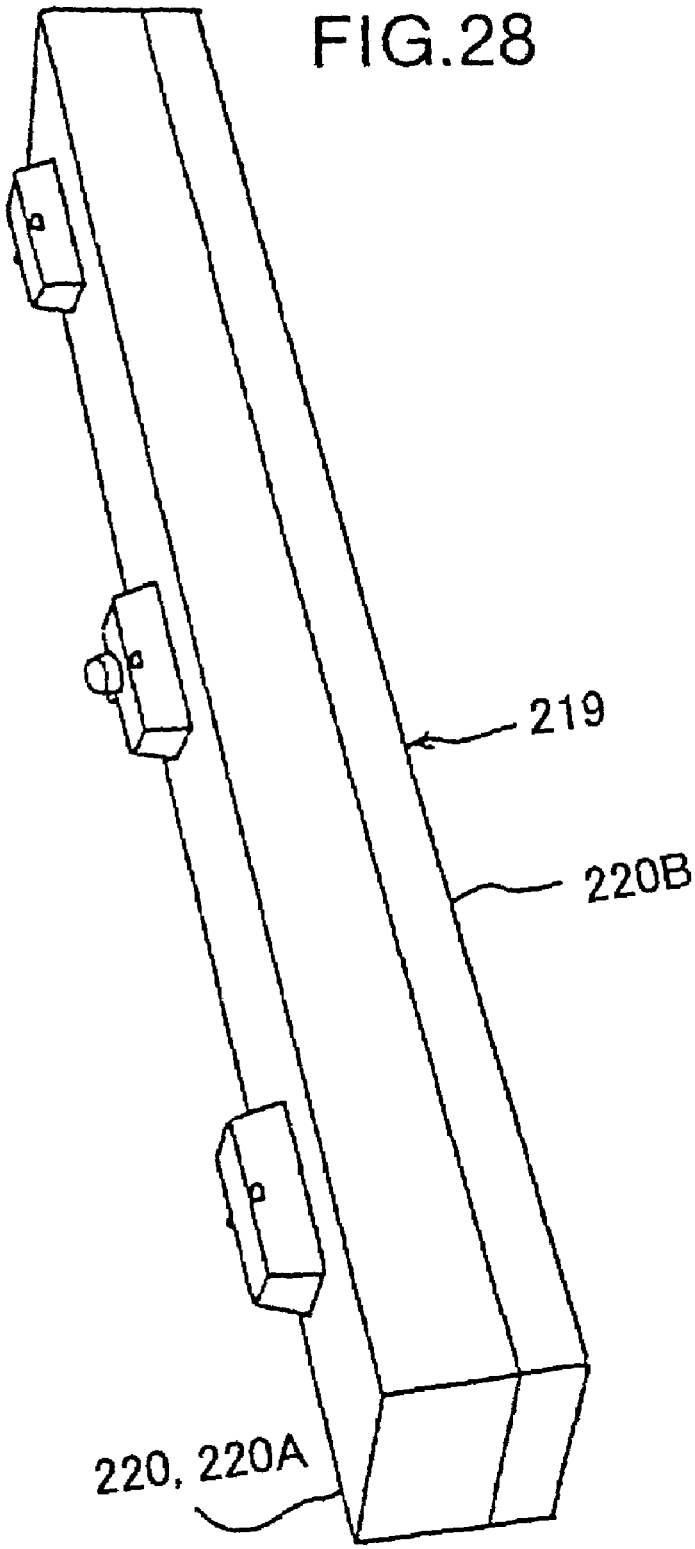
FIG. 28 is a perspective view of a shock absorber formed by joining two shock absorbing members having a different thickness to each other.
Figure 29:
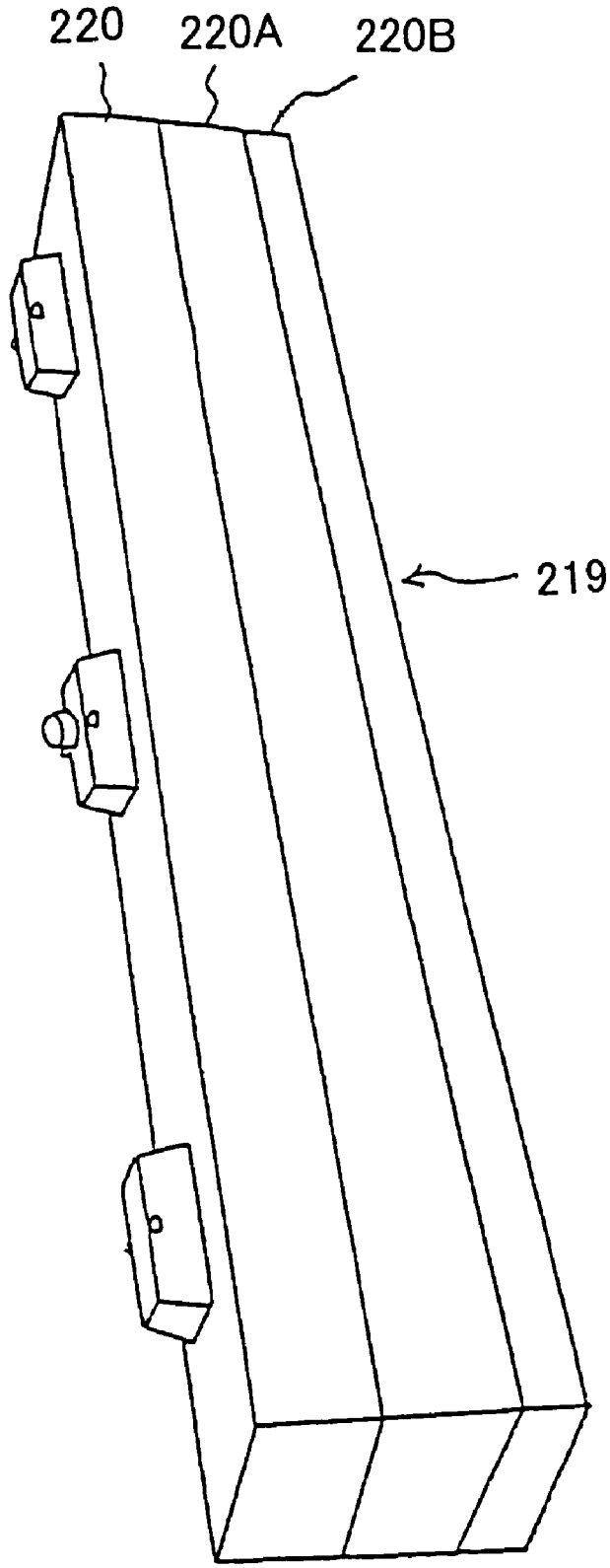
FIG. 29 is a perspective view of a shock absorber formed by joining three shock absorbing members to each other.

The third shock absorbing member 220B as shown in FIG. 25 is formed substantially the same as these shock absorbing members 220 and 220A except the point that the thickness T2 is different from the thickness T1 of the other two shock absorbing members 220 and 220A. Further, this shock absorbing member 220B can be detachably yet integrally coupled to either the shock absorbing member 220 or 220B to form a single shock absorber 219 as shown in FIG. 28 in the completely same manner as explained above. In addition, as shown in FIG. 29, the three shock absorbing members 220, 220A, and 220B can be detachably coupled to each other in series to form a single shock absorber 219.

It is clearly understood from the explanation, the shock absorber 219 can be formed by a single shock absorbing member, or by coupling two or more of shock absorbing members having the same or different thickness from each other as required. That is, it is possible to form the shock absorber 219 having any thickness fitting any gap G1 between the article 202 and the support 204.

FIG. 22 to FIG. 24 show an example of how the shock absorber 219, formed by coupling the two shock absorbing members 220 and 220B shown in FIG. 25 to each other, is disposed in the gap G1 between the article 202 and the support 204. In this case, the protruding portion 221, the projections 223, and the protrusion 224 of the shock absorbing member 220 function as the protruding portion 221, the projections 223, and the protrusion 224 of the shock absorber 219, respectively.

As shown in FIG. 17 and FIG. 22 to FIG. 24, a groove 226 is formed on the surface of the support 204, fitted to the pallet 203, facing the article 202 on the pallet 203 along the length of the support 204 in its longitudinal direction. Further, fitting holes 227 are made in the part of the support forming the bottom wall of the groove 226. The number of the fitting holes 227 may be one, but in this shown example, a plurality of fitting holes 227 are made on each support 204 along its longitudinal direction.

In order to fit each shock absorber 219 to each support 204, as shown in FIG. 22, the shock absorber 219 is faced to the support 204 in parallel with each other. The protrusion 224 of the shock absorber 219, that is, the protrusion 224 (FIG. 25) of the shock absorbing member 220 in the example shown in FIG. 22 to FIG. 24, is positioned in a desired fitting hole 227 on the support 204. The shock absorber 219 is then pressurized to the support 204 in the direction indicated by the arrow C in FIG. 22. Accordingly, as shown in FIG. 24, the protruding portion 221 of the shock absorber 219 is fitted into the groove 226 formed on the support 204, and the protrusion 224 of the shock absorber 219 is fitted into the fitting hole 227 of the support 204. At this time, the projections 223 formed on the protruding portion 221 are click-fitted to the groove 226. Accordingly, the shock absorber 219 can be prevented from its disengagement from the support 204 in the direction opposite to the arrow C (FIG. 22). Further, since the protrusion 224 of the shock absorber 219 is fitted into the fitting hole 227 of the support 204, the shock absorber 219 can also be prevented from slipping down from the support 204. The shock absorbers 219 are fixed to the supports 204 in such a manner so as not to be disengaged from the supports 204.

In the shown example, although the shock absorbers 219 are fixed to all the supports 204, the shock absorber 219 may be fixed only to a desired support 204. As shown in FIG. 24, another shock absorber is not coupled to the shock absorbing member 220B that is in contact with the article 202. Therefore, the rectangular grooves 222 (FIG. 26) may not be formed on the rear side of the shock absorbing member 220B.

As explained above, by fitting the supports 204 with the shock absorbers 219 to the pallet 203 with the article 202 loaded, the article 202 can be held by the supports 204 through the shock absorbers 219 as shown in FIG. 24. Thus, inconvenience such that the article 202 largely vibrates during transport can be prevented. The shock absorber 219 can be easily detached from the support 204 by manually pulling the shock absorber 219 in the direction opposite to the arrow C.

As understood from the explanation, the groove 226 and the fitting hole 227 formed on the support 204, and the protrusion 224, the protruding portion 221, and the projections 223 formed on the shock absorber 219 are structured as an example of the fixing unit that fixes the shock absorber 219 to the support 204. However, the fixing unit may be formed only by a part of these elements, or some other adequate fixing unit may be used. Further, the fixing unit may be formed by making the fitting hole on the shock absorber and making the protrusion to be fitted into the hole on the support.

In either case, the article conveyance and storage device has shock absorbers each disposed between the article loaded on the pallet and the support fitted to the pallet, and the fixing units each of which fixes the shock absorber to the support. Accordingly, the inconvenience such that the article during conveyance largely vibrates can be prevented, and the shock absorber can easily be detached from the support yet securely be fixed to the support. Further, the shock absorber can be used many times, therefore, there is no need to dispose the shock absorber at the destination of the article. Accordingly, it is possible to reduce the amount of produced wastes.

As explained above, the fixing unit has the protrusion 224 provided on either of the shock absorber 219 and the support 204 and the fitting hole 227 which is formed on the other one and into which the protrusion 224 is fitted, which makes it possible to prevent the shock absorber 219 from slipping down from the support 204 and securely fix the shock absorber 219 to the support 204.

Further, as the shown example, the fitting hole 227 is made on the support 204 and if a plurality of fitting holes 227 are made along the length of this support 204, it is possible to freely select any fitting hole 227 into which the protrusion 224 is to be fitted. Accordingly, the article 202 can be loaded to a position having a height at which the article 202 can most securely be fixed to the support 204 according to the shape and the size of the article 202 on the pallet 203. Thus, further stability of the article during conveyance of the article 202 can be increased.

As the shown example, the fixing unit has the groove 226 which is formed on the support 204 and extends along the longitudinal direction of this support 204, and the protruding portion 221 which is formed on the shock absorber 219 and is fitted into the groove 226. When the shock absorber 219 is fitted to the support 204, the shock absorber 219 can be prevented from its disengagement from the support 204 caused by rotating around the central part on the longitudinal direction by providing the protruding portions 221 at two or more positions spaced apart from each other in the longitudinal direction of the shock absorber 219. Thus, the shock absorber 219 can be securely fixed to the support 204.

Like the article conveyance and storage device 201 according to this embodiment, the protruding portion 221 has the projections 223 that are fitted into the grooves 226 of the support 204 and prevent the protruding portion 221 from its slipping out from the groove 226, which makes it possible to further securely prevent sliding of the shock absorber 219 with respect to the support 204.

The shock absorber may also be made from a foam or a solid formed with elasticity such as rubber. However, if the shock absorber 219 has at least one shock absorbing member whose internal side molded through blow molding is a hollow as shown example, retention of the outer shape of the shock absorber 219 can be enhanced and reduction in its weight can be achieved.

As explained above, the shock absorber 219 has a plurality of shock absorbing members detachably coupled to each other in the direction of their thickness, which makes it possible to form the shock absorber 219 having the thickness fitting any gap G1 between the article 202 and the support 204. Thus, the article 202 during conveyance can be more securely held and protected.

Figure 30:
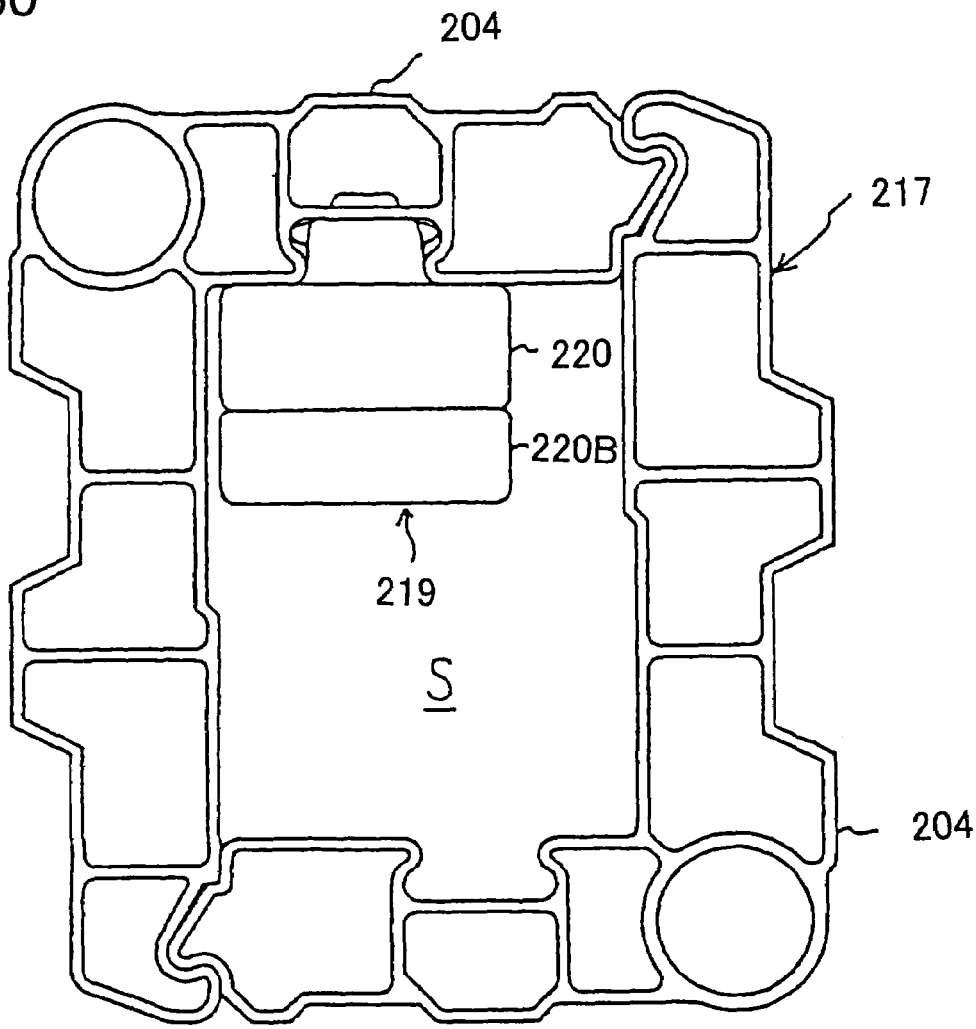
FIG. 30 is a plan view showing how to store the shock absorber in a space formed inside the support bundle obtained by joining two supports to each other.

As explained with reference to FIG. 20, the article conveyance and storage device 201 according to this embodiment has a support coupling unit that detachably couples two supports 204, that have been detached from the pallet 203, adjacently in substantially parallel with each other, and a space S is formed in the internal side of the two supports 204 when they are integrally coupled to each other. As shown in FIG. 30, the shock absorber 219 kept fixed to the support 204 can be accommodated in this space S. Although FIG. 30 shows how the shock absorber 219 is fixed to one of the supports 204, the shock absorbers 219 kept fixed to both of the supports 204 may be accommodated in the space as they are.

As explained above, the cross section of the support is set so that the space S, in which the shock absorber 219 fixed to at least one of the supports 204 is accommodated, can be formed inside the supports 204 when these two supports 204 are coupled by the support coupling units.

Based on the structure, when the supports 204 are detached from the pallet 203 and the supports 204 and the pallet 203 are to be sent to the original site such as a factory, the shock absorbers 219 can be accommodated in the internal space S of the bundle of the supports 204. Accordingly, the supports 204 and the shock absorbers 219 can be made compact in size to be efficiently conveyed. The same holds true for storage of these components.

Figure 31:
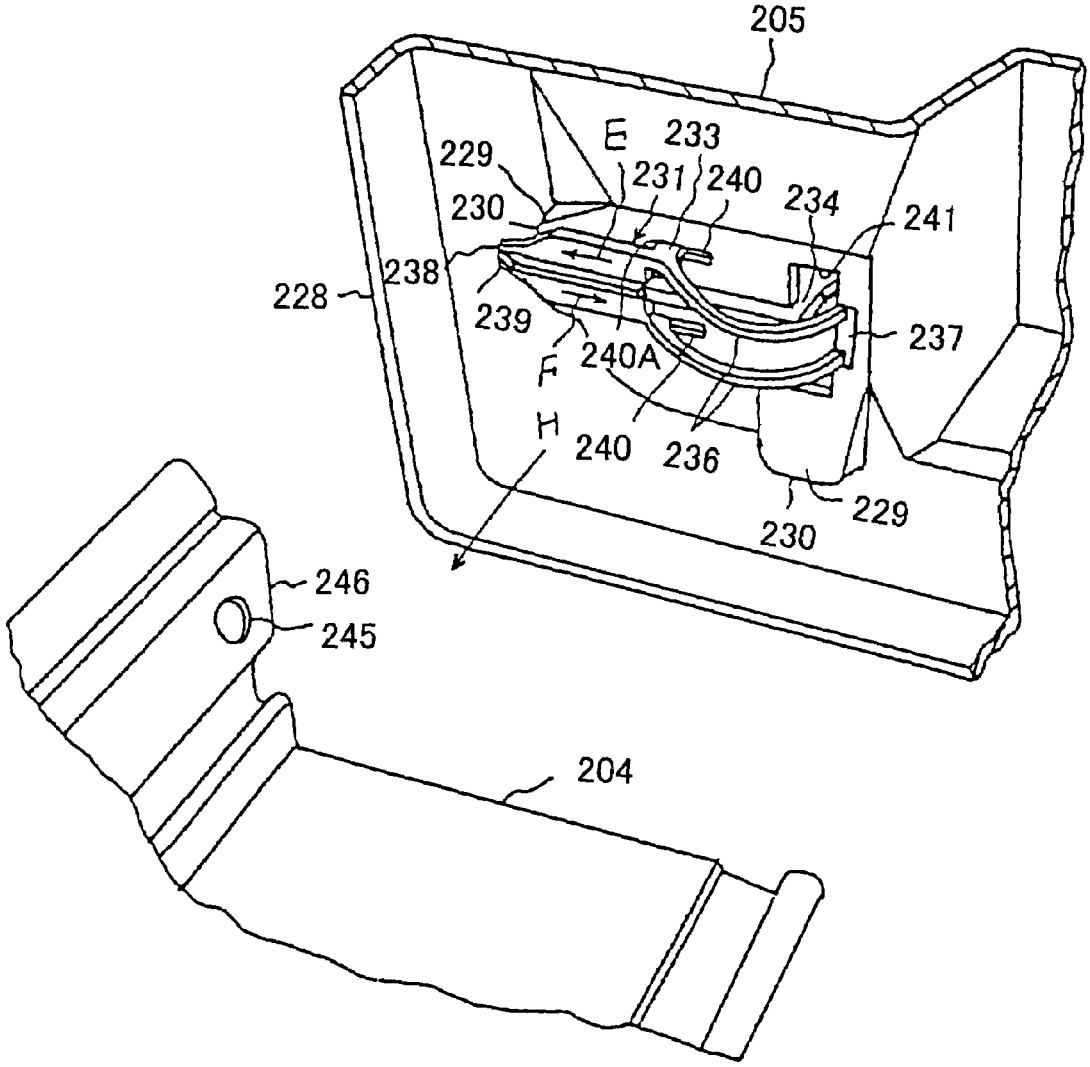
FIG. 31 is a perspective view of the top when viewed from its underside.
Figure 32:
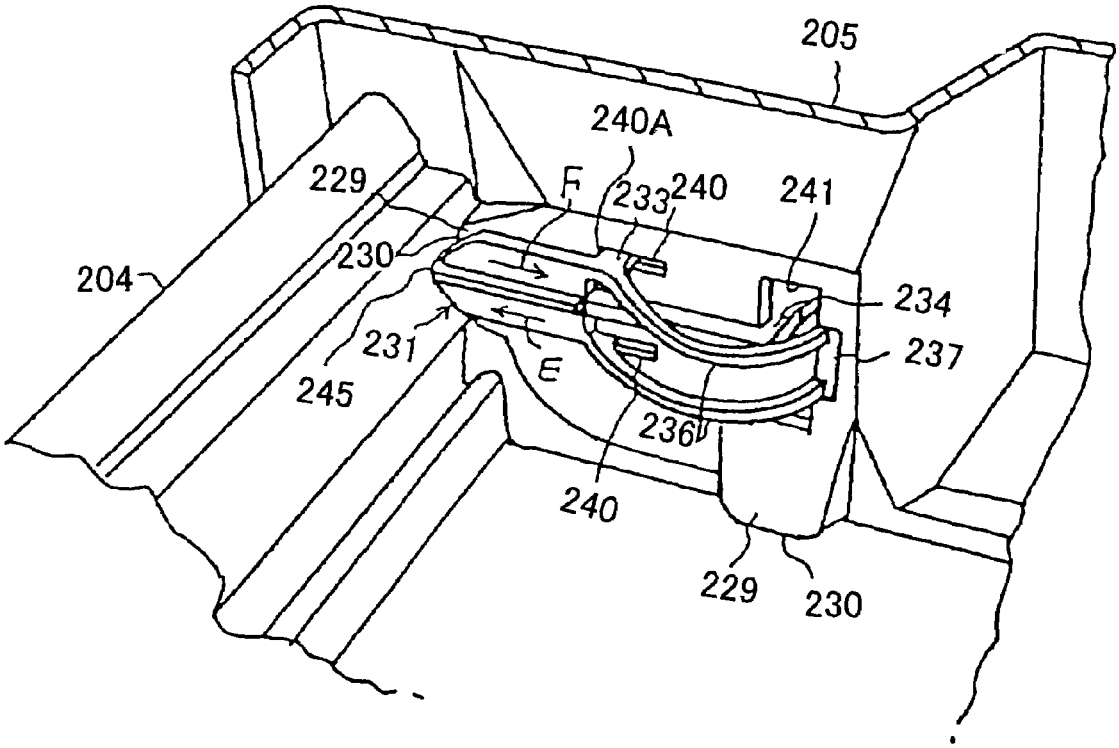
FIG. 32 is a perspective view of the top fitted to the upper part of the support when viewed from the underside of the top.
Figure 38:
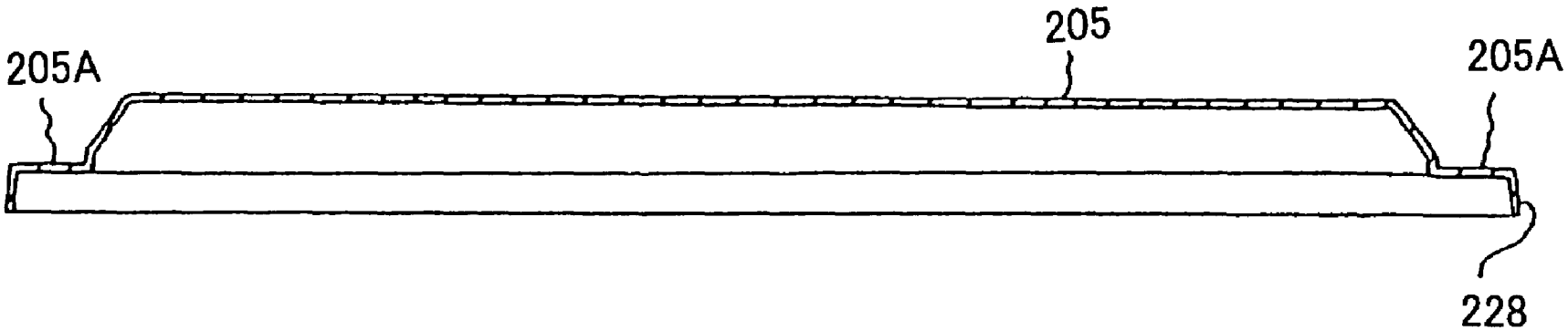
FIG. 38 is a cross-sectional view of the top taken along the line X-X in FIG. 16.

As explained above, the article conveyance and storage device 201 according to this embodiment has the top 205 detachably fixed to the upper parts of the plurality of supports 204 that are fitted to the pallet 203. As shown in FIG. 16, this top 205 is fixed to the upper parts of the supports 204. At this time, a flange part 228 extending downward is provided along the edge of the top 205, as shown in FIG. 16 and FIG. 38. As shown in FIG. 31, pairs of positioning protrusions 229 each facing the flange part 228 are formed at four corners on the rear surface of the top 205 (see also FIG. 34). When the top 205 is fixed to the upper parts of the supports 204, the upper parts of the supports 204 are fitted into the spaces each between an edge surface 230 of the positioning protrusion 229 and the flange part 228 so as not to be rattled, as shown in FIG. 32. That is, each of the upper parts of the supports 204 is sandwiched between the flange part 228 and the edge surface 230, so that the supports 204 and the top 205 are positioned. The top 205 has top positioning units that position the supports 204 and the top 205 through the upper parts of the supports 204 when the top 205 is fixed to the upper parts of the plurality of supports 204. In the shown example, the flange part 228 and the positioning protrusion 229 form the top positioning unit. However, any other adequate top positioning unit may also be employed.

Provision of the top positioning units allows the top 205 to be fixed to the supports 204 without rattling.

Although the top 205 may also be formed with wood or metal, the top 205 in this embodiment is formed with a hard-resin molded product. Further, this top 205 has high durability and high weather resistance so that the top 205 is used many times by being collected to the original site together with the pallet 203 and the supports 204 after the article is unloaded from the pallet 203. Further, if the top 205 is formed with a molded product obtained by molding a composite material of remanufactured plastic such as remanufactured polypropylene and paper, cost reduction and weight reduction of the top can be achieved.

When the top 205 is fixed to the upper parts of the supports 204, the resin film or the like is wound around the supports 204 and the top 205 in order not to disengage the top 205 from the supports 204, so that the top 205 can be fixed to the supports 204. However, if doing so, used resin film has to be disposed at the destination of the article, therefore, a large amount of wastes may be produced.

To solve this problem, the article conveyance and storage device 201 according to this embodiment has lock units to lock the top 205 into the supports 204 so that the top 205 will not be disengaged when it is fixed to the upper parts of the plurality of supports 204.

Figure 33:
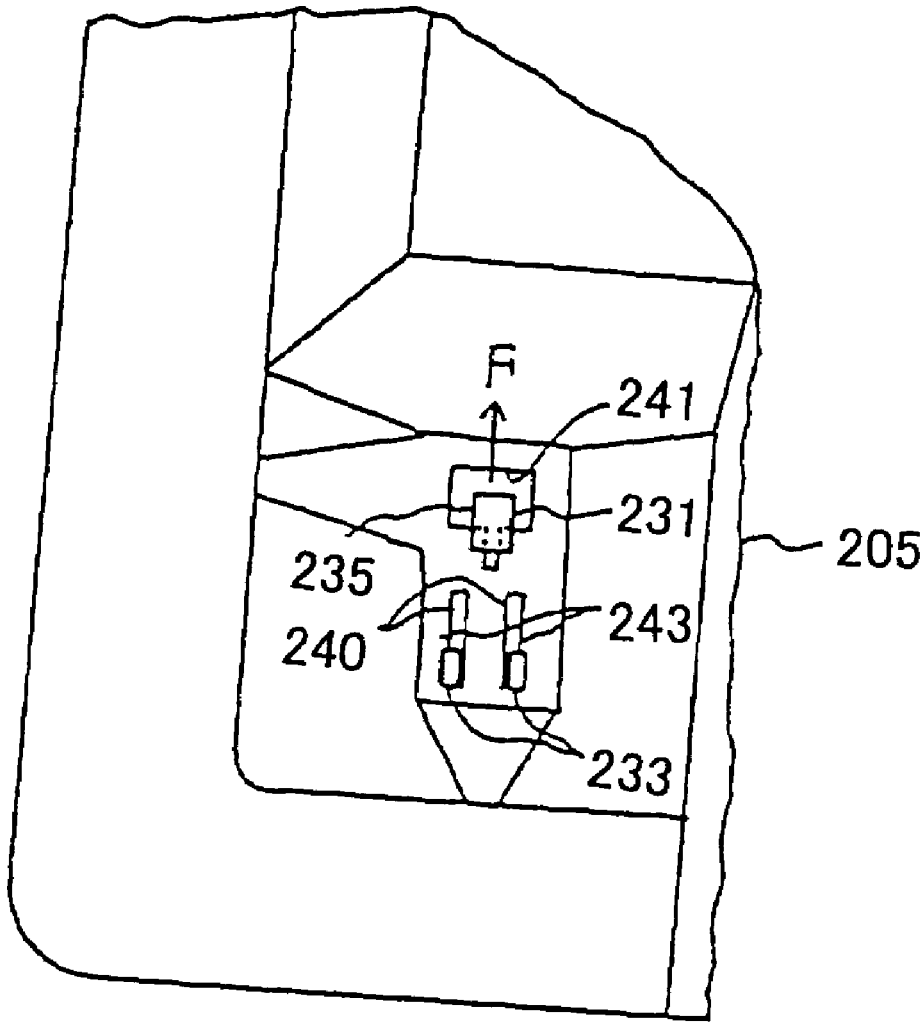
FIG. 33 is a plan view of a lock member fixed to the top when viewed from the upper side of the top.
Figure 34:
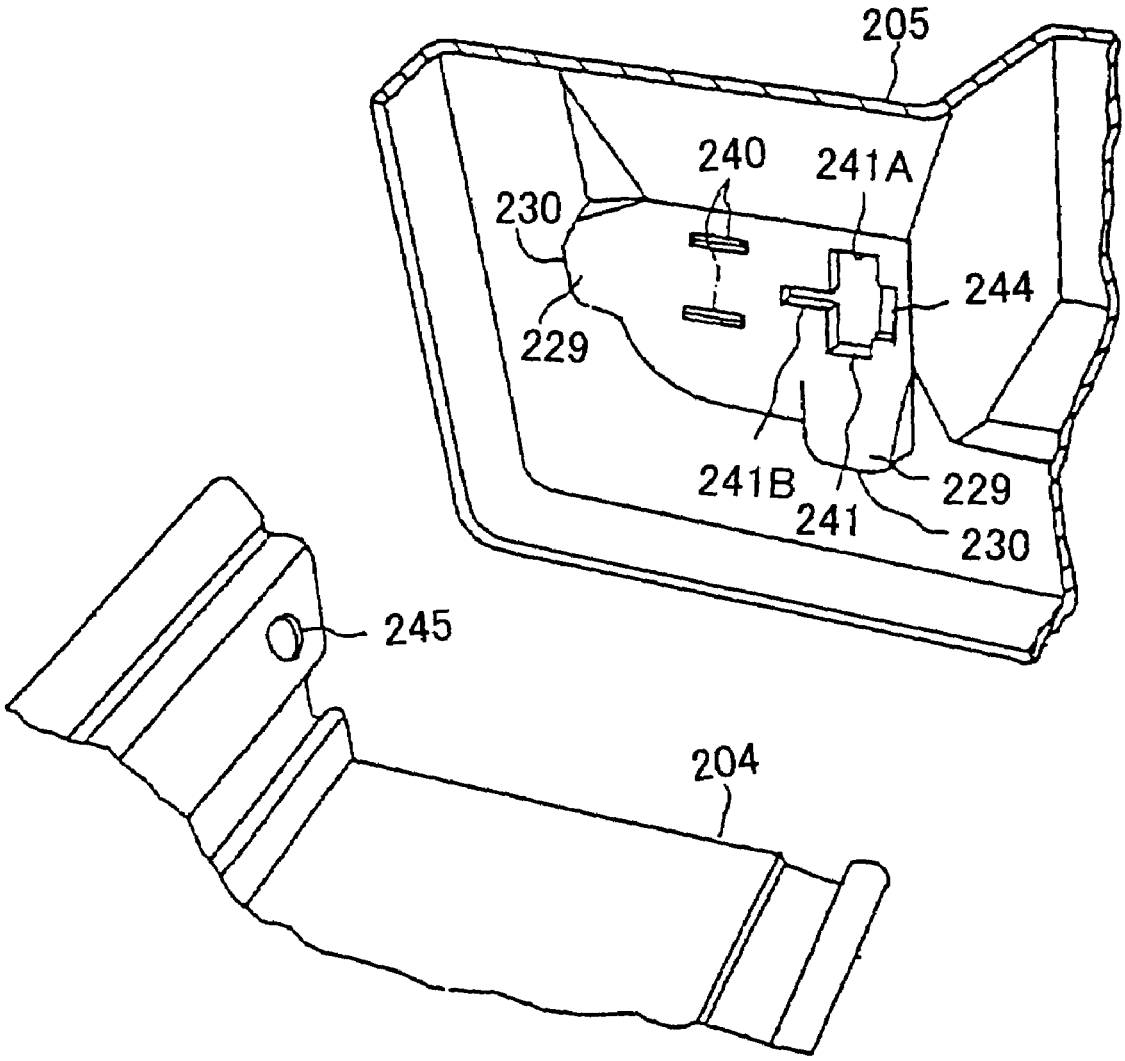
FIG. 34 is a perspective view of the lock member that is detached from the top when viewed from the underside of the top.
Figure 35:
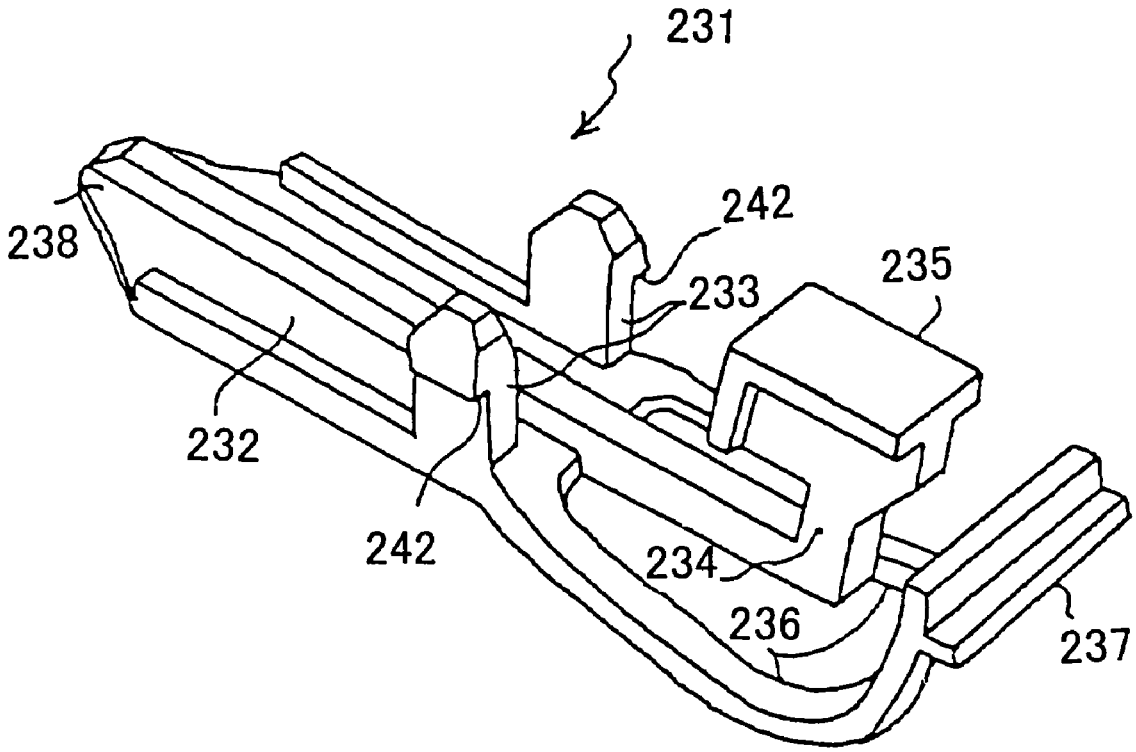
FIG. 35 is a perspective view of the lock member when viewed diagonally from its upper side.
Figure 36:
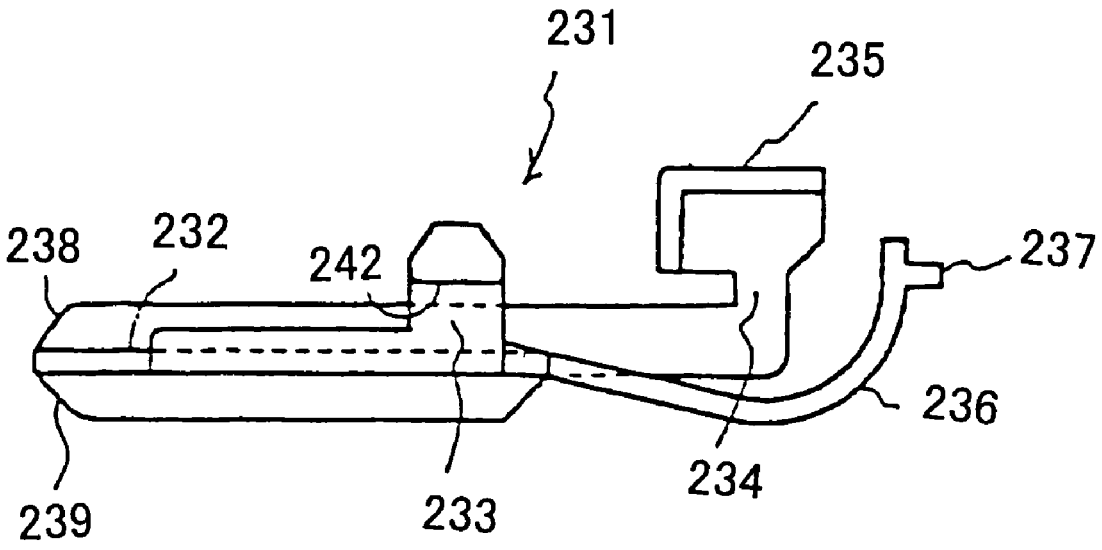
FIG. 36 is a front view of the lock member.

The lock unit according to this embodiment, as shown in FIG. 16, has lock members 231 provided at four corners of the top 205. FIG. 33 is an enlarged plan view showing one of the lock members 231. FIG. 34 is a perspective view of the lock member 231 in its detached state from the top 205 when viewed from the underside of the top 205. FIG. 35 is a perspective view of the lock member 231 when viewed diagonally from its upper side. FIG. 36 is a front view of the lock member 231. The lock member 231 shown here is formed with a single molded product obtained by molding resin such as polyacetal. This lock member 231 has a base 232, a pair of guide pieces 233 provided upward from the side edges of the base 232, a finger grip 235 integrally formed with the base 232 through a joint part 234, a pair of narrow-width springs 236 integrally joined to the base 232, and a joint piece 237 joining free ends of these springs 236. An edge part 238 of the base 232 is tapered, so that the underside surface of the edge part 238 is an inclined surface 239.

On the other hand, a pair of guide holes 240 and a substantially T-shaped fitting hole 241 are formed at each of the corners of the top 205. Therefore, the lock members 231 are fitted into these holes 240 and 241 from the underside of the top 205 as follows.

The guide pieces 233 are inserted from the underside of the top 205 into the guide holes 240, and are slidably fitted into the guide holes 240 in their longitudinal direction. At this time, hooks 242 formed on the guide pieces 233 are hooked with the edges 243 (FIG. 33) of the guide holes 240, so that disengagement of the guide pieces 233 from the guide holes 240 can be prevented. The finger grip 235 of the lock member 231 is inserted from the underside of the top 205 through a wide part 241A of the T-shaped fitting hole 241, and the finger grip 235 is projected upward from the upper side of the top 205 as shown in FIG. 33. At this time, the joint part 234 is slidably fitted into a narrow part 241B of the fitting hole 241 in its longitudinal direction. The joint piece 237, that joins the free edges of the pair of springs 236, is engaged with a fitting part 244 (FIG. 34) formed adjacent to the fitting hole 241 on the top part in contact with the fitting part 244 with pressure. When it is fitted, the springs 236 are elastically deformed, and the lock member 231 is energized by the spring force toward the edge part 238 as shown by the arrow E in FIG. 31 and FIG. 32, and the guide pieces 233 are pressed into contact with one ends 240A of the guide holes 240.

A lock hole 245 is formed on the support 204 as shown in FIG. 31. When the top 205 is fixed to the upper parts of the supports 204 as shown in FIG. 32, the edge part 238 of the lock member 231 gets into and is fitted into the lock hole 245 by a biasing action of the springs 236. The edge parts of the other lock members 231 are inserted into the lock holes 245 formed on the supports 204 in the same manner as explained above. When the top 205 is fitted to the upper parts of the supports 204 in such a manner, the top 205 is locked into the supports 204 by the lock units each formed with the lock member 231 and the lock hole 245 into which the lock member 231 is fitted, thus preventing disengagement of the top 205 from the supports 204. Further, the top 205 with the lock members 231 can be used many times, thus preventing inconvenience of the increased amount of wastes.

If each of the finger grips 235 of the lock members 231 are manually pushed in the direction indicated by the arrow F in FIG. 32 and FIG. 33, the lock members 231 are slid in the direction of the arrow F against the action of the springs 236, and the edge parts 238 of the lock members 231 are disengaged from the lock holes 245. Accordingly, the top 205 is held upward and is disengaged from the supports 204.

As explained above, the lock units of the article conveyance and storage device 201 of this embodiment has the lock holes 245 formed on the supports 204, and the lock members 231 slidably fixed to the top 205 and whose edge parts 238 are fitted into the lock holes 245. Further, the springs 236, that energize the lock member 231 in a direction that the edge part 238 of the lock member 231 is fitted into the lock hole 245, is formed on the lock member itself. By forming the springs 236 on the lock member itself in such a manner, the number of components forming the lock unit can be reduced. Thus, cost reduction can be achieved.

Further, when the top 205 is to be fitted to the upper parts of the supports 204, the top 205 is put closer from the upper side of the supports 204 to the supports 204 as shown by the arrow H in FIG. 31, the under side inclined surface 239 of the edge part 238 of the lock member 231 is brought into contact with an upper edge 246 of the support 204. By further pressing the top 205 downward indicated by the arrow H, the inclined surface 239 of the lock member 231 is pressurized by the upper edge 246 of the support 204, and the lock member 231 is slid in the direction of the arrow F against the action of the springs 236. By further pressing the top 205 continuously, the edge part 238 of the lock member 231 slides while contacting the outside of the support 204 with pressure. When the edge part 238 is positioned at the lock hole 245, the lock member 231 slides in the direction of the arrow E due to the biasing action of the springs 236, and the edge part 238 of the lock member gets into and is fitted into the lock hole 245.

As explained above, in the article conveyance and storage device 201 according to this embodiment, the inclined surface 239 is formed on the edge part 238. The function of the inclined surface is as follows. When the top 205 is pressed to the upper parts of the supports 204 in order to fit the top 205 to the upper parts of the supports 204, the edge part 238 of the lock member 231 is brought into contact with the upper edge 246 of the support 204 with pressure, and is pressurized by this upper edge 246. When the lock member 231 moves in the direction of departing from the lock hole 245 against the action of the springs 236 of the lock member and the edge part 238 of the lock member 231 is positioned at the lock hole 245, the edge part 238 is fitted into the lock hole 245 due to the action of its springs 236.

Based on the structure, simply by pressing the top 205 to the upper parts of the supports 204, the lock member 231 can automatically be fitted into the lock hole 245 to lock the top 205 into the supports 204, thus facilitating the work of locking.

The top 205 is fitted to the upper parts of the supports 204 as shown in FIG. 16, and another article conveyance and storage device is loaded on this top 205. The article conveyance and storage devices are vertically stacked in plural stages, and articles loaded on these article conveyance and storage devices can be conveyed or stored as well. At this time, two sides 205A, 205A and the other two sides 205B, 205B of the periphery of the top 205 are flat, and the central part of the top 205 except the flat parts 205A and 205B is projected upward from the flat parts 205A and 205B. When the pallet of another article conveyance and storage device is loaded on such a top 205, the leg parts 206, 206 are placed on the flat parts 205A, 205A. Further, auxiliary leg parts 206A and 206A, that extend downward from the parts between both the leg parts 206, 206 of the loading plate 207, are placed on the flat parts 205B, 205B of the top 205. Accordingly, the upper-side article conveyance and storage device can be properly positioned in and vertically stacked on the lower-side article conveyance and storage device.

As shown in FIG. 16, inclined guide surfaces 247, each of which becomes gradually higher toward the central part of the top 205, are formed at parts of the periphery of the top 205. This inclined guide surface 247 may also be formed along the entire periphery of the top 205, or may be formed at least a part of the periphery of the top 205.

As explained above, when another article conveyance and storage device is loaded onto or unloaded from the top 205 of the article conveyance and storage device 201, the pallet 203 of the upper-side article conveyance and storage device is generally raised or lowered by the fork 208A of the cargo gear such as a forklift as shown by the chained line in FIG. 16. When doing such a work, the fork 208A is inserted into or taken out from a space on the top 205 of the lower-side article conveyance and storage device. In this case, since the inclined guide surface 247 is formed on the periphery of the top 205, the edge part of the fork 208A can be guided by the inclined guide surface 247 when the fork 208A is inserted into or taken out from the space on the top 205. Accordingly, it is possible to prevent inconvenience of damaging the top 205 by being strongly hit with the edge part 238 of the fork 208A.

Further, not another article conveyance and storage device but another particle, not shown, may be loaded on the top 205 of the article conveyance and storage device 201. When the article is loaded onto or unloaded from the top 205, the article can be guided by the inclined guide surface 247. Thus, the works of loading and unloading articles can easily be carried out.

As explained above, the lower parts of the supports 204 are fitted into the fitting grooves 212 (FIG. 14) formed on the pallet 203 and also engaged with the pins 213 (FIG. 28) projected on the pallet 203. Therefore, even when the supports 204 of the article conveyance and storage device 201 shown in FIG. 16 are pushed in the horizontal direction to move it on the floor or the load carrying platform of a truck, inconvenience of disengaging the supports 204 from the pallet 203 can be prevented. Further, it is also possible to prevent inconvenience of disengaging the supports 204 from the pallet 203 due to shock added to the article conveyance and storage device 201 during transport of the article 202.

As shown in FIG. 14 to FIG. 16, the article conveyance and storage device 201 according to this embodiment has the article holding members 209 that position and hold the article 202 with respect to the pallet 203. These article holding members 209 can be attached to the pallet 203 at different positions as shown in the following example.

Figure 37:
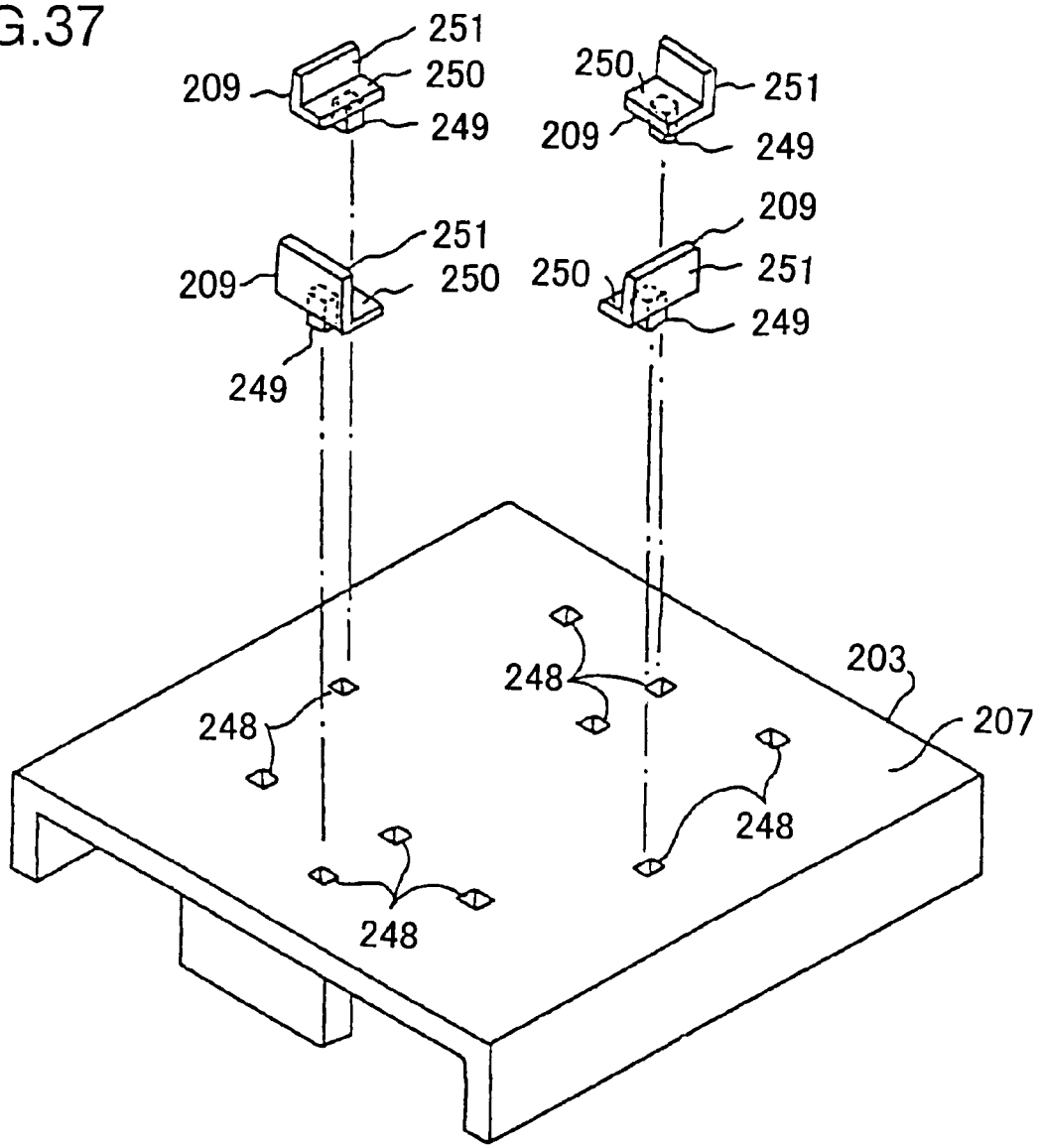
FIG. 37 is a perspective view showing the pallet on which mounting holes are made, and article holding members with fitting parts that fit in the mounting holes.

As shown in FIG. 37, many mounting holes 248 are made on the loading plate 207 of the pallet 203. While the each of the article holding members 209 has a fitting part 249 that detachably fits into any of the mounting holes 248 formed on the surface of the pallet 203, an article placing part 250 where the article is placed, and an article positioning part 251 that projects upward from the article placing part 250. Each of the article holding members 209 is positioned to the pallet 203 by selecting any of the mounting holes 248 matching the shape of the article 202 to be loaded onto the pallet 203 and inserting the fitting parts 249 of the article holding members 209 into the selected mounting holes 248. The lower part of the article 202 is placed on the article placing parts 250 of the article holding members 209. The article 202 is loaded onto the pallet 203 trough the article holding members 209 in such a manner. At this time, as shown in FIG. 16, the sides of the lower part of the article 202 are held by the article positioning parts 251 of the article holding members 209, which makes it possible to prevent the article 202 from slipping along the pallet 203 even during conveyance of the article 202.

As explained above, any of the large number of mounting holes 248 that are formed on the pallet 203 can be selected, and the fitting part 249 of the article holding members 209 are fitted into the selected mounting holes 248, so that the article holding members 209 can be mounted on a different position of the pallet 203. Therefore, the articles 202 of different shapes or different sizes can be positioned and held by the article holding members 209. The article holding members 209 of this embodiment has the article placing parts 250 on which the article 202 is placed, therefore, the article holding members 209 are pressed onto the pallet 203 by a load of the article 202. Accordingly, only by fitting the fitting parts 249 of the article holding members 209 into the mounting holes 248 formed on the pallet 203, the article holding members 209 can be securely fixed to the pallet 203. The need for lock units that lock the article holding members 209 to the pallet 203 is therefore eliminated, and the number of components of the article conveyance and storage device can be decreased.

Further, the article 202 may be directly loaded on the pallet 203 without providing the article holding members. In this case, however, the top surface of the pallet 203 is preferably marked to position the article 202. This mark may be a paint marking applied to the top surface of the pallet 203, a label stuck to the top surface, or a groove formed on the top surface of the pallet 203.

Further, fitting grooves and pins used for positioning the lower parts of the supports 204 are not shown in FIG. 37.

As explained above, the supports 204 of the article conveyance and storage device 201 of this embodiment are formed with a molded product made through extrusion of resin or metal. Therefore, only by cutting the molded product to a prespecified length, the supports of the same cross section can be manufactured, thus achieving cost reduction in the supports.

The article conveyance and storage device according to this invention may be formed so as to convey or store any types of articles other than copiers.

As explained above, according to still another aspect of this invention, the supports detached from the pallet can be securely tied in a bundle. Accordingly, the supports can be efficiently conveyed or stored.

Further, the supports can be coupled to obtain a bundle of the supports by the simple-structure support coupling unit.

Further, the bundles of the supports can be assembled. Accordingly, it is possible to prevent inconvenience that these bundles are shifting during transport.

According to still another aspect of this invention, inconvenience that an article largely vibrates can be prevented during transport of the article by the shock absorber provided between the article and each of the supports. The shock absorber can be easily fixed to the support.

Further, by fitting the protrusion into the fitting hole, inconvenience that the shock absorber may drop can be prevented.

Further, a plurality of fitting holes are formed. Accordingly, by selecting any of the fitting holes into which said protrusions are fitted, the shock absorber can be held at a desired height of the supports.

Further, by fitting the protruding portion of the shock absorber into the groove of the support, it is possible to prevent inconvenience that the shock absorber may rotate around the central part in its longitudinal direction.

Further, it is possible to prevent inconvenience that the protruding portion may be disengaged from the groove.

Further, retention of the outer shape of the shock absorbing member can be enhanced and reduction in its weight can be achieved.

Further, the shock absorber having any thickness matching a gap between the article and each of the supports can be formed. Thus, the article can be efficiently held by the shock absorbers.

Further, the shock absorber can be accommodated in a space internally formed by the two supports coupled to each other. Thus, these supports and shock absorbers can be made compact in size to be conveyed or stored.

Further, the upper part of the article loaded on the pallet can be protected by the top.

Further, the top can easily and securely be positioned and fixed to the upper parts of the supports.

Further, the top can be prevented from its disengagement from the supports.

Further, the lock member is fitted into the lock hole by the biasing action of the springs formed on the lock member itself. Thus, it is possible to reduce the number of components of the lock unit and achieve its cost reduction.

Further, only by pressing the top toward the supports, the lock members can be fitted into the lock holes. Thus, the work can be simplified.

Further, the works of loading and unloading articles on or from the top, or the work at the time of loading or unloading another article conveyance and storage device on or from the top can be facilitated.

Further, the supports can easily be positioned and fitted to the pallet.

Further, it is possible to prevent inconvenience that the supports are disengaged from the pallet.

Further, any article of a different shape or size can be positioned and loaded on the pallet.

Further, the article holding members are easily fixed to or detached from the pallet.

Further, the supports of the same cross section can easily be manufactured at a low cost.

The present document incorporates by reference the entire contents of Japanese priority documents, 2000-135235 filed in Japan on May 8, 2000, 2000-356640 filed in Japan on Nov. 22, 2000 and 2001-47288 filed in Japan on Feb. 22, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An article conveyance and storage device comprising:

a pallet including a top surface and a bottom surface; and a plurality of supports detachably fitted to said pallet, said plurality of supports configured to be not in contact with each other while fitted to said pallet, the plurality of supports including a first support and a second support, said plurality of supports including a support coupling unit configured to detachably couple the first support and the second support to each other and substantially parallel with each other when the first support and the second support are detached from the pallet, at least one of said supports is formed as a molded product obtained by extruding resin or metal, said at least one of said supports has a substantially L-shape in cross-section, said at least one of said supports includes a plurality of hollow parts partitioned inside said at least one of said supports, and said at least one of said supports includes an outer wall and a plurality of partition walls.

2. An article conveyance and storage device comprising:

a pallet configured to support the weight of an article;

a plurality of supports, each support in the plurality of supports having an upper part and a lower part, the lower parts of the plurality of supports are configured to be detachably fitted to said pallet, the plurality of supports including a first support including a lock hole;

a top detachably fixed to the upper parts of said plurality of supports fitted to said pallet, the top including a positioning unit configured to position the first support and the top by holding the upper part of the first support when the top is fixed to the upper parts of the plurality of supports; and a lock unit configured to lock and unlock said top to the upper part of the first support so that the top will not disengage from the first support while the lock unit is locked, the lock unit including a lock member mechanically connected to said top, the lock member including an edge part configured to move within a range of motion substantially parallel to a bottom surface of the top, the range of motion including a first position and a second position, the edge part configured to establish an interference fit with the lock hole when the edge part is in the first position and the first support is locked to the top, the edge part is configured to be disengaged from the lock hole when the edge part is in the second position and to unlock the top from the first support, and a spring connecting the edge part to the top and configured to provide a force in a direction of a force vector defined from the second position to the first position.

3. The article conveyance and storage device according to claim 2, wherein the edge part has an inclined surface configured to contact an upper edge of the first support when the first support is being fixed to said top and the inclined surface is configured to position the edge part for insertion into said lock hole by the spring.

4. The article conveyance and storage device according to claim 3, wherein an inclined guide surface, which becomes gradually higher toward a central part of said top, is formed at least a part of a periphery of said top.

5. An article conveyance and storage device, comprising:

a pallet including a top surface and a bottom surface; and a plurality of supports detachably fitted to said pallet, said plurality of supports configured to be not in contact with each other while fitted to said pallet, the plurality of supports including a first support and a second support, said plurality of supports including a support coupling unit configured to detachably couple the first support and the second support to each other and substantially parallel with each other when the first support and the second support are detached from the pallet, each of said supports formed as a molded product obtained by extruding resin or metal, each of said supports has a substantially L-shape in cross-section, each of said supports includes a plurality of hollow parts partitioned inside the respective support, and each of said supports includes an outer wall and a plurality of partition walls.

* * * * *